US010470559B2

(12) United States Patent
Fleischer

(10) Patent No.: US 10,470,559 B2
(45) Date of Patent: Nov. 12, 2019

(54) ILLUMINATION MEANS AND ACCESSORIES FOR A PAINTBRUSH AND METHOD

(71) Applicant: John Fleischer, Airdrie (CA)

(72) Inventor: John Fleischer, Airdrie (CA)

( * ) Notice: Subject to any disclaimer, the term of this patent is extended or adjusted under 35 U.S.C. 154(b) by 245 days.

(21) Appl. No.: 15/237,468

(22) Filed: Aug. 15, 2016

(65) Prior Publication Data

US 2017/0071327 A1 Mar. 16, 2017

Related U.S. Application Data

(63) Continuation-in-part of application No. 13/508,710, filed as application No. PCT/CA2010/001788 on Nov. 9, 2010, now Pat. No. 9,414,669.

(60) Provisional application No. 61/259,263, filed on Nov. 9, 2009.

(51) Int. Cl.

| | |
|---|---|
| ***A46B 15/00*** | (2006.01) |
| ***A46B 17/08*** | (2006.01) |
| ***F21V 33/00*** | (2006.01) |
| ***A46B 9/02*** | (2006.01) |
| ***A46B 17/04*** | (2006.01) |
| ***F21V 21/088*** | (2006.01) |

(52) U.S. Cl.

CPC ..... *A46B 15/0036* (2013.01); *A46B 9/025* (2013.01); *A46B 15/00* (2013.01); *A46B 17/04* (2013.01); *F21V 21/0885* (2013.01); *F21V 33/00* (2013.01); *F21V 33/0084* (2013.01)

(58) Field of Classification Search

CPC . A46B 15/00; A46B 15/0002; A46B 15/0036; F21L 4/04; F21V 33/00; F21V 21/0885; F21V 33/0084

See application file for complete search history.

(56) References Cited

U.S. PATENT DOCUMENTS

| | | | | |
|---|---|---|---|---|
| 6,026,828 | A * | 2/2000 | Altshuler | A46B 15/0002 132/308 |
| 2006/0215391 | A1* | 9/2006 | Jones | A46B 15/0002 362/91 |
| 2015/0290668 | A1* | 10/2015 | Cox | B05C 1/06 118/75 |

* cited by examiner

*Primary Examiner* — Randall E Chin

(74) *Attorney, Agent, or Firm* — Tu W. Nahm; Miller Thomson LLP

(57) ABSTRACT

This application describes an illumination means, and a method of attaching the accessories and protective coverings of the illumination means to a paintbrush to illuminate a work area, and to protect that illumination means from water and chemicals, while maintaining a compact, streamlined form that is easy to clean. With these illumination accessories and protection means installed, the intended use of the brush is primarily painting, and specifically cutting in around a trim or casing. The present invention provides the optimal lighting required for that specific work area, with no manipulation of the brush required by the user. Superior lighting is achieved by structurally directing light sources (LED's) to the specific location where the paint leaves the bristles while cutting in, and/or also structurally directing at a different angle to light up the general work area around the bristles while painting. Protective coverings are form-fitting and of minimal thickness.

9 Claims, 57 Drawing Sheets

707
707a
707b
709
710f
710h
710c
710j
730
720
741
743
750
740
760
762
710g
710m
710d
770
701b
703c
754
755
701d
700
744
758a
741c
741d
741a
758
Φ2
R1
741e
741f
705a
759
758a
705c
760
701
758
741b
P
A
748
741d
S
703a
B
704
704a
705
703b

P
709
710f
710c
710h
710j
710i
710e
720
720a
722
730
740
736
710m 741a
741
750
759a
700
P
B
704
704a
705
701a
703a
758a 759a
704
741a
700
A
741d
757
756a 710m
710g
743
760
710d
710m
710g
710f
741
761
750
760
741
709
710c
710f
709
710h
782
761
750

705
705c
761
709
741
754
740
755
760
710c
760
743
761
709
741
744
760
710c
782
709
743
761
730
720
741
760
700
705
709
760
705c
759a
756a
757
757

707
709
730
741
710
710c
710h
720
740
755
754
748
743a
743
782
752
701b
701a
703a
700
700a
701d
749
710f
758a
758
760
705
751b
751a
753
743a
755
754
740
758
743
782
760
758a
705c
747
751
741a
S
741
758b
710h
758a
758b
751c
751
705b
705
S

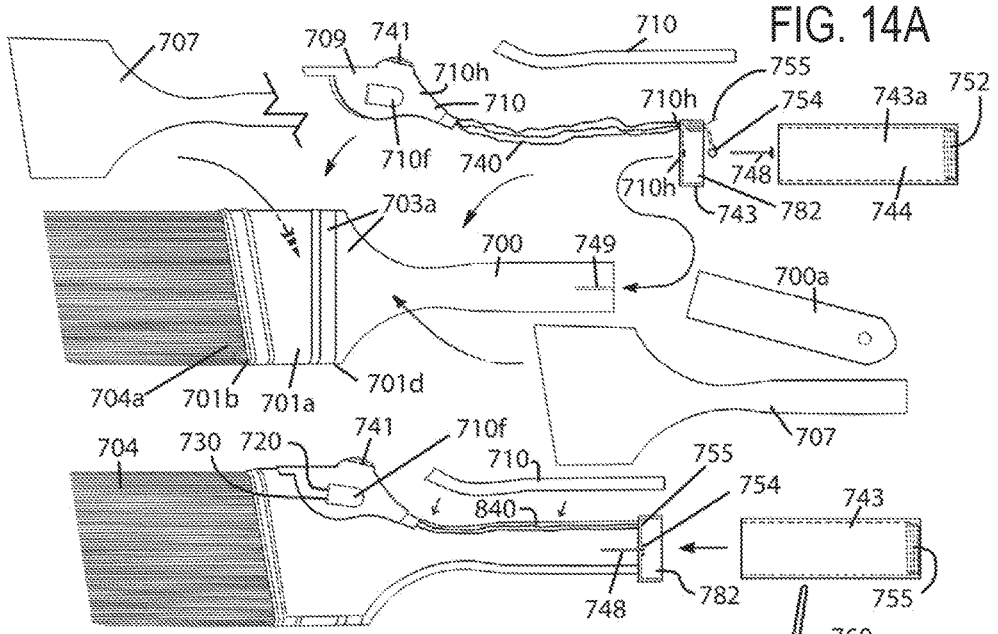
FIG. 14A
FIG. 14B
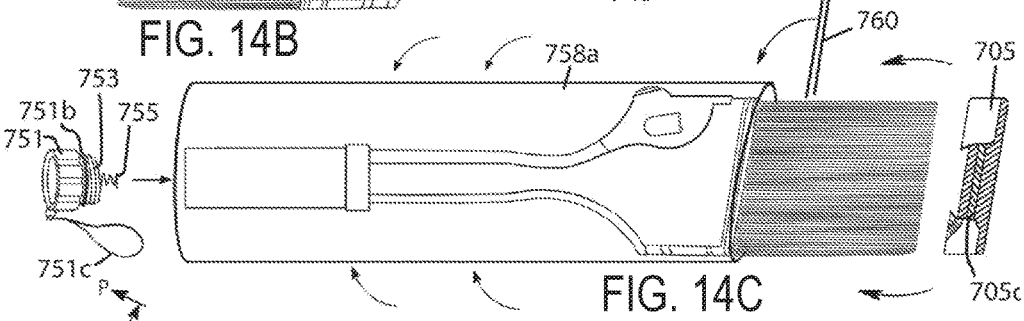
FIG. 14C
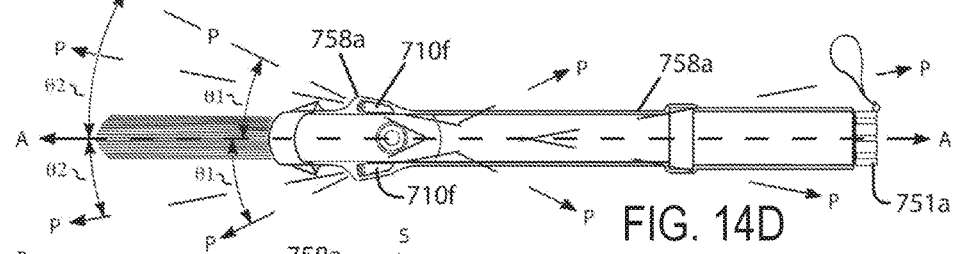
FIG. 14D
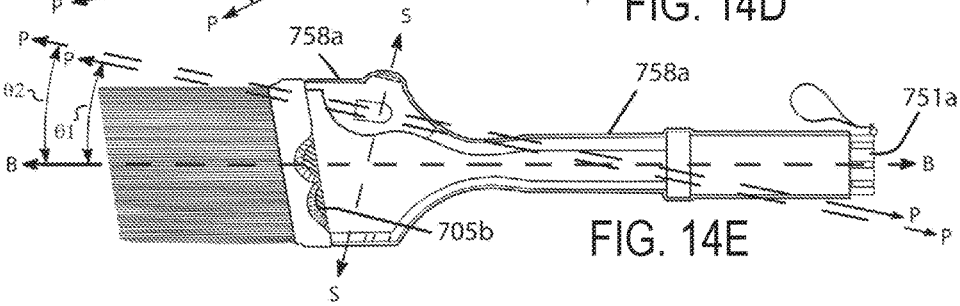
FIG. 14E 776
777
778
721a
A
B
P FIG. 33A
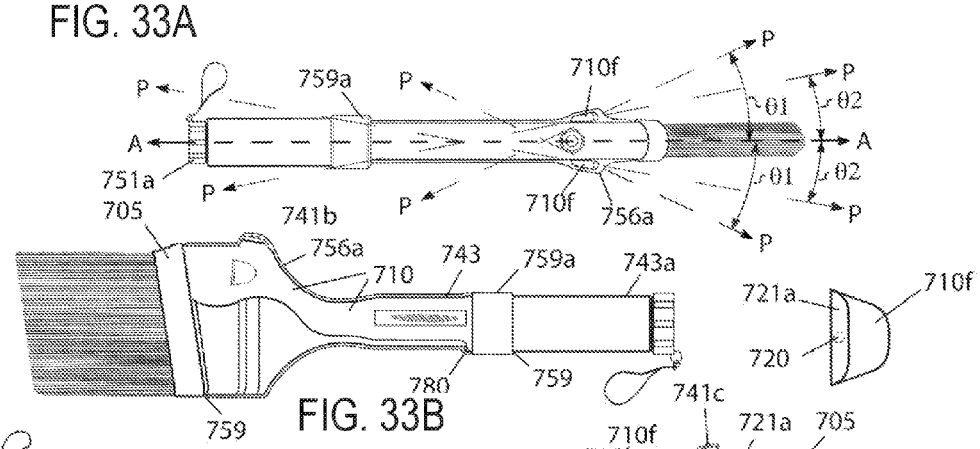
FIG. 33B
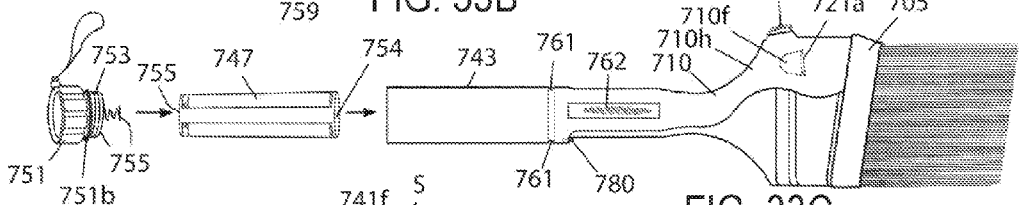
FIG. 33C
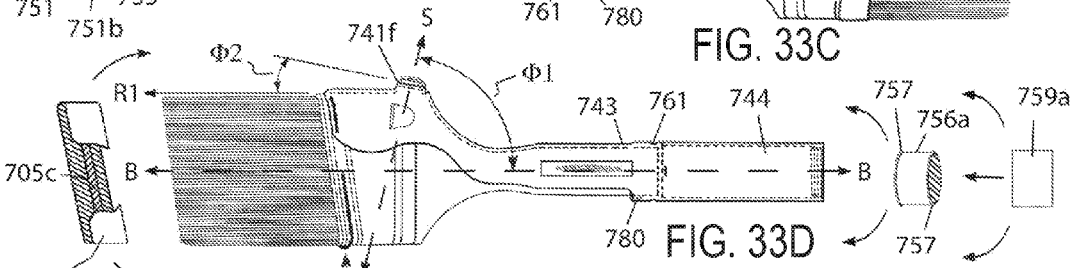
FIG. 33D
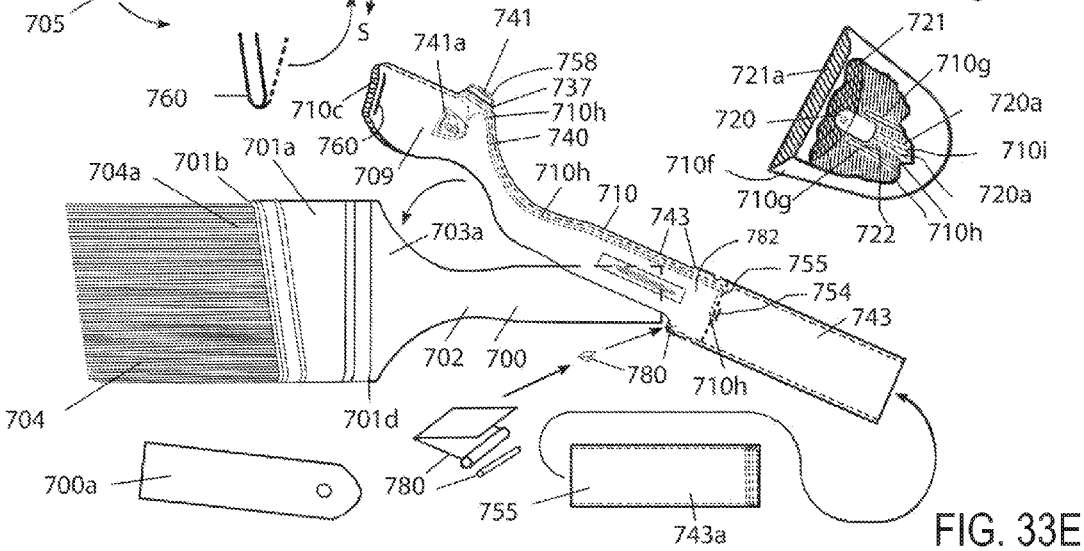
FIG. 33E FIG. 37A
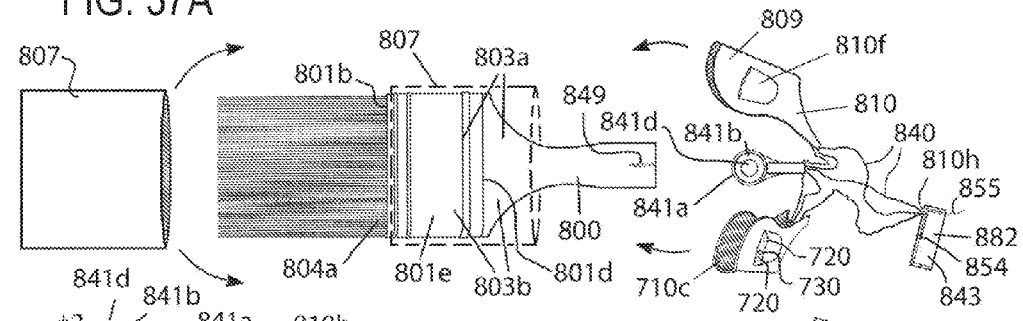
FIG. 37B
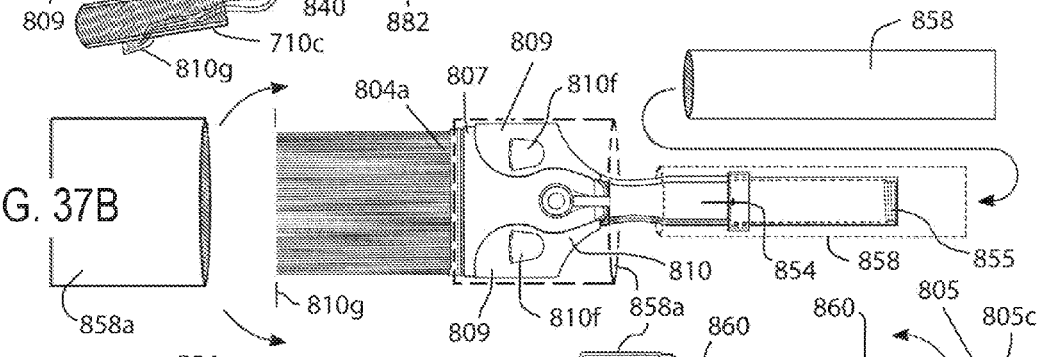
FIG. 37C
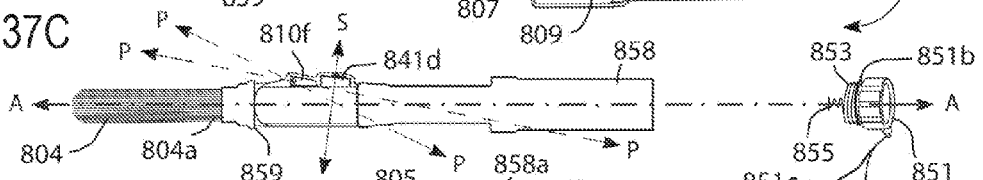
FIG. 37D
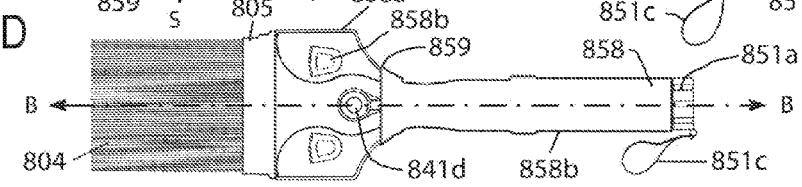
FIG. 37E 807
804
801b
807
803a
800
849
804
804a
803b
809
810f
820
830
840
810h
854
Φ2
841
810h
720
730
843
710c
809

820
830
809
810
770
810h
855
882
848
848
840
801g
807
810d
800a 858a
860
810f
810
841
855
843
843a
854
852
840
841a
807
809
770
858a
810f
841e
852
854
858
855
852
848
855
810
804
804a
860
809

860
858b
809
855
858
851
855
847
842
851a
853
851b
854
854
858b
807
805

858a
858b
858b
841
803c
859
851a
S
B
B
S
842
859
858
805

807
804
801e
803a
801d
800
800a
849
803b 810f
841
848
844
854
844
852
809
810f
809
810
810h
843
840
810h
843
843
855
710c
720
730
809
841
840
848
882
720
730
782
810h
840
844
810h
810f
804
804a
810
848
955
858
955
800
840
843
844
854
843
858a
801b
807
858a
810b
807
859
859
858
805
810b
860

810f
S
Φ1
804
R1
805
858a
858
851b
751
A
A
855
853
810b
S
741
S
741a
R1
R1
Φ2
S
S
S
R1
Φ2
741
S
741a
805
858b
859
858
751a
B
B 804
804a
801b
801e
801d
803a
800
800a
807
B
B
803b 809
810f
860
809
710c
810f
730
720
810
710h
843
882
803a
892
720
730
841d
851b
841
841a
844
781
851
Φ2
810h
810h
810f
741f
860
841d
843
857
843a
857
856a
841a
810
860
857
856a
757
860
841a
844
857
810
809
804a
859a
857
810
809
807
805

804
804a
805
S
P
859
P
844
A
A
P
P
810f
Φ1
857
891
851b
851
893
S
893
894
859
758b
P
P
859a
843a
859
P
P
B
B
P
P
P
P
805
758b
859

776
810f
841
810
843a
859
851a
778
A
P
805
841d
751c
853
855
858
844
854
847
846
B
804
804a
809
800
848
810h
843
843a
840
801b
720
721a
721
752
851
801e
803a
801d
807
849
703b
800a

P
A
H
810f
S
858
851a
776
837
841
809
810
859
759
858
778
801f 804
804a
721a
810f
810h
843a
B
841
840
855
854
860
805
858

858c
837
720
722
821a
860
809
810
840
854
855
853
741d
710g
841a
843
848
843a
852
851
851b
701g
Y
801e
X
Z
802
800
B
849
801d
801b
800a

FIG. 78A
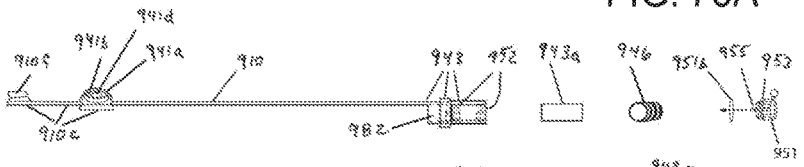
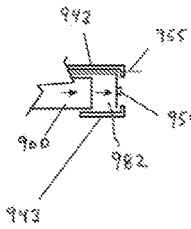
FIG. 78B
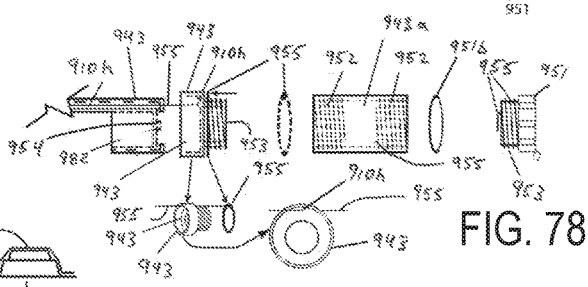
FIG. 78C
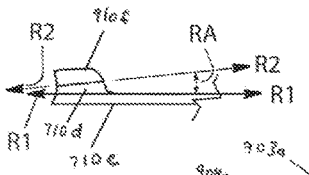
FIG. 78D
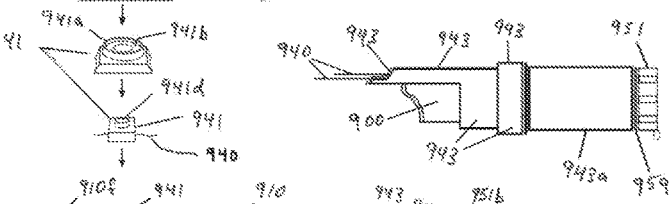
FIG. 78E
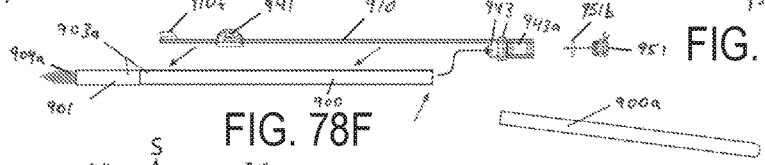
FIG. 78F
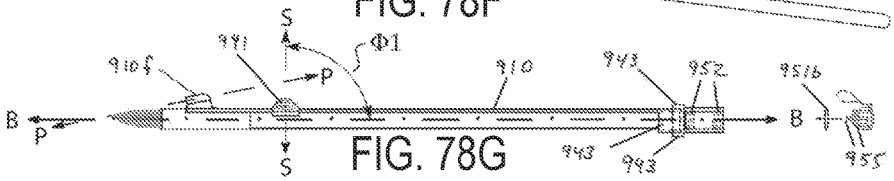
FIG. 78G
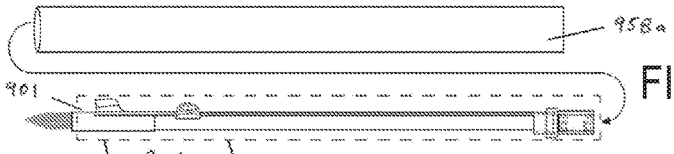
FIG. 78H
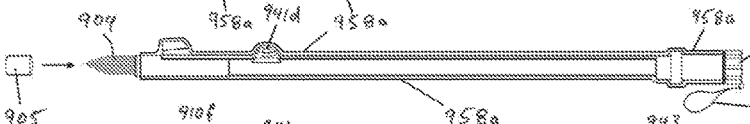
FIG. 78I
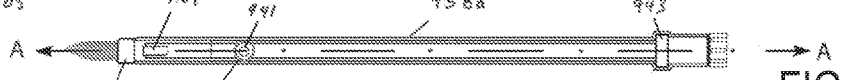
FIG. 78J
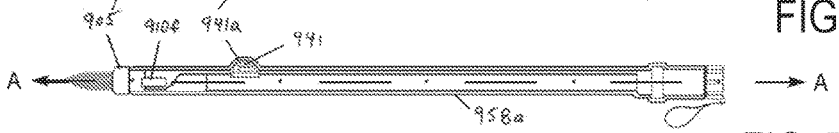
FIG. 78K 770
904a
905
958b
958
951
A
A
958a
958b
943a
951

958a
943a
959
953
951
770
959
958
951b
955

905
958
904
720
958a
958
730
720
941a
943a 941
910h
910f
910
943a
954
952
958a
958a
940
948
943

777
776
776
955
943a
955
P
P
B
p
B
p
778
910d
901b
901f
941
940
943
982
901d 776
777
955
943
943a
P
778
P
A
p
p
A
910f
948
P
910f
941a
941d
910
940
720
730
720
941b

Y
X
Z
701g
701g
901f
902
A
A
701g
701g
901b
901d
900
900a
Y
X
Z

FIG. 81A
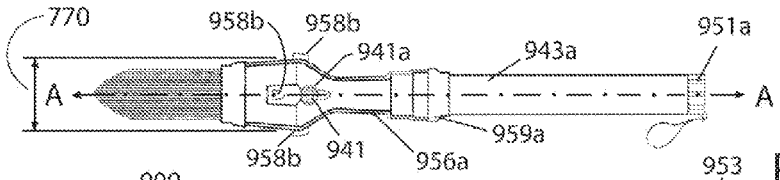
FIG. 81B
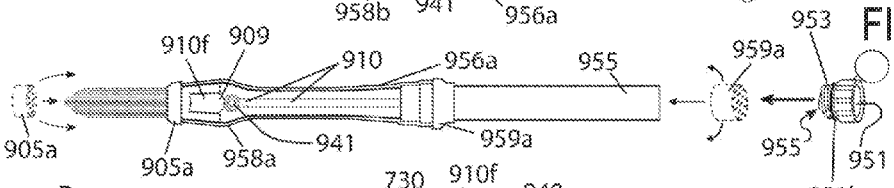
FIG. 81C
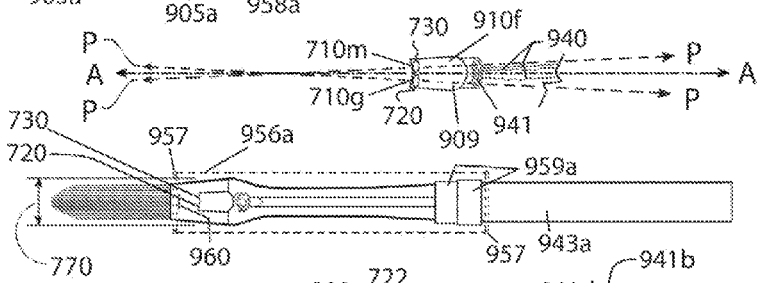
FIG. 81D
FIG. 81E
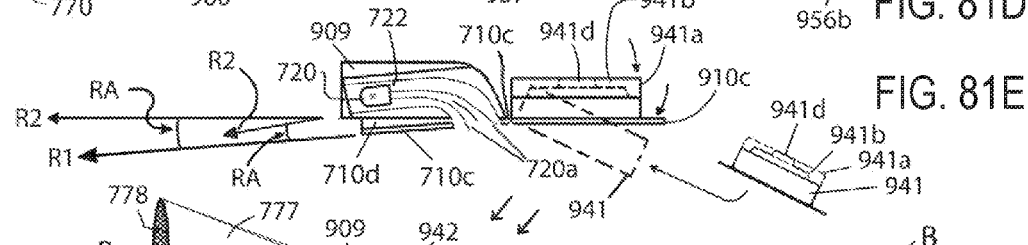
FIG. 81F
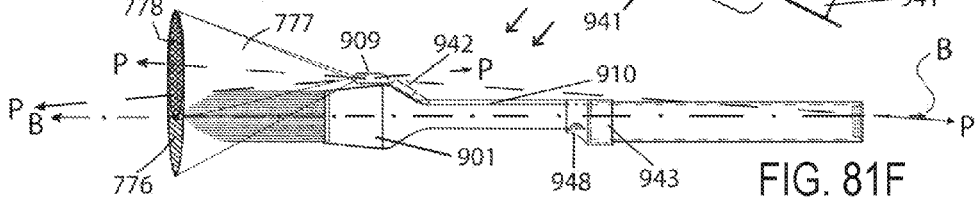
FIG. 81G
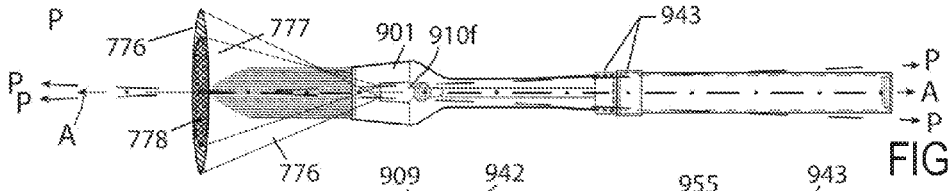
FIG. 81H
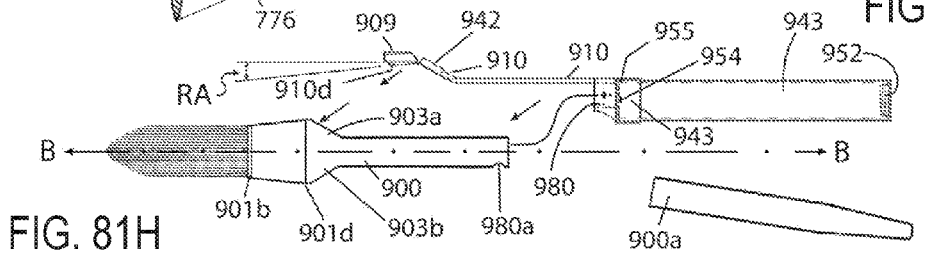

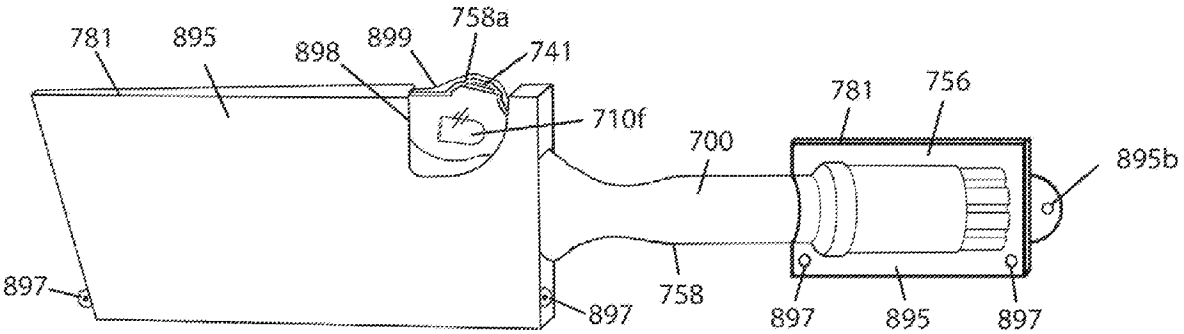
FIG 100
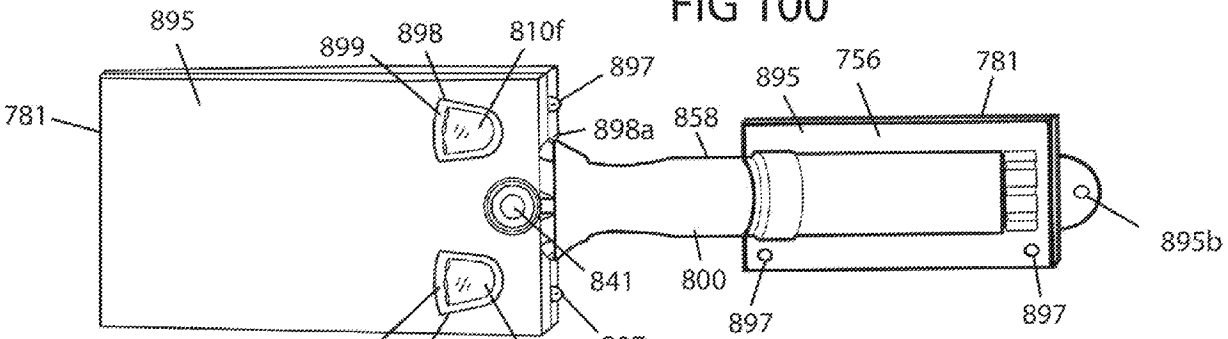
FIG 101
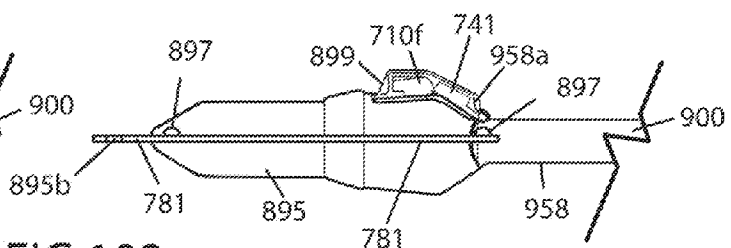
FIG 102
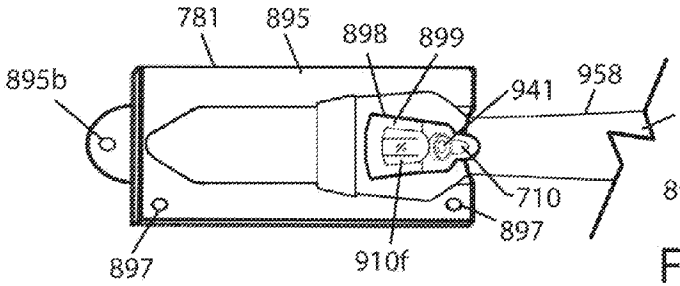

ILLUMINATION MEANS AND ACCESSORIES FOR A PAINTBRUSH AND METHOD

CROSS-REFERENCE TO RELATED APPLICATIONS

This application is a continuation-in-part of U.S. application Ser. No. 13/508,710, entitled LIGHT PACK FOR A PAINTBRUSH, LIGHTED PAINTBRUSH WITH HOLDER AND PAINT CAN LID FOR USE WITH HOLDER, issuing to patent as U.S. Pat. No. 9,414,669 on Aug. 16, 2016, which is a 371 of international PCT Appl. No. PCT/CA2010/001788 with an international filing date of Nov. 9, 2010, which is a non-provisional of U.S. Prov. Appl. No. 61/259,263 with a filing date of Nov. 9, 2009, all of which are hereby incorporated by reference in their entirety.

FIELD OF THE INVENTION

The present disclosure relates to an illumination means and accessories for a paintbrush, and a corresponding method.

BACKGROUND

It is known that confined areas such as at a corner where the wall meets the ceiling, or beside a moulding, are very difficult to illuminate well with a traditional work light during the painting process, since these high powered lights cast numerous shadows directly in front of the painter's brush, making it difficult to see and paint accurately, causing the painter lost time and frustration from having to repeatedly move and or adjusting the work light in order to properly illuminate the work area.

Some prior attempts have been made to try to address the problem. In one example, U.S. Pat. No. 4,916,773 issued on Apr. 17, 1990 (McCoy) describes an illumination means, complete with power source, mounted onto the ferrule area of a paintbrush, to illuminate a general area directly ahead of the brush. One bulb is mentioned as the light source. Therefore, if lighting is required in a different or more specific area, the painter must manipulate the brush to obtain better lighting, which could interfere with the quality of the paint job, and be frustrating for the painter. Also, by having the power source of the illumination means mounted on the ferrule area, additional bulk is added to that area, which may block the painter's view and also affect the natural gripping of the brush. Because the illumination means in McCoy is attached to the ferrule with wires, the ferrule area must be custom-designed to accept the wires. The wires are not easily detachable from the ferrule, which also interferes with the natural gripping of the brush, and makes cleaning of the mounting mechanism and surrounding area difficult. The design focuses on cleaning paint from the bristles, but no mention is made of any type of water/paint splatter protection, seals or water-resistant qualities to protect any features, including the bulb, of the illumination means.

In another example, U.S. Pat. Pub. No. 2006/0215391 filed Dec. 29, 2005 (Jones et al.) describes a lighted detail brush with a custom-shaped handle that includes a housing that contains and retains the bristles when they are not in use, and a light (or plurality of lights) is connected to the housing, whereby the bristles are concealable and protected in the housing when the implement is not in use and extendable when the implement is in use. In Jones et al., if lighting is required in a different or more specific area, the user must manipulate the brush or manually point the light, which again could interfere with the quality of the paint job, and be frustrating for the painter. Protecting the bristles by retracting them is impractical in the case of larger paintbrushes, which are often the brushes of choice when cutting in. Again, no mention is made of any type of water/paint splatter protection, seals or water-resistant qualities to protect any features, including the bulb, of the illumination means.

Therefore, there is a need to further improve illumination means and accessories to address the limitations found in the prior art.

SUMMARY OF THE INVENTION

Apparatuses and methods are provided in which an illumination means is mounted onto a brush and protected by one or more coverings. The present invention combines a brush, such as a traditional paintbrush, with known, typical power sources and components, such as those found in various flashlights. In some cases, the paintbrush gripping end may be modified or altered to accept power source components and/or housings, and flashlight parts may be modified or altered into a suitable configuration to be attachable to the handle of the paintbrush or to an adaptor, such as a battery housing connector. This application discloses a variety of accessories for a paintbrush, including a) a variety of types and shapes of lighting accessories, b) sealed power source housings, which may be a battery housing attachable to a brush behind the ferrule, and c) protective coverings, and various combinations thereof. The accessories are configured to be attachable to a variety of types, sizes and shapes of brushes, and provide optimal illumination to one or more specific target areas during the painting process by strategically aiming one or more lights. All accessories are configured to maintain a thin, streamlined and natural appearance when installed on the brush. These brush accessories may be used on a variety of brushes that are intended for a variety of different applications, including, but not limited to: painting, archaeology, mechanics, cosmetology, and cleaning.

BRIEF DESCRIPTION OF THE DRAWINGS

FIGS. 14A-14E illustrate a group of accessories for fixing to a brush, with a single outer shell comprising a first outer shell extension and a second outer shell extension, installed independently from the first, a ferrule covering which covers a substantial portion of the brush ferrule and handle, and a one piece protective covering extending from the front of the gripping end near the bristle base to the end of the power source housing, and the angling of the lights and switch from the top and side view.

FIGS. 33A-33E illustrate an alternate illumination configuration to be removably fastened on to a modified brush handle, whereby the battery housing connector is slid over the modified end of the handle, and held in place by a spring steel clamp, with the outer shell resting on the upper shoulder, and the embodiment held in position on the handle by a bristle base protector (seal) and a back seal, with a rolled-on protective covering spanning between the two seals, as well as the assembly of the lighted paintbrush, and the angling of the lights from a top view and the angling of the switch from a side view in relation to Axis A and Axis B.

FIGS. 37A-37E illustrate one embodiment with two side views of a rectangular-ferruled brush with a modified handle, as a lighting accessory and protective coverings are installed, and a top view of the positioning and angling of the switch and lights.

FIG. 76 shows an enlarged cross-section of a light holder, with a curved lens, and an LED resting within the curved reflective portion.

FIG. 77 shows an enlarged cross-section of a light holder, with a curved lens and a riser, and the lens acting as a stop for the LED.

FIGS. 78A-78K illustrate lighting accessories and components for a small, thin round brush, and their assembly.

FIG. 79A illustrates a top view of a round brush, and handle being modified to accept an illumination means.

FIG. 79B shows the brush of FIG. 79A as the illumination means is installed, and the light cones and overlapping light cones produced.

FIG. 79C shows a side view of the brush of FIG. 79B.

FIG. 79D shows a top view of the brush of FIG. 79C as a first protective covering is installed.

FIG. 79E shows the lighted paintbrush of FIG. 79D as a second protective covering is installed.

FIG. 79F shows the lighted paintbrush of FIG. 79E, as the end cap is installed.

FIG. 79G shows a top view of the lighted paintbrush of FIG. 79F, with additional light sources.

FIG. 79H shows a top view of the lighted paintbrush of FIG. 79G, and the light emitted.

FIG. 79I shows a side view of the lighted paintbrush of FIG. 79G.

Figures 79A, 79B, 79C, 79D, 79E, 79F, 79G:
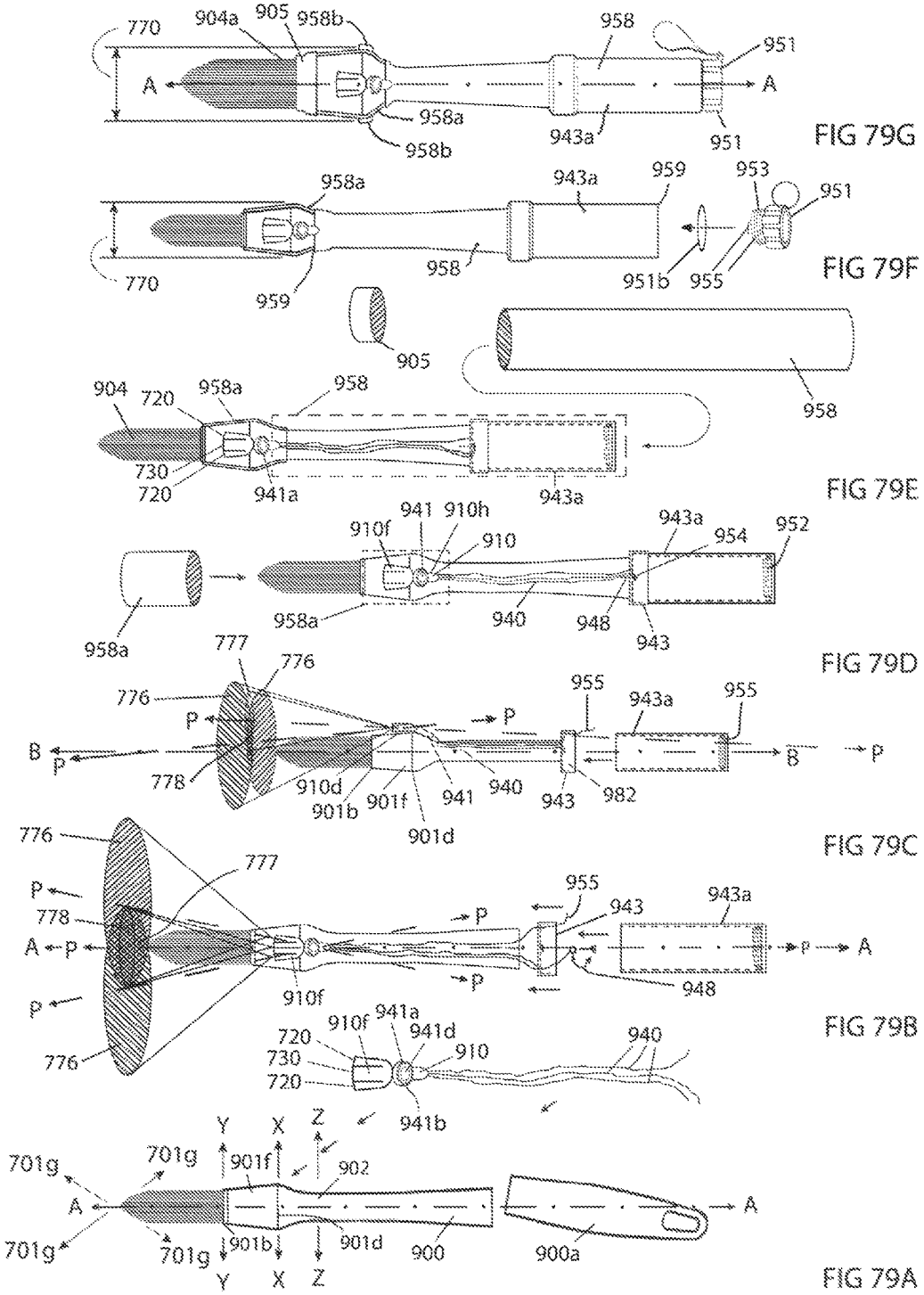
Figure 79H:
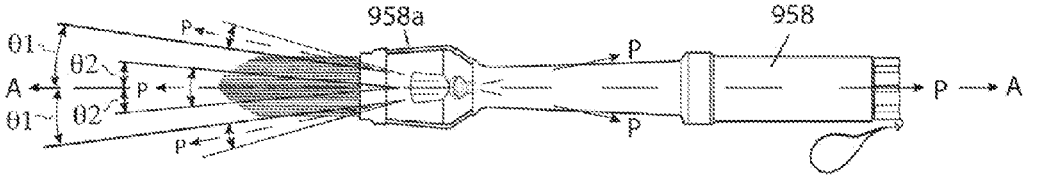
Figure 79I:
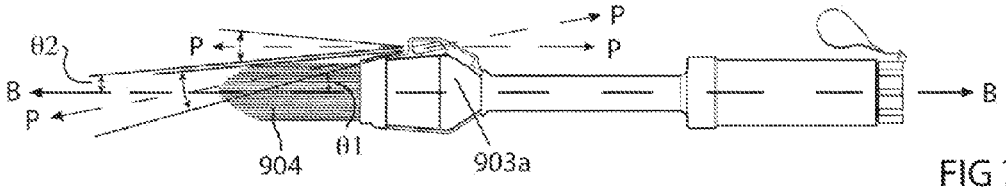
Figure 79J:
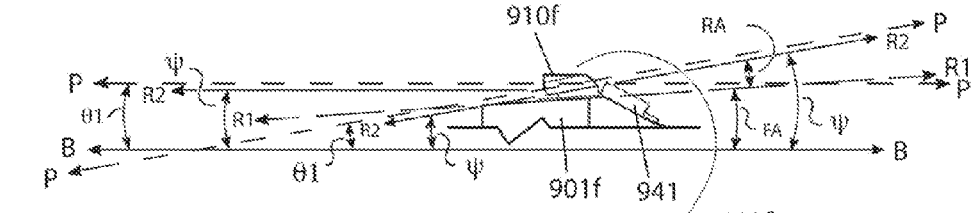
Figure 79J:
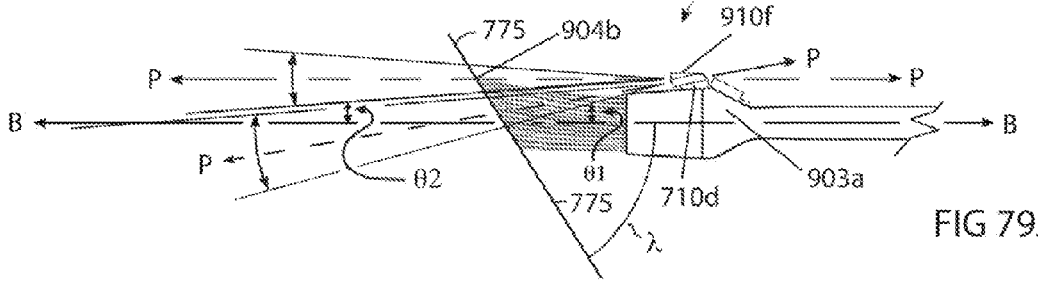

FIG. 79J shows two partial side views of the lighted paintbrush of FIG. 79I in painting action.

Figure 79K:
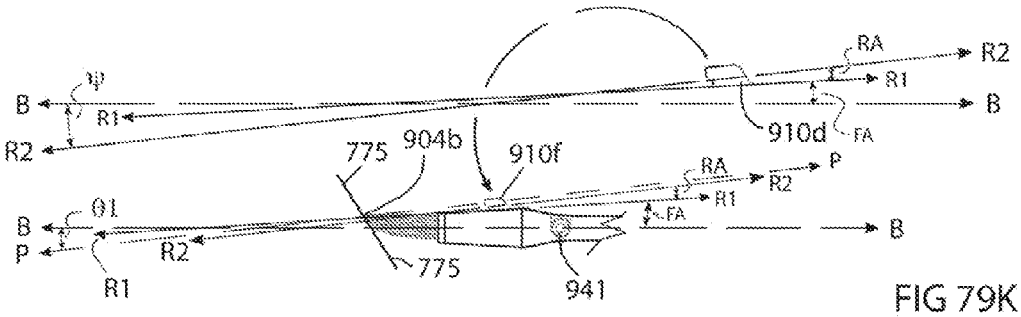

FIG. 79K shows partial views of components of the lighted paintbrush of FIG. 79H and FIG. 79J, and the angling of the rays emitted.

Figure 79L:
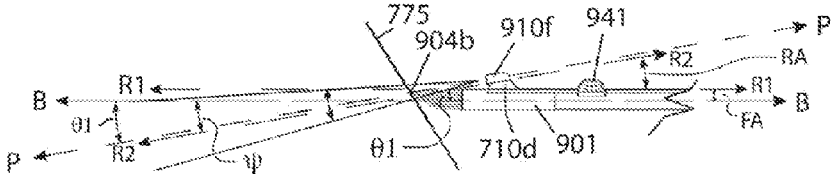
Figure 80A:
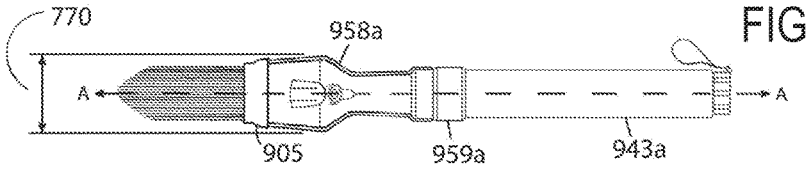
Figure 80B:
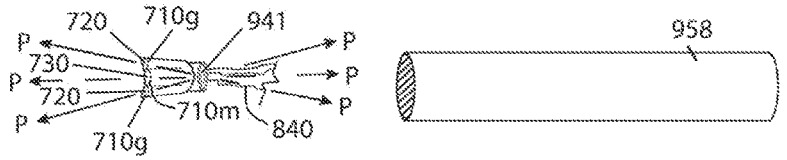
Figure 80C:
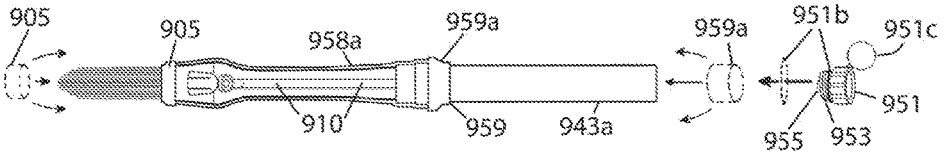
Figure 80D:
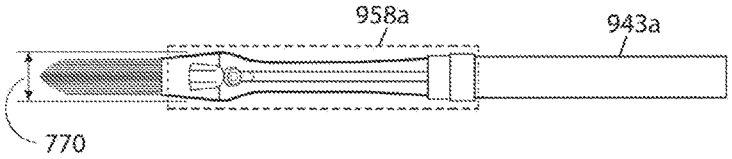
Figure 80E:
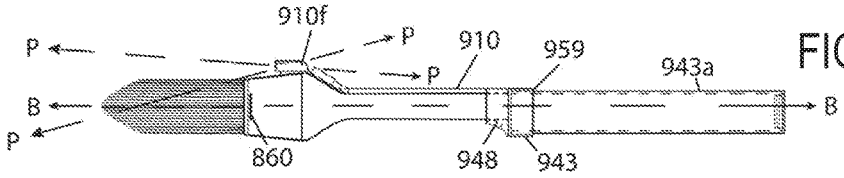
Figure 80F:
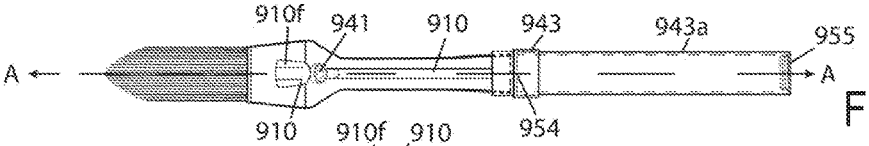
Figure 80G:
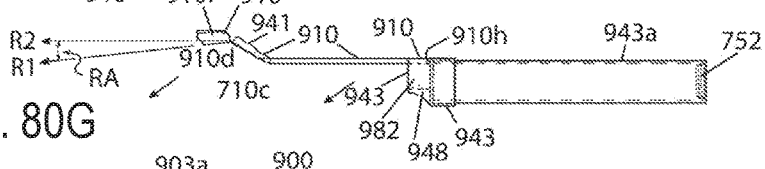
Figure 80H:
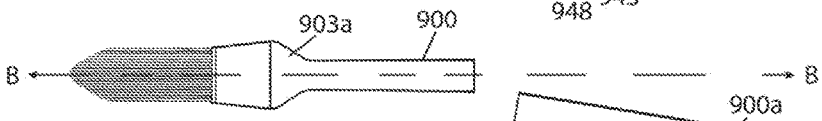
Figure 80I:
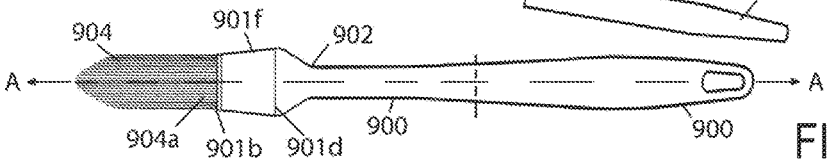

FIG. 79L shows a side view of the assembled brush of FIG. 78, and the angling of the lights in relation to Axis B.

FIGS. 80A-80I illustrate lighting accessories and components for a round lighted paintbrush with a modified handle, and its assembly.

FIGS. 81A-81H illustrate an alternate embodiment for a round paintbrush, and its assembly.

Figure 82:
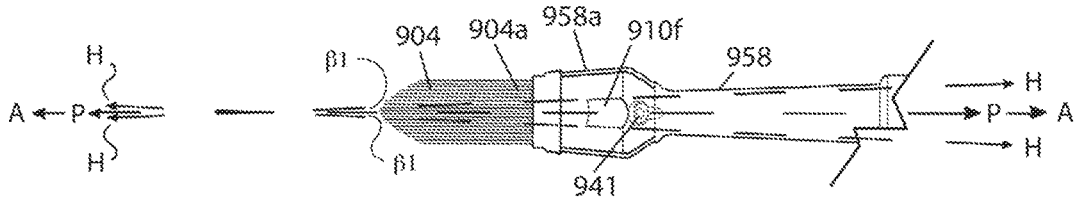

FIG. 82 illustrates a top view of the embodiment of FIG. 81, showing the angling of the lights, and without the anti-wear protection.

Figure 83:
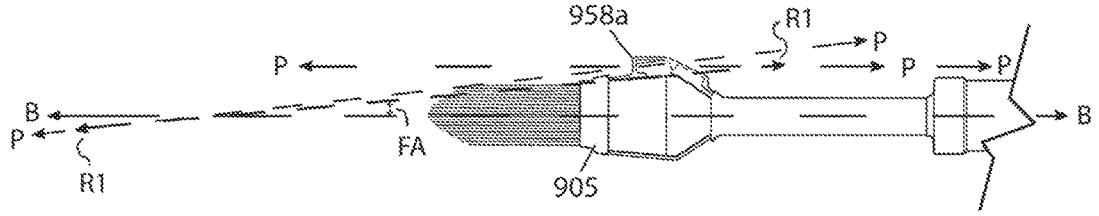

FIG. 83 shows a side view of the embodiment of FIG. 82.

Figure 84:
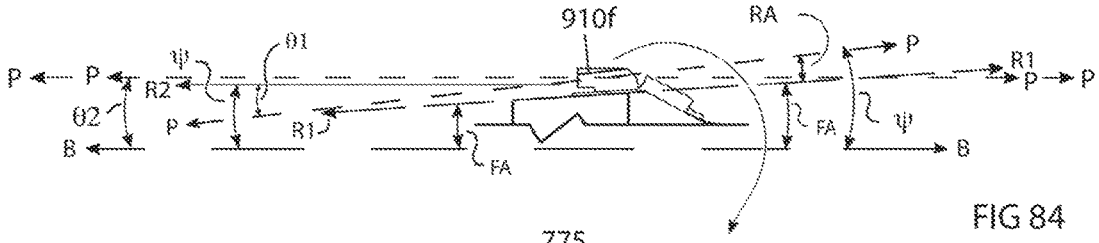

FIG. 84 shows a partial enlarged side view of the lighting components of FIG. 83, and the angling.

Figure 85:
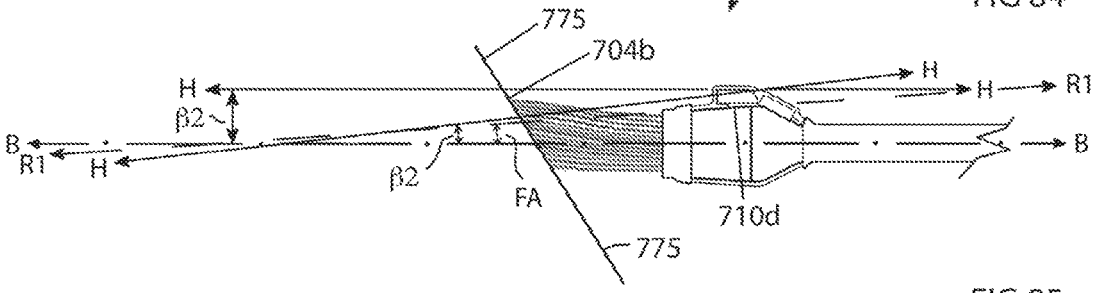

FIG. 85 shows a side view of the embodiment of FIG. 83 in painting action, and the light emitted from the components.

Figure 86:
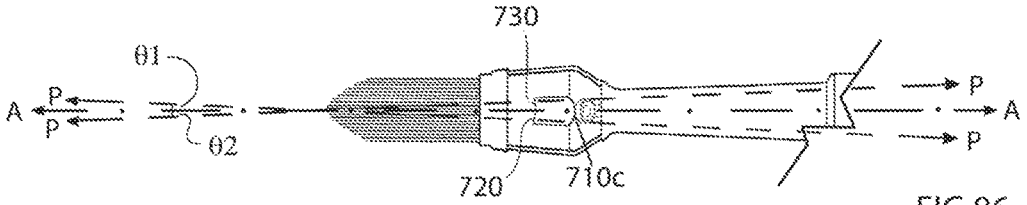

FIG. 86 shows a top view of the embodiment of FIG. 82, with an alternate light angling configuration.

Figure 87:
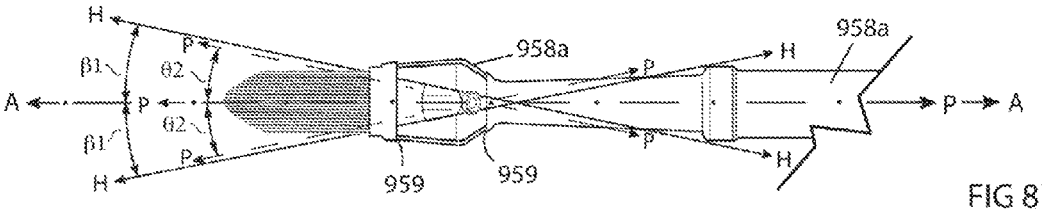

FIG. 87 shows a partial view of the embodiment of FIG. 79H showing the angle β beta of the outside edge of the light housing in relation to the centerline of the light holders (Axis P) and Axis A.

Figure 88:
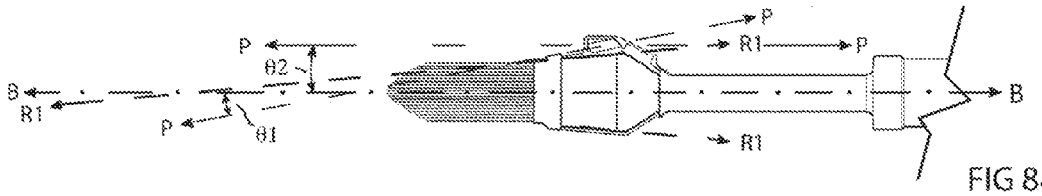

FIG. 88 shows the embodiment of FIG. 87 from a side view.

Figure 89:
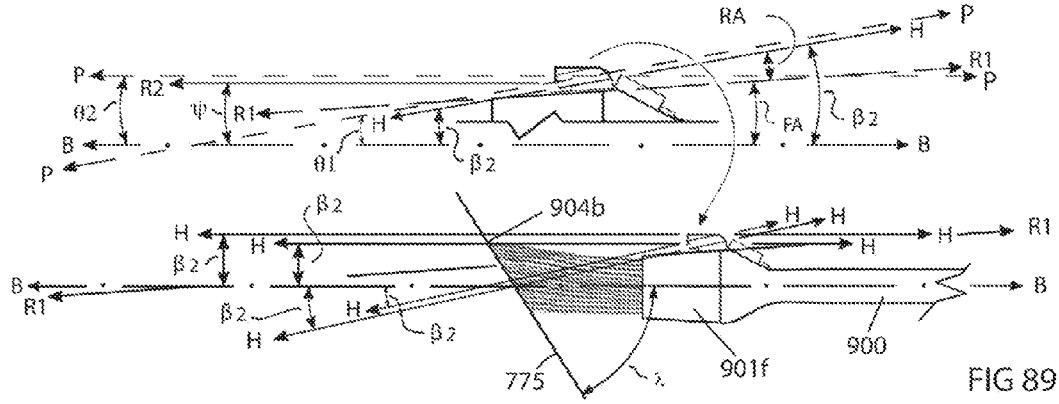

FIG. 89 shows two views of the embodiment of FIG. 88, in painting action, with one enlarged to show additional detail.

Figure 90:
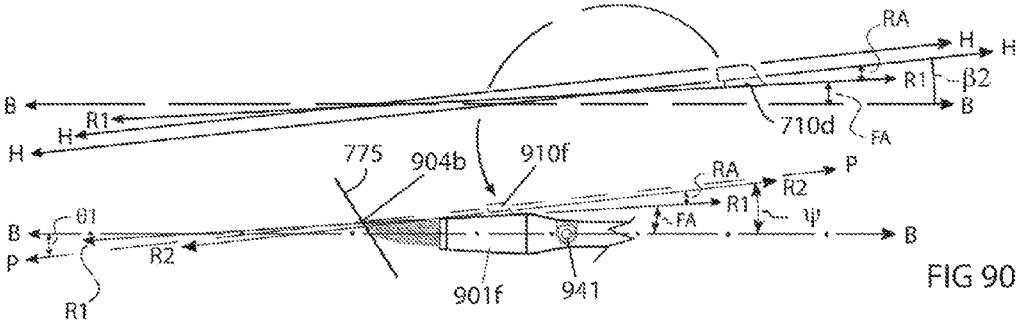

FIG. 90 illustrates a side view of an alternate embodiment for a small round brush, with a tapered ferrule and offset switch.

Figure 91:
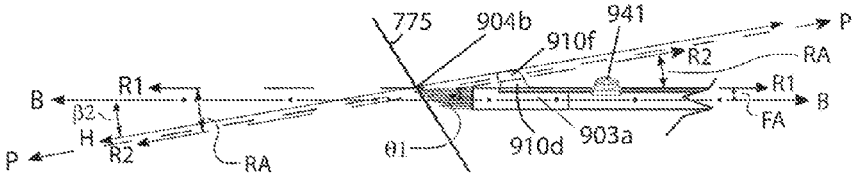

FIG. 91 illustrates a side view of an alternate embodiment for the small round brush of FIG. 78, with no tapered ferrule, showing the light placement and angling, and switch placement.

Figure 92:
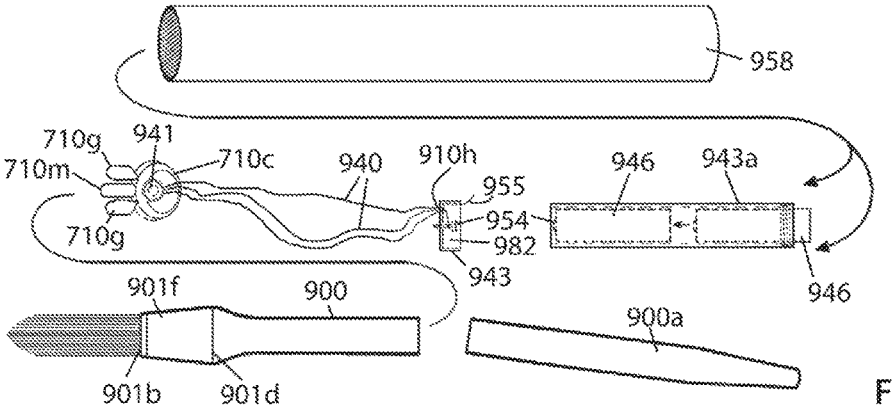

FIG. 92 illustrates an alternate embodiment for a round brush with a tapered ferrule, and the assembly and protective covering of the components.

Figure 93:
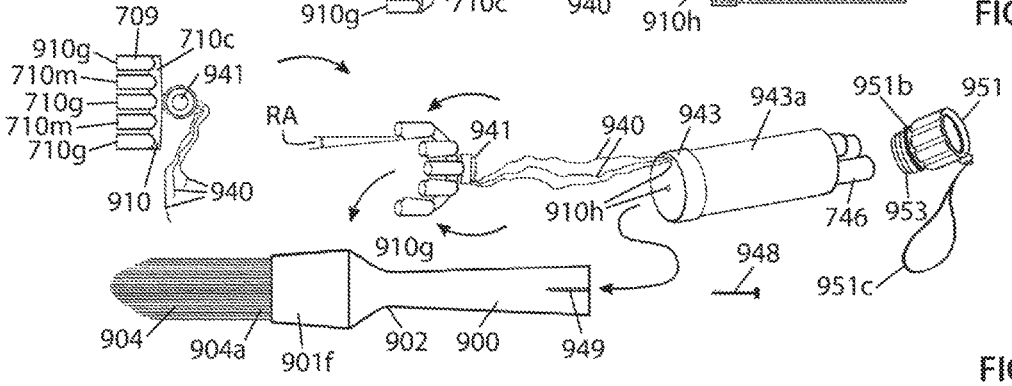

FIG. 93 illustrates the assembly of an alternate embodiment for a round brush with a tapered ferrule and modified handle, with an alternate lighting configuration.

Figure 94:
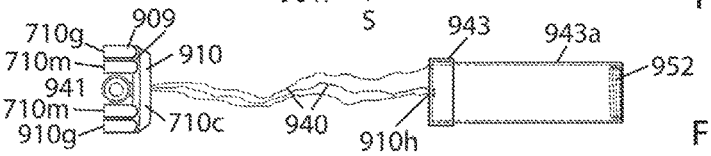

FIG. 94 illustrates an alternate lighting and power configuration ready and able to be attached to a variety of brush sizes.

Figure 95:
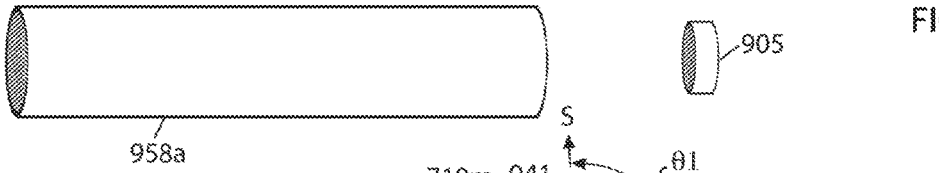
Figure 95:
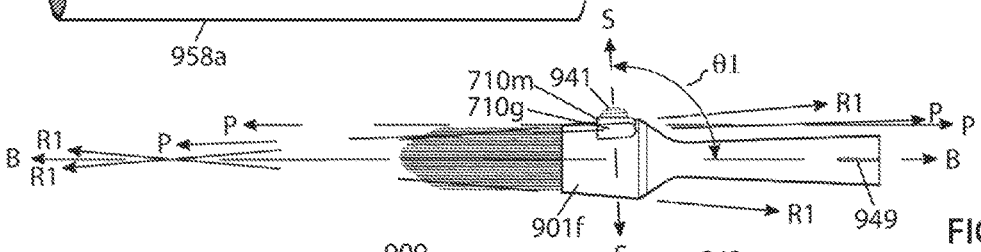

FIG. 95 shows a partial side view of the lighting configuration portion of FIG. 94 after attachment to the brush, and its protective covering before install.

Figure 96:
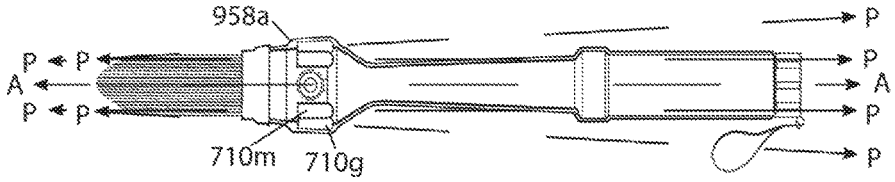

FIG. 96 shows a top view of the assembled embodiment of FIG. 95, after installation of the protective covering.

Figure 97B:
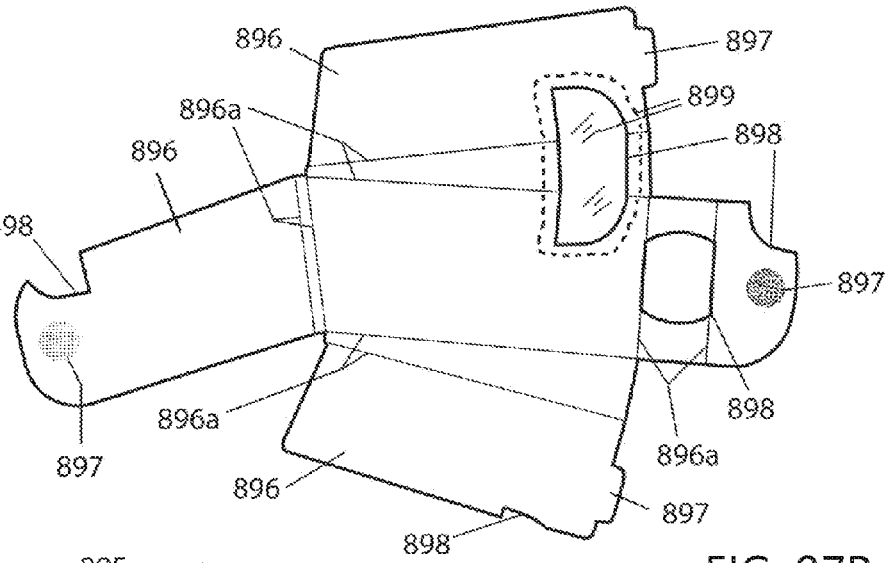
Figure 97A:
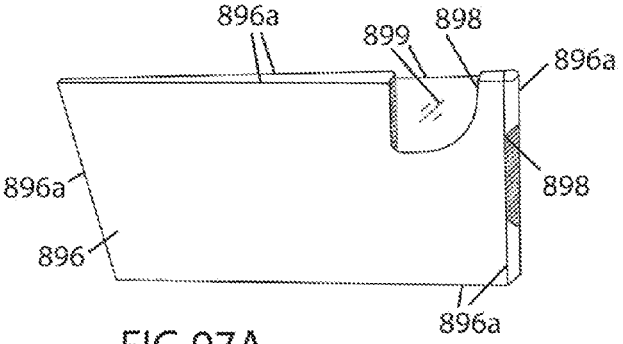

FIGS. 97A and 97B show a pattern view, showing fold lines, of an example of a common, known type of protective covering, modified to include cut-outs, with a light permeable window, suitable for packaging the bristle end of an embodiment of the lighted paintbrush, as well as a perspective view after folding, but before insertion of the lighted paintbrush.

Figure 98:
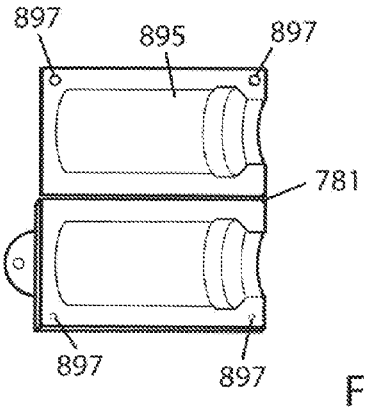
Figure 98:
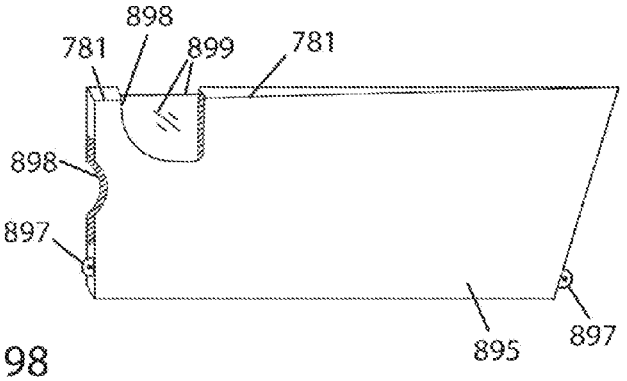

FIG. 98 shows a perspective view, of an alternate, molded, protective covering with a light permeable window, suitable for packaging the bristle end of an embodiment of the lighted paintbrush, before insertion of the lighted paintbrush.

Figure 99:
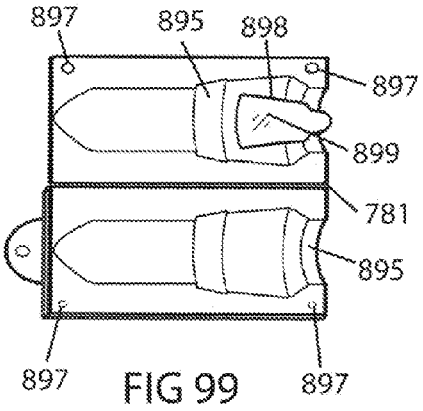

FIG. 99 shows a side view of a molded protective covering suitable for packaging a portion of the gripping end of an embodiment of the lighted paintbrush, before insertion of the lighted paintbrush.

FIG. 100 shows an example of the packaging protective covering for an embodiment of a lighted paintbrush.

FIG. 101 shows an example of the packaging protective covering for an alternate embodiment of a lighted paintbrush.

FIG. 102 shows an example of the packaging protective covering for an alternate embodiment of a lighted paintbrush.

DETAILED DESCRIPTION

In general, the various aspects described below relate to an illumination accessory means for paintbrushes of various shapes and sizes, including all related components thereof, and other paintbrush accessories. Described below, the paintbrush may include other brushes, such as mechanic's brushes with rigid or wire bristles or archeologist brushes, and includes traditional paintbrushes. A traditional paintbrush is defined as a brush having a handle with a gripping end and a bristle end, the gripping end including a ferrule securing the bristle end to the handle of the brush, and a plurality of bristles extending from the bristle end, the plurality of bristles having an edge to contact an object being painted. The edge is characterized as the outside edge of the plurality of bristles when the bristles are bent and compressed together against an object when an object is being painted. A traditional brush is further defined as one that does not comprise any features such as light housings, lights, conductive leads, a lens cover, waterproof features such as protective covering over an illumination means, a battery housing or front or back seals, and (the combined bristle end and gripping end structure and configuration are suitable to attach one or more of the brush accessories described within. The combined bristle end and gripping end structure includes "angled brushes" whereby the length of the top of the ferrule is longer than the length of the bottom of the ferrule in a side view of the brush, or "rectangular" brushes, with rectangular ferrules as viewed from the side of the brush, or "round" brushes, including brushes with a tapered ferrule (the diameter of the brush at the front of the ferrule is a different size than the diameter of the brush at the back of the ferrule) or non-tapered ferrule, having substantially "round" handles.

For clarification purposes, illustrations in this application may be shown with one or more of the following features:

- a centreline fore-and-aft Axis A drawn through the brush as viewed from the top of the brush, and is considered 0 degrees; —a centreline fore-and-aft Axis B drawn through the brush as viewed from the side of the brush, and is considered 0 degrees;
- a front of the ferrule Axis Y intersecting the fore-and-aft Axis B
- a back of the ferrule vertical Axis X intersecting the fore-and-aft Axis B
- the narrowest part of the handle vertical Axis Z intersecting the fore- and aft Axis B
- a centerline Axis P of a light holder of a first or second light source
- an Axis R1 of the bottom surface of the mounting base
- an Axis R2 of the riser's most forward edge paralleling the first or second light holder within the housing
- an Axis H of the outside surface edge of a light housing mounted on an outer shell
- an Axis S through a switch assembly
- the angle RA defined as the angle formed between Axis R2 and Axis R1
- the angle (psi) $\psi$ defined as the angle formed between Axis A or Axis B, and Axis R2
- the angle (lambda) $\lambda$ defined as the angle formed between brush handle Axis A or Axis B against a painting surface while the surface is being painted.
- the angle (theta) $\theta$1 defined as the angle formed between Axis A or B, and Axis P of a first light source
- the angle (theta) $\theta$2 defined as the angle formed between Axis A or B, and Axis P of a second light source
- the angle (beta) $\beta$1 defined as the angle formed between Axis A and Axis H
- the angle (beta) $\beta$2 defined as the angle formed between Axis B and Axis H
- the angle phi $\Phi$1 defined as the angle formed between Axis S and Axis A or Axis B
- the angle phi $\Phi$2 defined as the angle formed between R1 and Axis A or Axis B, in reference to an angled switch base;

wherein the gripping end is characterized as having an upper shoulder and a lower shoulder, the upper shoulder being the portion of the gripping end of the handle above Axis B (side view), and the lower shoulder being the portion of the gripping end of the handle below Axis B (side view), and each shoulder includes at least one or more portions of the ferrule's outer surface encompassing one end of the brush handle, or the handle adjacent to the ferrule or the transitional portion of the gripping end.

Figure 10A:
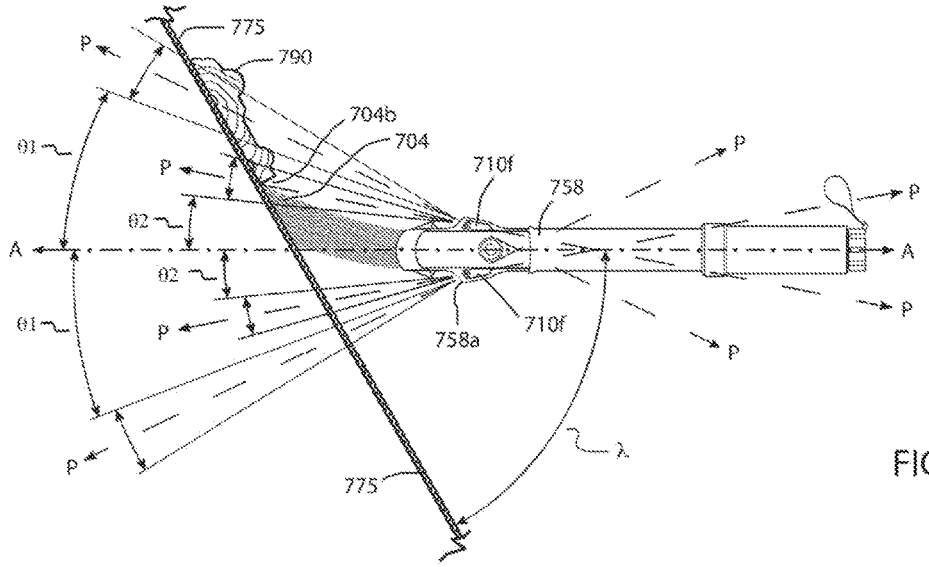
FIG. 10A illustrates a top view of the preferred embodiment of FIG. 9, showing the brush in painting action, and possible variances in the angling of the first and second light source in each light housing, whereby the first light source illuminates the general work area around the bristles, and a second light source is directed towards the edge of the bristles, and the traditional angling of the brush handle Axis A away from the molding, creating an oblique angle (λ lambda) between the center of the brush Axis A and surface being painted.
Figure 10B:
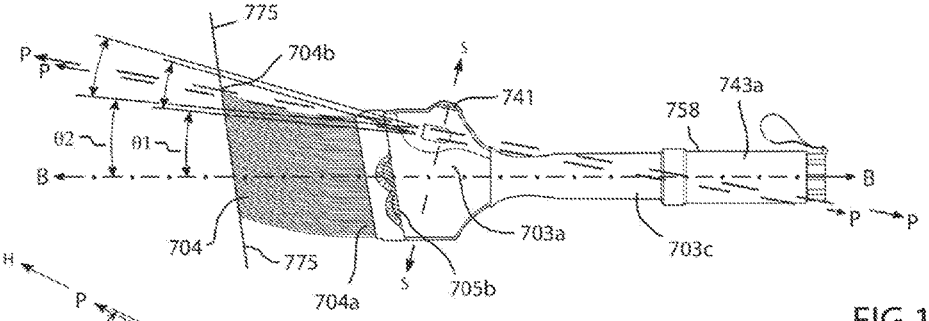
FIG. 10B illustrates a side view of the preferred embodiment of FIG. 10A, in a different painting action, and the lights pointed towards the edge of the bent bristles.
Figure 10C:
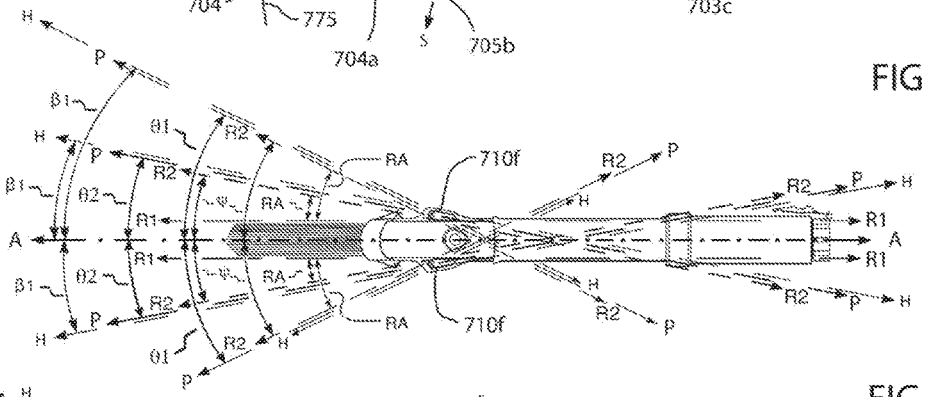
FIG. 10C illustrates the preferred embodiment of FIG. 10A with bristles in a relaxed state, with the preferred angling of various lights within light holders (Axis P) and light housings, showing the Axis H of the outside surface edge of the light housing near the first and second light source, as well as the preferred riser angles for the first light sources and second light source, i.e. the angle RA formed between the thin mounting base Axis R1 and the end of each riser projection Axis R2; Axis P, Axis H, Axis R1 and Axis R2 are angled equally on the right and left sides of the brush (though the left side of the brush is only partially shown).
Figure 10D:
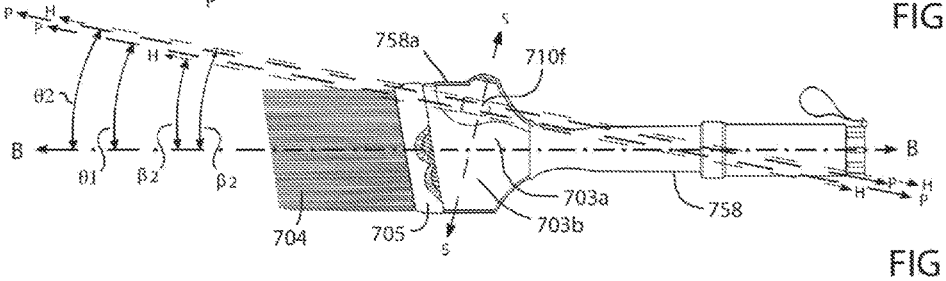
FIG. 10D illustrates a side view of the preferred embodiment of FIG. 10B, with bristles in a relaxed state, showing the preferred angling of various lights within light holders (Axis P) and light housings, showing the Axis H of the outside surface top edge and bottom edge of the light housing near the first and second light source.
Figure 10E:
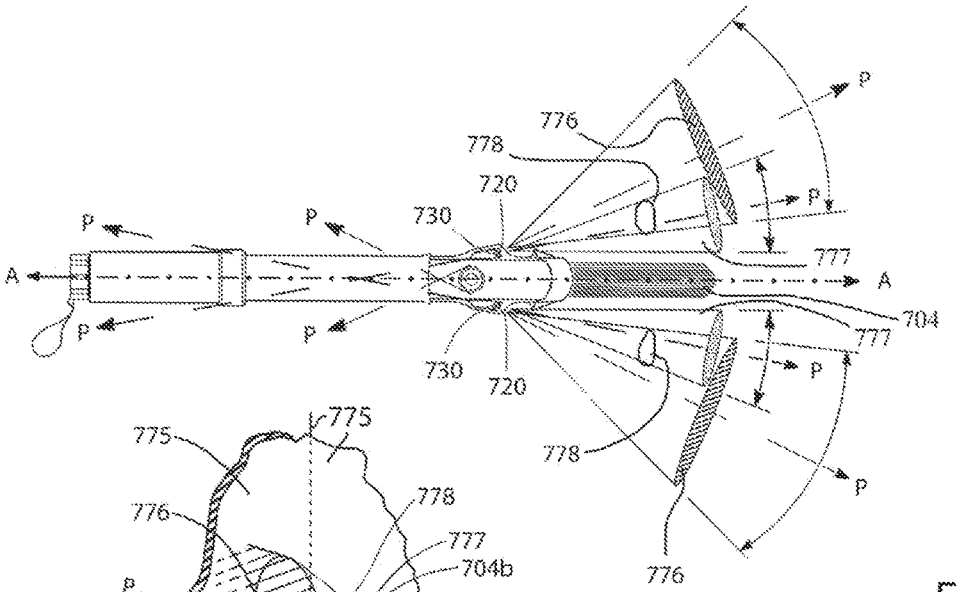
FIG. 10E illustrates a top view of the preferred embodiment shown in FIG. 10C, showing the light cones projecting from the preferred angling of the first and second light sources, and the preferred partial overlapping of light cones.
Figure 10F:
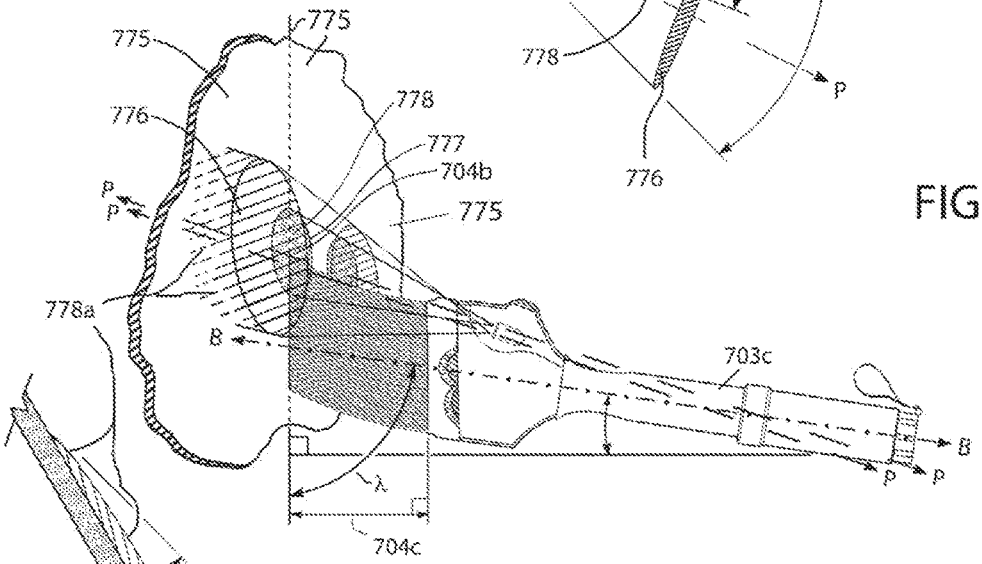
FIG. 10F illustrates the preferred embodiment of FIG. 10B, in the painting process, showing a side view of the brush and a perspective view of the surface being painted, as well as the overlapping cones of the first and second light sources in relation to the edge of the bent bristles in the painting process, the gripping end Axis B at an oblique angle (λ Lambda) to the surface being painted, as well as the indirect, more distant light rays 778*a* from the first light source.
Figure 10G:
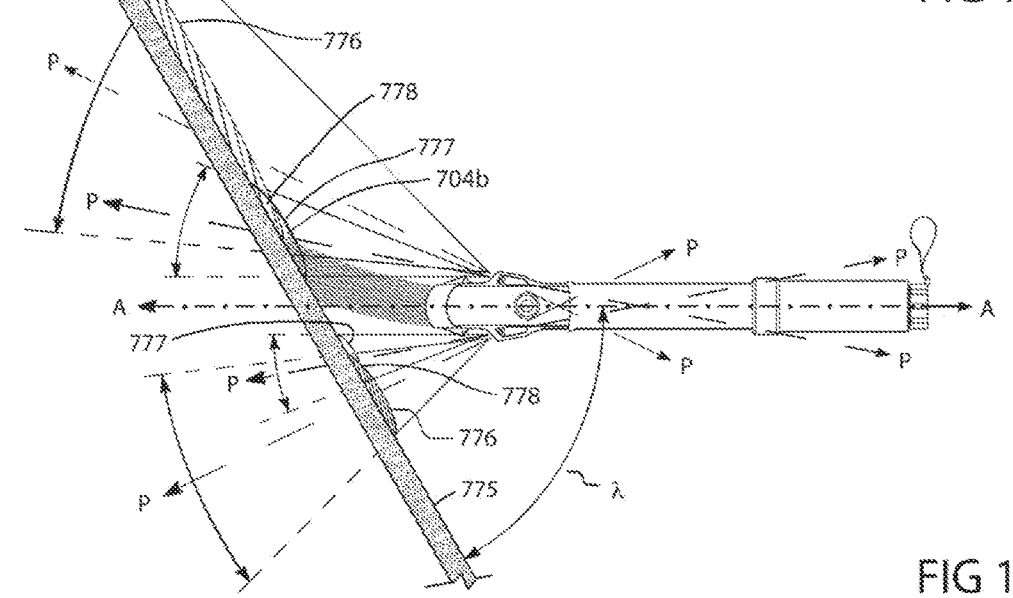
FIG. 10G illustrates a top view of the preferred embodiment of FIG. 10F, and the overlapping cones of the first and second light sources, in relation to the edge of the bent bristles, with the brush Axis A of the gripping end at an oblique angle (λ Lambda) to the surface being painted, and the more distant indirect light rays 778*a* from the first light source due to the angling of the brush.
Figure 11A:
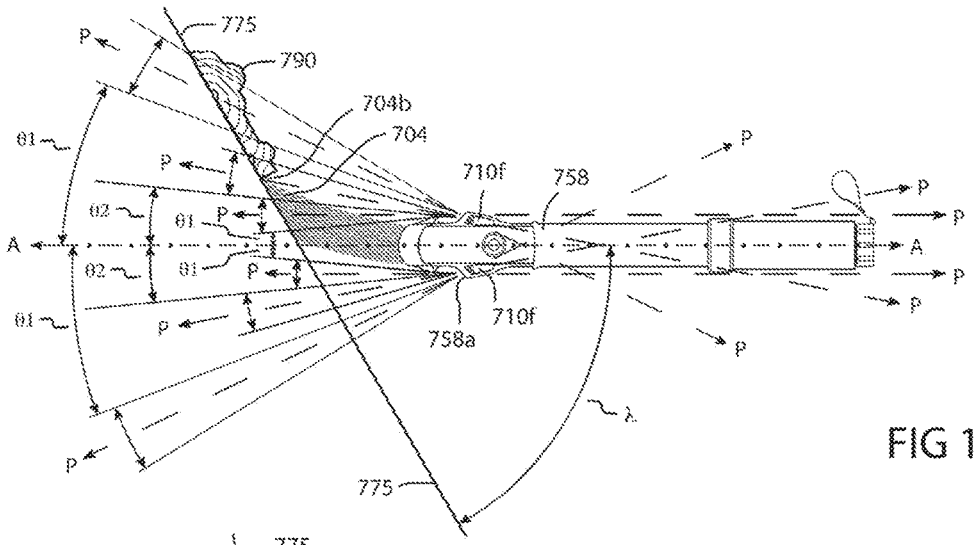
FIG. 11A illustrates a top plan view of an alternate embodiment similar to FIG. 9 and FIG. 10A, but with each housing on the outer shell configured to comprise 3 light holders and sized to accept two first light sources and one second light source, and showing the variances in the angling of the first light sources and second light source in each light housing, and the traditional angling of the brush handle Axis A away from the molding, creating an oblique angle (λ lambda) between the center of the brush Axis A and surface being painted.
Figure 11B:
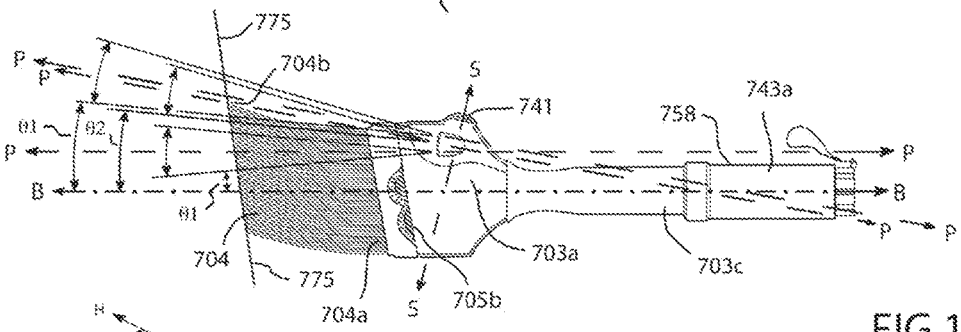
FIG. 11B illustrates a side view of the embodiment of FIG. 11A, showing the variances in the angling of the first light sources and second light source in each light housing.
Figure 11C:
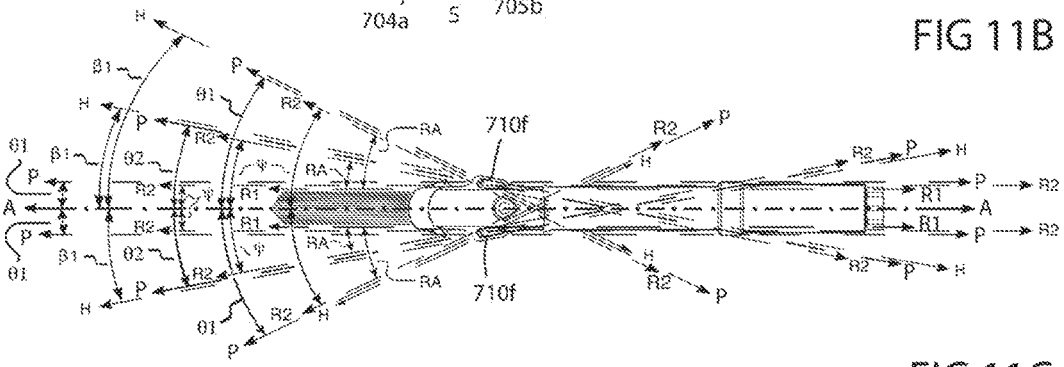
FIG. 11C illustrates a top view of a brush with bristles in a relaxed state, and the preferred angling of the light holders (Axis P) of the first light sources and second light source in each light housing and the angling of the outer shell of the light housings (Axis H), of the embodiment of FIG. 11A, the lights in a structurally fixed orientation to Axis A, as well as the preferred riser angles for the first light sources and second light source, i.e. the angle RA formed between the thin mounting base Axis R1 and the end of each riser projection Axis R2; Axis P, Axis H, Axis R1 and Axis R2 are angled equally on the right and left sides of the brush (though the left side of the brush is only partially shown).
Figure 11D:
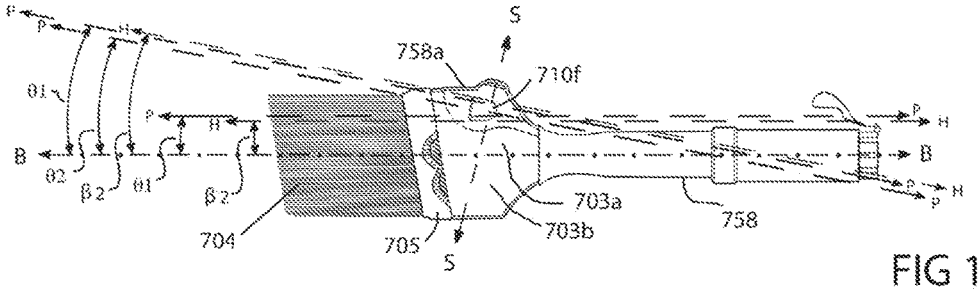
FIG. 11D illustrates a side view of the embodiment of FIG. 11A, with bristles in a relaxed state, showing the angling of the switch assembly, the preferred angling of the first light sources and second light source in each light housing, and the preferred angling of the outer shell portions of the housing.
Figure 11E:
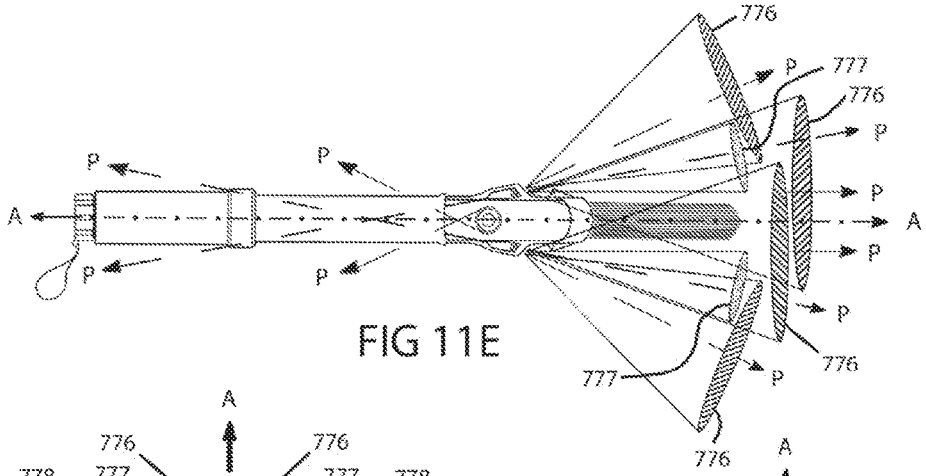
FIG. 11E illustrates a top view, of the embodiment shown in FIG. 11C, with bristles in a relaxed state, showing the light cones projecting from the preferred angling of the first light sources and second light source, and the preferred partial overlapping of light cones.
Figure 11F:
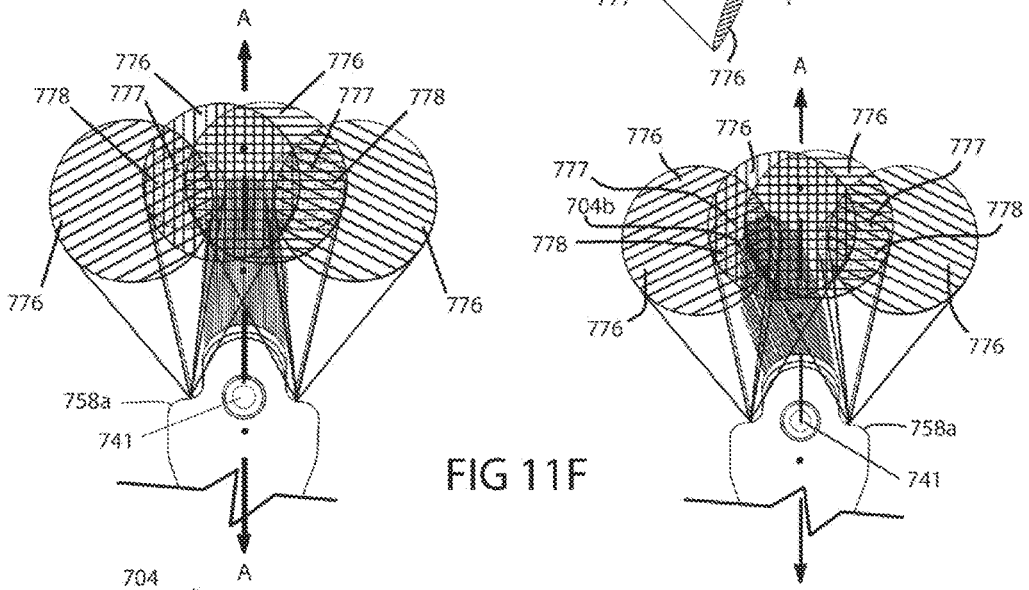
FIG. 11F illustrates a rear perspective view of the light cones emitted from the embodiment in FIG. 11E, the left illustration showing the light cones (3 per side) in relation to Axis A and the bristles while in their relaxed state, while the right illustration shows the edge of the bristles bent to the left of the brush, and condensed overlapping light cones.
Figure 11G:
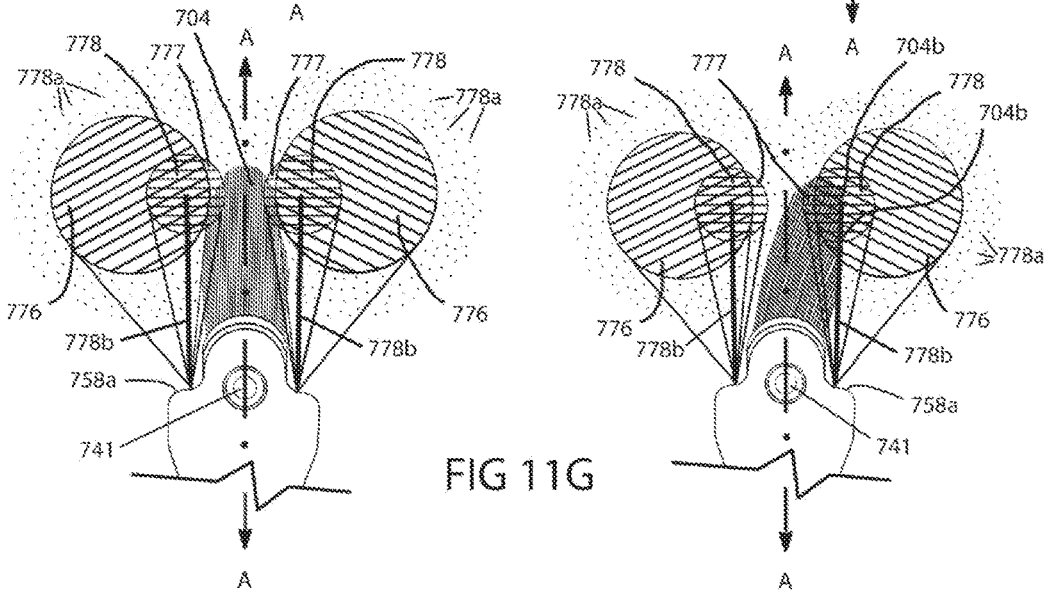
FIG. 11G illustrates a rear perspective view of the light cones and a pin-point light source emitted from the embodiment in FIG. 10E and FIG. 10F, the left illustration showing the light cones (2 per side) and the bristles while in their relaxed state, while the right illustration shows in their bent state as shown in FIG. 10G, in the painting process and the overlapping cones and combined indirect light rays 778*a* of the first and second light sources.

In this disclosure, brush accessories focus primarily on brushes suitable for the painting process, and involve:

a) Strategically aiming one or more lights to provide optimal illumination, to one or more specific target areas in relation to where the edge of the bristles are bent and compressed during the painting process Examples are shown on FIGS. 10A, 10B, 10F, 10G, 11A, 11B, 40, 54, 56, 60, 62, 79J-79L, 85 89, 90, and 91, and the right illustration of FIG. 11F and FIG. 11G. The lighting accessories as described herein may include a compact size of one or more strategically placed light housings, comprising one or multiple light holders within each light housing, that are integrally formed as part of a thin, but durable outer shell. For this application, integrally formed refers to a structural configuration of the listed components that are moulded as one piece. There may also be more than one integrally formed component that is sized and configured to be attachable to one or more other integrally formed, moulded parts. A component may also be integrally formed with a component held within the mould, as seen in FIG. 32. The outer shell comprises a mounting base, shaped and sized to engage at least one portion of at least one shoulder of a paintbrush. In an embodiment, as illustrated in FIG. 11G, the one or more lights may include a precision, pin-point light source 778*b*, such as for example a low power laser light source, which more precisely outlines a target point to which the edge of the bristles should be bent and compressed during the painting process, in order to obtain substantially optimal performance from the brush when painting an edge. The pin-point light source 778*b* may be aligned with the center of another light, or may instead be aimed on its own. More than one pin-point light source 778B may be used to define a target point on a second side of a brush, when the bristles may be bent and compressed in the opposite direction. In another embodiment, more than one pin-point light source 778*b* may be used on one side of the brush in order to help maintain the position and orientation of a brush when the brush is being applied to paint a straight edge.

b) Powering the illumination means by a power source within a housing connected to a brush by means of one or more battery housing connectors, configured to be attachable to the gripping end of a brush, and employed as a means of attaching and storing at least one power source (within a housing), positioned behind the ferrule. Storing the power source behind the ferrule allows the use of larger and longer-lasting power sources, positioned to not interfere with the natural gripping portion of the brush and to keep the majority of the ferrule as thin as possible, so the brush can be handled and maneuvered in a typical, traditional method.

c) Providing a quick, easy access to at least one power source, for replacing or recharging what may be one or more batteries.

d) Protecting all components of the illumination means within one or more protective coverings. The protective covering(s) may be conforming and form-fitting, completely sealed, waterproof, heat-resistant, and chemical-resistant, to protect all lighting components within one or more protective coverings in a compact, streamlined manner. One or more covering(s) may simplify the cleaning process of the illumination means and/or lighted paintbrush apparatus by virtually eliminating all tight crevices around the lights and switch areas where paint could build up and interfere with the operation and life of the illumination means and the brush. One type of covering may be heat-resistant and completely sealed, and very hot temperatures of water may be used to remove even dried paint from all areas of the gripping end of the brush (though the user must still ensure very hot water does not contact the bristles). The present invention also refers to a removable jacket apparatus (protective covering) for protection and demonstration of the lighted paintbrush.

e) Preventing paint buildup near the base of the bristles, by installing a bristle base protector, thereby extending the life of the brush. The bristle base protector protects the base of the bristles from being contacted by paint during the painting process, since the bristle base is the most difficult area of the brush from which to remove paint, and paint buildup in this area reduces the life of the brush. The bristle base protector may be a removably attachable, resilient band, preferably installed relatively centred over the front of the ferrule and the base of the bristles and very easily removed for the final cleaning process.

f) Employing a variety of different types of power sources, including multiple types of power sources or combinations of different types of power sources, whereby each power source may be held within its own housing, and the one or more housings may be configured to be attached to each other, or to a common attachment means such as a coupler, and may be configured to be secured in position by a battery housing connector configured to be attachable to the gripping end of a brush.

Some individual brush accessories are moulded, shaped and sized to be attachable to a variety of brushes, requiring these brushes to have common similar characteristics such as handle shapes and/or thicknesses of handles, in order to attach the accessory. Other accessories are attachable to a variety of different sizes and shapes of brushes and adapt and conform to multiple irregular shapes and do not require similar brush characteristics in order to be attachable. Yet other accessories may require the gripping end of the brush handle to be modified, which may include notching the handle or cutting off a portion of the handle in order to install a particular accessory. It should also be noted that a brush may be manufactured and configured to receive certain paintbrush accessories and/or a battery housing connector attachment means. For example, the brush may be manufactured with a shortened, blunt end (with a pre-drilled pilot hole), ready to receive a battery housing connector (and fastener), and/or notched within the gripping end, ready to receive one or more switches, power source components or conductive leads or wires.

Accessories may be self-contained, defined as being removably attachable to a brush, secured in place by an attachment means, such as: held in place by one or more resilient bands positioned over a portion of an outer shell of the lighting accessory, or an outer shell of the lighting accessory friction-fitted to the gripping end of the brush, or a combination of both, whereby all brush accessories and their attachment means are completely removable from the brush after the painting process is complete, allowing for typical washing of the brush in a traditional manner. Other accessories are sized, shaped, and configured to be fixed to a brush for the life of the brush, converting a traditional brush such as a paintbrush into a lighted paintbrush apparatus comprising a fixed illumination means, fixed form-fitting protective covering which is waterproof and chemical resistant, a fixed power source housing preferably having a sealed removable end cap for quick and easy battery access, a removable bristle base protector, whereby all fixed components also allow the brush to be easily washed in the same traditional manner as a brush without an illumination means.

For the purpose of this application, it should be noted that several protective coverings may be used in various combinations, for various functions, as more specifically described herein. The light permeable protective coverings #758*c* is only referred to in the enlarged light housing illustrations of FIGS. 2F, 4C, and 13A, and is used to refer to all light permeable protective coverings, such as a removable protective covering 756*a*, 856*a*, 956*a*, or a fixed protective covering 758*a*, 858*a*, 958*a*, depending on the embodiment on which the light housing is installed.

Figures 7A, 7B, 7C:
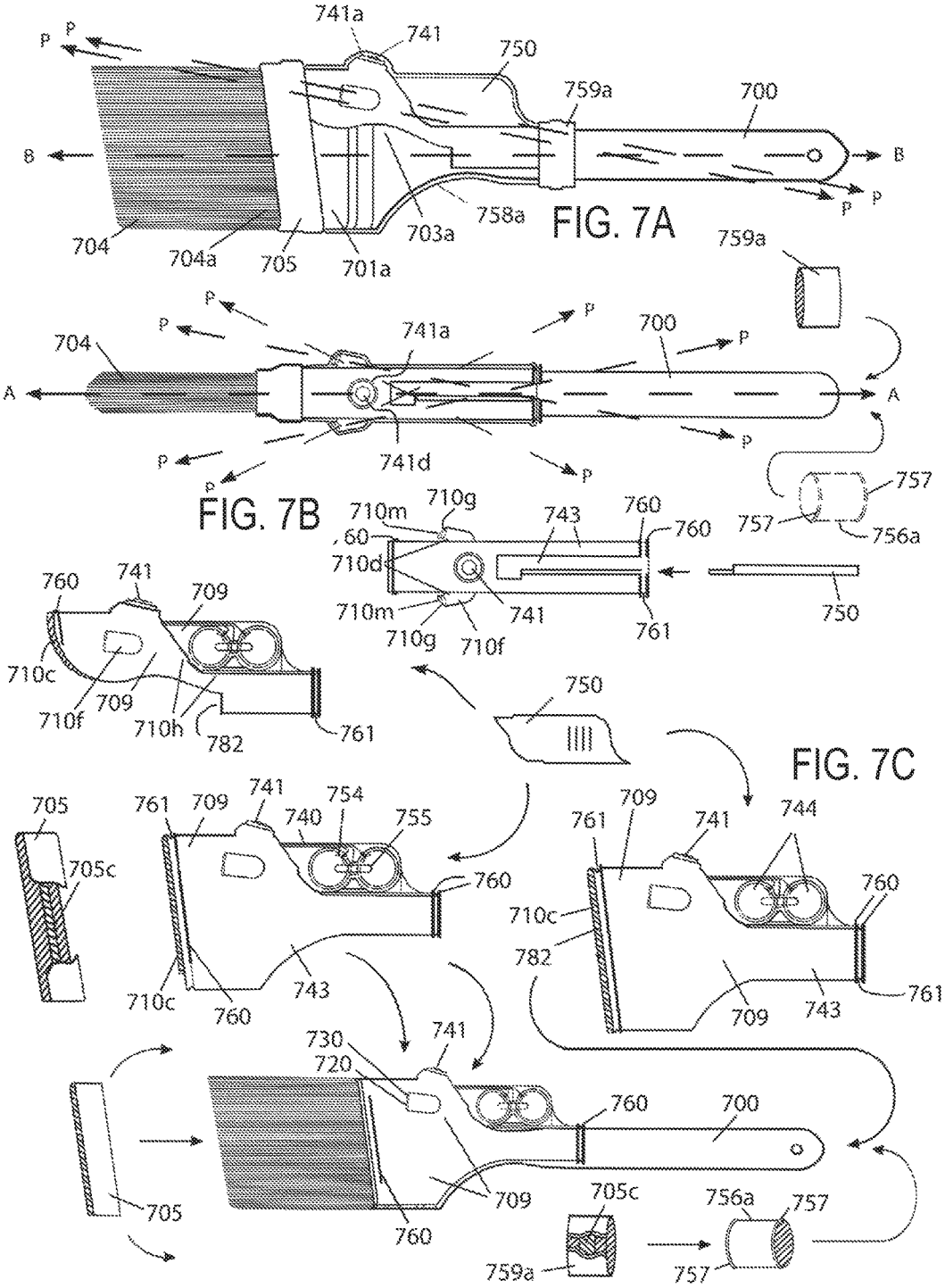
FIGS. 7A-7C illustrate accessories including a self-contained illuminating embodiment that is removably attached, shown in a variety of outer shell mounting configurations, and showing the angling of the lights from a top and side view, and the removable sliding access cover, which may comprise a compressible seal or waterproofing means, to access the batteries.

A rolled-on covering, such as a latex covering, may still be employed on a lighted paintbrush as described in Ser. No. 13/508,710, and rolled on over the end of the brush handle, either partly or entirely enveloping the handle, and one or more parts of the lighting accessory, from the gripping end to the bristle end. The frontal rim of the latex covering may now be held within a hollowed-out portion of the outer shell of a lighting accessory, referred to as a groove 761, located in the outer shell, as seen in FIGS. 5A-5E and FIGS. 7A-7C, and FIGS. 33A-33E. The frontal rim of the latex covering may also be rolled over a portion of a channel 760, shown in FIGS. 5A-5E FIGS. 7A-7C, 32A-32E, 33A-33E, and FIGS. 53A-53E, formed or fixed to an outer shell of the lighting accessory and in both cases, may be held in place by a bristle base protector and may engage a recessed area in the underside of the bristle base protector, referred to as a groove 705*c*, whereby the front rim of the protective covering is secured in position near the base of the bristles. The back rim may be held in a groove as shown in FIGS. 33A-33E, a ridge as shown in FIGS. 32A-32E, or between two ridges, as shown in FIGS. 7A-7C. This covering may now also be constructed of a material such as latex or silicone (including a medical grade silicone) or rubber, or any combination of these, as well as rubber latex, polyurethane, polyethylene, polyisoprene (synthetic latex), or nitrile (synthetic rubber). This covering may also be employed as a waterproof/dustproof or paint resistant, protective, stretchable, tubular covering, which may be employed between a front and rear seal such as shown in FIGS. 5A-5E, FIGS. 7A-7C, FIGS. 8A-8C, FIGS. 32A-32E, FIGS. 33A-33E, and FIGS. 53A-53E, whereby the front seal is the bristle base protector 705, 805, and the back seal 759*a*, 859*a* is a flexible resilient band type of covering which is stretched over the handle and positioned over the handle and back rim of the protective covering, holding it in place within the groove of the handle, battery housing connector, outer shell extension or outer shell. The watertight seals created at the rims of the protective covering are formed by the pressure of the bristle base protector on the front and back rims of the protective covering into the groove, or onto the ridge located on the outer shell of the illumination means.

The protective covering of the lighted paintbrush may be removable, as described above, or also take the form of a fixed-type of waterproof protective covering material, which may consist of one or more compounds that may be installed on a brush by being dipped, brushed, sprayed, or vacuum-sealed or heat shrunk into place to produce a covering that is preferably waterproof or water-resistant. For example, one or one or more combinations of waterproof dipping or brushing or spraying compounds may be used, such as wax, liquid rubber, a type of liquid plastic dipping formula, liquid PVC (or other liquid plastic), or products such as vacuum-sealed or heat shrinkable plastic tubing. Any of these products may be employed alone, or in any combination as a protective covering, or with any combination of a type of latex covering, or other suitable covering or waterproofing. The main ferrule area of a paintbrush is preferably covered with a light-permeable, heat shrinkable plastic tubing type of protective covering, or by two moulded components which may be ultrasonically welded together, while the protective covering of the handle may be heat shrinkable plastic tubing, or formed by dipping the brush handle in a dipping compound such as the different types of dipping or spray compounds mentioned above. The dipping compound may be employed as a protective covering of the handle, as well as the protective covering of the conductive leads and/or wires, and battery housing.

A preferred, multipurpose, protective covering consists of one or more pieces of heat shrinkable plastic tubing, whereby at least one portion of the tubing is light permeable, allowing light to be transferred through the protective covering, to a work area around the bristles of a brush while painting, without distorting or restricting the light rays of wide-angle or narrow-angle cones of light, or light which may be projected through a first light-altering lens 721*a*, which may be a Fresnel lens.

The characteristics of the preferred shrinkable plastic tubing material depend on the location upon which it is installed on the brush, the number of tubing pieces installed, the shrink ratio of the type of tubing, the size and shape of the brush, the placement of the attached accessories, and the size and/or number of lights, switches, and type of power source housings that are attached to the brush, as well as the intended use of the brush.

Figures 28A, 28B, 29A, 29B, 29C, 30A, 30B:
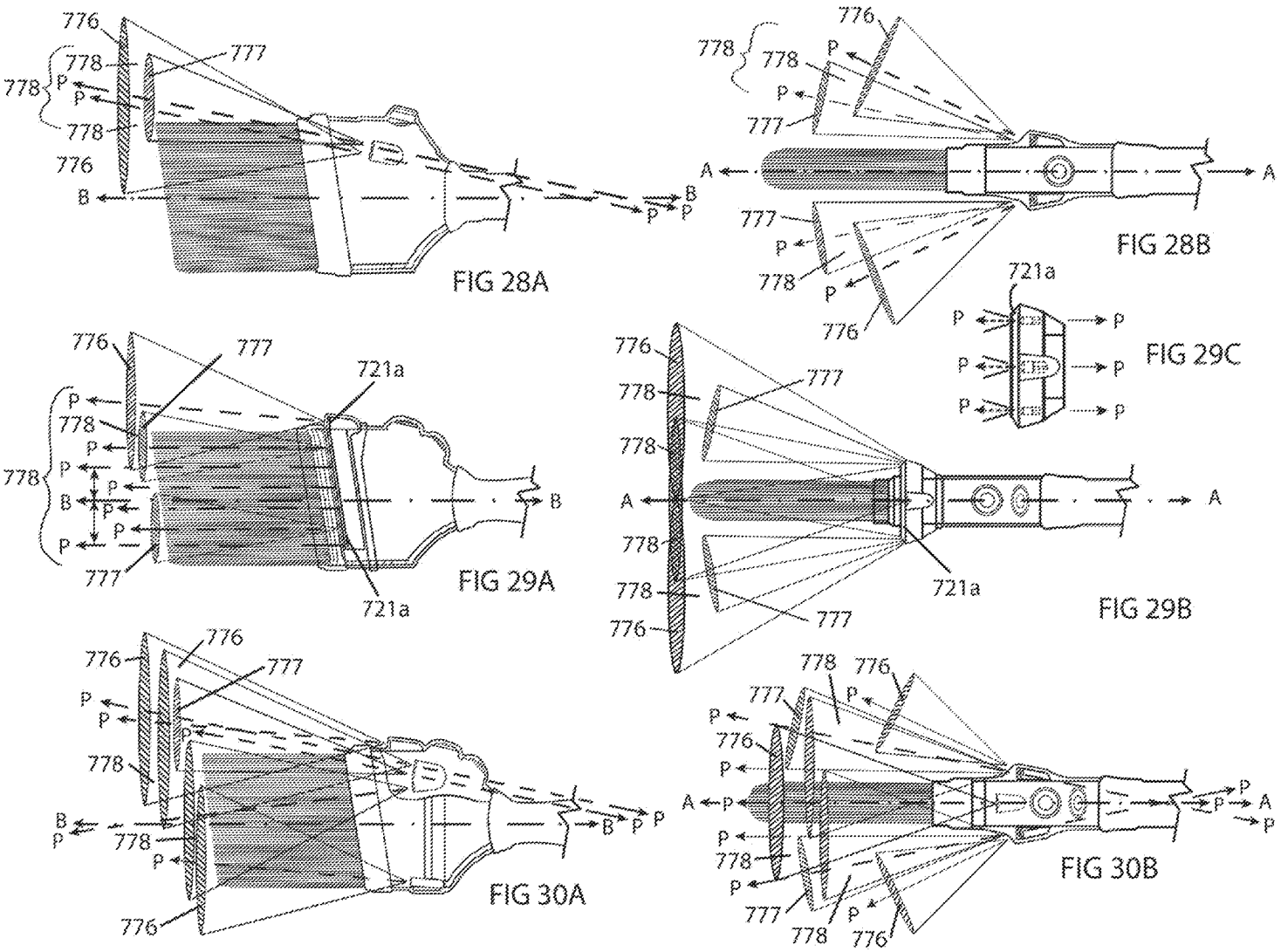
FIG. 28A illustrates the partial side view embodiment of FIG. 1, and the angles the lights are structurally pointed in relation to Axis B, and the wide angle and narrow angle light cones produced by the LED's in relation to one another, and partly overlapping.
FIG. 28B illustrates the embodiment of FIG. 1, and the angles the lights are structurally pointed in relation to axis A, and the wide angle and narrow angle light cones produced by the LED's in relation to one another, and partly overlapping.
FIG. 29A shows a partial side view of the illumination means of FIG. 15 mounted on a brush, comprising multiple LED light sources, with light projected through a light-permeable bristle base protector, showing the angle of the lights in relation to Axis B, and some of the light cones produced from such lights, prior to refraction from a Fresnel lens.
FIG. 29B shows a partial top view of the illumination means of FIG. 29A, but after refraction from a Fresnel lens and the light emitted shown represented in light cones to display how the light is directed to desired locations.
FIG. 30A shows a partial side view of the embodiments of FIG. 21 and FIG. 24, showing the angle the lights are pointed in relation to axis B and light cones produced from such lights, with the cones overlapping.
FIG. 30B shows a partial top view of the embodiment shown in FIG. 30A, showing the angle the lights are pointed in relation to Axis A, and light cones produced from such lights, with the cones overlapping.

One or more heat shrinkable plastic tubes may be employed as durable, form-fitting, unbreakable, solvent-resistant, chemical-resistant, heat-resistant, dustproof, watertight protective coverings, which mechanically encapsulates all components, and may provide electrical insulation for any conductive connections, within the tube. A protective covering may be composed of one piece of heat shrinkable plastic tubing, and may be employed as a protective layer enveloping all lighting components of the brush, and may also be employed as the sole lens cover for all of the lights, as well as the sole protective covering for one or more switches. A protective covering may also be employed as a secondary protective covering and employed in conjunction with a first lens, such as a rigid light-altering lens 721*a* (which may be a Fresnel lens). Examples showing lenses are FIGS. 15, 20, 23, 29A, 29B, 29C, 65A-65D, 66A-66D, 67A-67C, 69, 70, 71, 72, 73, and 74. FIG. 29C shows the pointing of the light rays before being altered by the lens. FIGS. 29A, 29B, 65A-65D, and 66A-66D show embodiments with a secondary protective covering, which is positioned enveloping a first protective covering (being a lens), whereby the secondary protective covering is a light-permeable bristle base protector 705, 805. This bristle base protector protective covering covers the light housings, the front portion of the outer shell, and the base of the bristles. An alternate secondary protective covering for a lighting accessory for the gripping end of a brush may be heat shrinkable plastic tubing, covering and protecting the lighting components, switch assembly, gripping end of the brush, battery housing connecter and battery housing, covering and protecting all components within the tube from scratches, paint and paint buildup, dust, dirt and water. Since a portion of the protective covering is light permeable and can be clear, it also functions very well as a durable, unbreakable marketing window for indicia 762 and/or logos displayed on a ferrule covering which may be attached to the ferrule of the brush within the protective covering, as seen in FIGS. 1A-1E.

An advantage of using one or more pieces of heat-shrinkable plastic tubing as a protective covering is that one or more pieces may be joined together to form a continuous, waterproof protective layer capable of adapting and conforming to a wide range of sizes and various jagged component shapes created by attaching various illumination means to a brush, as required for various different embodiments, smoothing and blending all various sized joints and connections as it is heated into place, creating a mechanical connection between all of these components, regardless of shape, and protecting all the components within the tube. The one or more pieces of heat-shrinkable plastic may have characteristics such as thin-wall, ultra-thin wall, or adhesive-lined tubing, which differ in flexibilities or rigidness, and each type may be best suited for a different portion of the brush depending on the intended use of the brush. The embodiments in FIGS. 14A-14E, 26F, and 26J, 36B, 66A-66D, 67A-67C, 78A-78K, and 96 show a one-piece fixed heat shrinkable protective covering. FIGS. 1A-1E, 3A-3E, 9A-9E, 10A-10G, 11A-11G, 12, 26A, 26B, 29A, 29B, 30A, 30B, 34A, 34B, 35, 37A-37E, 38A-38F, 39-52, 54-64, 79E-79I, 82, 83, and 85-88 show a fixed two-piece heat shrinkable plastic tubing. In all cases, the protective coverings cover and protect all components of the brush handle and the illumination means installed on brushes of a variety of shapes and sizes.

Another type of protective covering may be a combination of a heat shrinkable protective covering and a fixed outer shell, which may also be fixed on separate portions of a brush, and sealed to one another, whereby together they form one protective outer covering from the base of the bristles to the end of the brush as seen in FIGS. 36B, 36C, 66A-66D, 67A-67C, 68, and 80A-80I.

Yet another type of protective covering may be a thin outer shell, formed of one or more pieces and joined together in a semi-rigid form, comprising an illumination means of one or more lights (which may or may not be protected by a light-altering lens), powered by a power source positioned within a power source housing within the combined pieces of the same outer shell. The one or more lights may be controlled by one or more switches, mounted within the outer shell, and whereby the lights, switch, and power source are electrically linked to each other within the outer shell. The power source may be accessible from the end of the embodiment through a water tight, sealed access, whereby the embodiment is configured to be attachable to a paintbrush handle or modified paintbrush handle, and held in place by one or more ferrule coverings and/or a bristle base protector, (which may be light-permeable) as seen in FIGS. 8A-8C, 31A-31C, 32A-32E, 33A-33E, 35, and 36E. In this case, once assembled, the two pieces are affixed together, and the assembled one-piece structure of this embodiment, excluding the bristle base protector, is considered to be a battery housing connector, not removable from the brush.

Clear PVC heat shrinkable tubing or cross-linked polyolefin (which may be thin-walled semi-rigid) may be a preferred material used as a protective covering, which is light permeable, and preferably extends from a location near the base of the bristles to the narrow transitional area of the brush handle, where it is overlapped and sealed by the handle's protective covering, or b) be applied as a single layer of protective covering which may extend from the bristle base to the end of the battery housing (where a battery cap is installed), and manually sealed at each end or sealed by means within the protective covering.

A protective covering formed by installing a single layer of light-permeable heat shrinkable plastic extending from the ferrule, near the bristle base, to the end of the battery housing, on a 2½" brush (depending on the type of switch mounted to the top of the handle) would approximately require a shrinkable 1.8" or 2" tubing. This tubing would require a 2.5:1 or 3:1 shrink ratio in order to be installed on the brush and contact firmly to all components within the tube (mechanically attaching one or more lights switches and at least one battery housing to a brush handle). This single layer application eliminates unnecessary joints and potential failure of a sealed joint (within a protective covering of multiple joints), and is more cost-effective, since only one protective covering is required to protect all components of the brush handle. This single layer of protective covering may be utilized as a lens cover for the LED's, as well as a multipurpose protective covering that covers and protects all components of the lighted brush from the base of the bristles to the end of the power source housing, where the end cap is installed (along with an O-ring), which finalizes the waterproof protective covering. Clear PVC heat shrinkable tubing or cross-linked polyolefin may also be preferred as a protective covering of some embodiments, due to their overall durability within a thin protective layer and higher scratch-resistance.

Clear PVC heat shrinkable tubing is sometimes referred to, in the marketplace as "crystal clear PVC." Clear PVC may also be preferred over other products due to its low shrink temperature, which lowers the risk of damaging the lighting components of the lighted brush while installing the heat shrink tubing. PVC tubing such as Layflat PVC™ by Stranco Products, which may be as thin as 0.0381 mm thick may be used over the lights and switch(es) portion, or one or more other portions of the protective covering of a lighted brush, retaining the streamlined appearance and size of the traditional brush, and keeping the added thickness to the gripping portion of a lighted brush to a minimum. PVC is generally more cost-effective than some other products, such as polyolefin. Whether using PVC or a type of polyolefin, both products have a thin or ultra-thin version of material that may be suitable, and capable of functioning well as a light-permeable light/lens covering portion of a protective covering (or a one-piece full length protective covering), enveloping and allowing activation of one or more types of switches, including touch switches, pressure switches (miniature vacuum or differential pressure switches), push-button switches, or other types of combinations utilized in other flashlights and similar applications.

Though polyolefin is generally more expensive than PVC, certain types of polyolefin are very flexible. In some cases, the very thin, very flexible tubing of clear polyolefin (which may be a Shrinktek™ product) or a cross-linked polyolefin (which may also be thin-walled semi-rigid) may be preferred for the light-permeable portion of the protective covering which is positioned around the ferrule, lights and switch portion of a brush. The heat shrink employed may be carefully selected, since some brands of heat shrinkable plastic are more durable and more clear, but not as flexible as polyolefin, and may lose their flexibility as they age.

Polyolefin may be preferred on embodiments comprising one or more push button on/off switches, touch switches, or multifunctional switches, whereby the actuating element is movable within a switch assembly, which may comprise a recessed portion located around the actuating element. The flexibility of polyolefin allows the movable actuating element of a push button switch to move freely without restricting the operation of the switch, and also allows for a combination of push button switches and touch switches to be used together without interfering with the actuation of either switch. A flexible polyolefin protective covering, like other heat shrinkable tubing, contracts as it is heated into place around the components of the lighted brush, but its final configuration allows a pliable, ergonomic flexibility between the prominent components, such as the one or more raised light or switch housings, resulting in a more comfortable gripping area located around the light housings, switch and ferrule. Polyolefin as thin as 0.49 mm or less may be used, and when installed on a lighted paintbrush apparatus, adds a total of less than 1 mm to the original thickness of the ferrule gripping area of the brush (and handle in some embodiments), also adding less than 1 mm of protective covering thickness to the housings and switch components as mounted on the brush.

Since polyolefin may be less durable than some other heat shrinkable tubing protective coverings, improved wear-resistance may be added by installing an anti-wear protection to the surface of the covering in one or more prominent places, such as the light or switch housings, or a raised portion of the handle. An anti-wear protection may also be a certain type of material used as a protective covering (instead of polyolefin) which may also be employed as a light/lens protective covering, and having a more durable composition, such as PVC heat shrinkable plastic. An alternate form of anti-wear protection in areas of high wear may be achieved by thickening the waterproof covering, by affixing a superior durable wearing compound. Also, one or more attachments may be fixed to the surface of the protective covering, positioned in areas where premature wearing is expected. An anti-wear protection, which may be constructed of materials such as hardened plastic, PVC or Teflon, may be fixed onto the outer surface of the light/lens protective covering or paintbrush handle protective covering. Examples are a hardened plastic or PVC skid-plate, or a resilient bumper of a non-slip material, both of which may be installed to the surface of a protective covering by an adhesive, such as QuickCure-5™, or J-B Weld™ or Krazy Glue™. Heat shrinkable plastic is also a preferable protective covering, able to conform to many shapes, and may also be employed as a mechanical connection of components within the tubing, once it is heated into place, and is more cost-effective than moulding a protective covering for each paintbrush embodiment out of a material such as plastic.

When a protective covering is comprised of two or more pieces of heat shrinkable plastic, all connections of the tubing are preferably sealed. In an embodiment comprised of a two-piece protective covering, this may be achieved by installing a light permeable, non-adhesive type of heat shrinkable plastic (which acts as a light/lens protective covering) and manually sealing the front edge with an adhesive, that may be QuickCure-5 or LePage™ QUAD Advanced Formula Sealant (or other sealant). This adhesive may be applied to the ferrule before the tubing material is shrunk into place or after the tubing is installed, by applying a bead of sealant to the joint where the tubing and ferrule, or two layers of tubing, meet. An alternate method of sealing involves installing a small piece of adhesive-lined (dual-walled) heat-shrinkable plastic, which has its own sealing adhesive within the shrinkable plastic tubing, installed near the base of the bristles to completely bond, and create a waterproof seal from the light permeable protective covering to the ferrule of the brush, or to span over a joint of two layers of heat shrinkable plastic tubing. Adhesive-lined (dual-walled) heat-shrinkable plastic may be used for the protective covering of the handle, but is not preferred for the light permeable protective covering, since the adhesive within the tubing may interfere with the activation of certain switch assemblies, and may discolour in time.

The preferred protective covering for a handle of a paintbrush, comprising a power source housing that has been attached to the handle, is a tubular heat shrinkable plastic material, which may be non-adhesive-lined or adhesive-lined. An adhesive-lined type of heat shrinkable plastic tubing is most preferred for its durability, rigidity, and superior mechanical bonding capabilities, whereby a waterproof bond is achieved by simply shrinking the covering into place, and the internal adhesive creating a watertight seal, encapsulating all components within the tube, but it is not the most cost-effective. The covering for the handle portion may also be formed using a more inexpensive heat shrinkable plastic tubing, such as ultra-thin wall heat shrinkable plastic, which may be thinner, and manually sealing each end of the tube with an adhesive (such as QuickCure-5™), rather than using a more costly adhesive-lined heat shrinkable plastic. When the protective covering consists of more than one continuous tube of heat shrinkable plastic, and the neither the light-permeable tubing, nor the handle tubing are adhesive-lined, a band of adhesive-lined heat shrinkable plastic cut to an approximately 1 inch width may be heated into place over the joint of the two coverings, creating a seal between the two coverings, and creating a three-piece heat shrinkable plastic protective covering. This type of protective covering takes slightly more time to install than a one-piece or two-piece protective covering, but the materials are more cost-effective than installing adhesive-lined heat shrinkable tubing over the entire handle.

In a two-piece protective covering configuration of a lighted paintbrush, an adhesive-lined heat shrinkable plastic tube is preferable for the piece of protective covering installed on the handle of some lighted paintbrush embodiments because as it is heated into place, the adhesive within the tube melts, creating a strong bond with the components within the tube. These components may include, but are not limited to, the paintbrush handle, one or more battery housing connectors or power source housing connectors, one or more power source housings and/or resistor or printed circuit storage compartments, or one or more surface mounted power sources.

An example of a surface mounted power source may be a solar power source, which may not be held within a housing, but attached to an outer surface such as the handle or wrapped around the outer surface of another power source housing, and held in position and protected between the handle or power source housing and the protective covering.

The final shape and configuration of the protective covering on each handle of each brush will depend on the type of power source or power sources required to operate the lighted paintbrush. For example, if a solar type of power source is employed below the surface of the protective covering, a single light-permeable outer covering is preferred, or at least one other portion of the handle protective covering installed must also be light-permeable to allow for the power source to function efficiently.

Figure 26A:
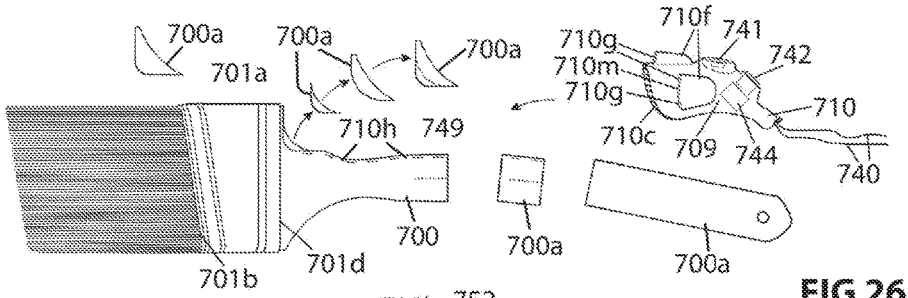
FIG. 26A illustrates the removal of a portion of a paintbrush handle in order to affix the power source housing connector and power source housing to the end of the brush handle, and further modifying the handle by removing a portion of the top shoulder directly behind the ferrule, as a means of creating space for one or more switch assemblies (mounted in the outer shell), to provide a more compact, streamlined design.
Figure 26B:
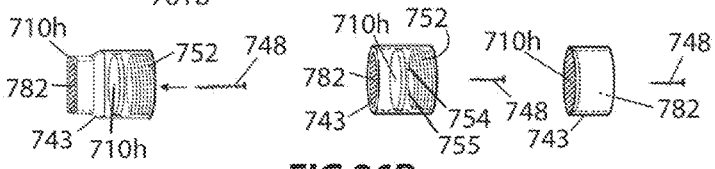
FIG. 26B shows three different configurations of battery housing connectors.
Figure 26D:
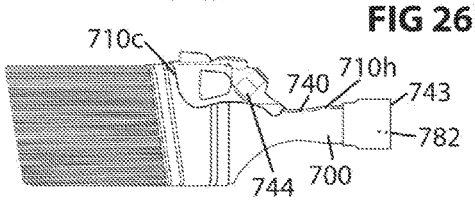
FIG. 26D shows the outer shell and housings of FIG. 26A, mounted on the brush handle, with a power source housing connector mounted to the end of the cut-off handle.
Figure 26C:
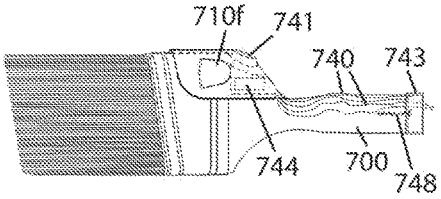
FIG. 26C shows a compact, streamlined design of an outer shell and light housings which comprises a switch recessed into the confines of the traditional natural brush handle parameters as shown in FIG. 26A, but whereby the top shoulder has been modified and configured to accept the switch assembly.
Figure 26E:
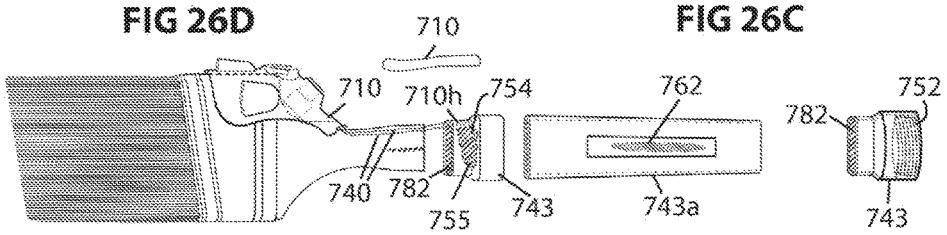
FIG. 26E shows the brush and accessory of FIG. 26D prior to installation of the power source connector and power source housing.
Figure 26F:
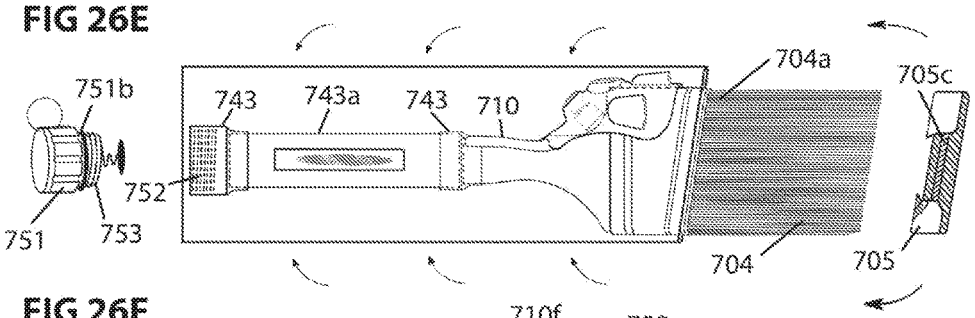
FIG. 26F shows the accessories of FIG. 26E all mounted on a brush, as well as a single protective covering of heat shrinkable plastic tubing, a bristle base protector, and an end cap and secondary battery housing connector, prior to installation. The single protective covering, when installed, is the secondary battery housing connector in a mechanical connection form.
Figure 26G:
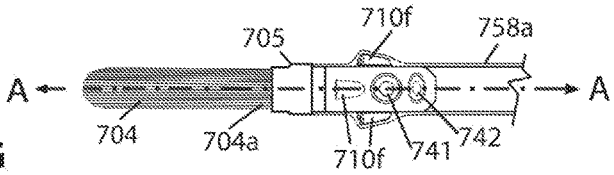
FIG. 26G shows a partial top view of a portion of the brush of FIG. 26F, showing the heat shrink and a standard bristle base protector installed, without ergonomic finger grips.
Figures 26H, 26I, 26J, 27A, 27B:
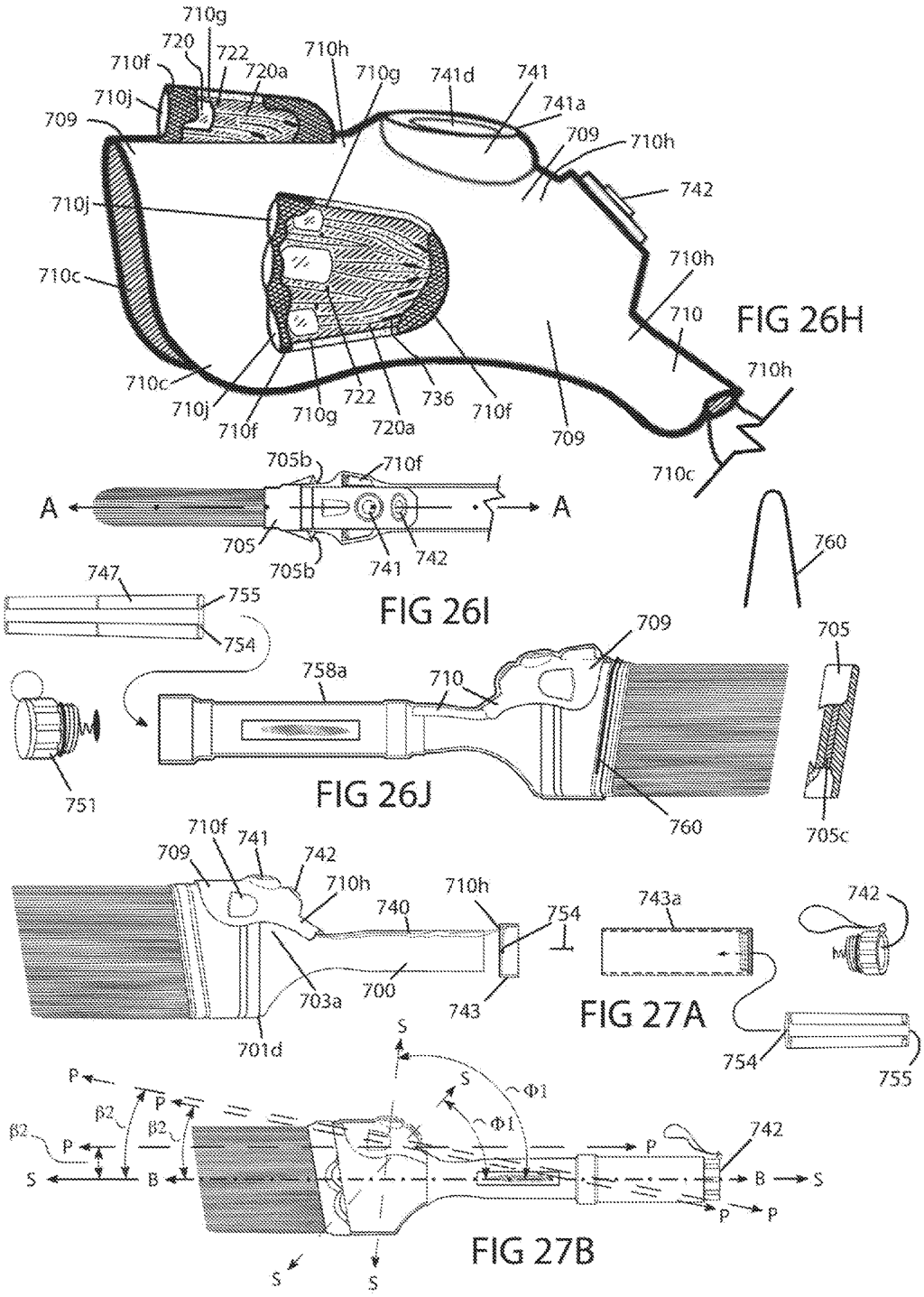
FIG. 26H shows an expanded view of the outer shell, switches and light housings of FIG. 26F, with a cut-out portion shown on each light housing, exposing the LED's.
FIG. 26I shows a partial top view of the lighted paintbrush embodiment shown in FIG. 26F, with ergonomic finger grips.
FIG. 26J shows the apparatus of FIG. 26F with the protective covering installed, the ridge or channel affixed to the protective covering, and with a bristle base protector, and power source holder and end cap comprising an O-ring, ready to be installed.
FIG. 27A shows an outer shell comprising two light housings with three LED's in each light housing and two switches to control the lights, mounted on a brush, with a battery housing connector ready to be fixed to the end of a modified brush handle, and with a power source housing and a power source holder and end cap (with a safety switch) ready to be installed.
FIG. 27B shows the completely assembled apparatus of FIG. 26A, and also shows the angles that the lights are structurally pointed within the housing, and the angles that three switch assemblies are mounted, all in relation to Axis B.

The handle's protective covering of heat shrinkable plastic tubing produces a waterproof seal, and also protects the conductive leads or wires which may be attached to the surface of the handle or placed in a dado or groove type of relief area 710*h*, as seen on FIG. 26A and FIG. 26D, which is cut into the surface of the handle in order to protect the leads or wires and reduce the total thickness of the handle, by positioning the leads or wires protected within the confines of the original outer perimeter of the traditional paintbrush handle. The portions of the conductive leads which are positioned along/within the handle location as a means of electrically linking the power source to one or more switches, lights or LED's, are also fixed in place within the rigid form of the protective covering (along with the battery housing), by means of a mechanical connection caused by shrinking the heat shrink tubing around the components, which adds only minimal thickness to each one of the irregularly shaped components, to form a streamlined handle configuration. This results in a superior, rigid, mechanical bond, conforming to all components within the tube, and forming a new one-piece rigid brush handle, comprising a power source housing preferably mounted within a paintbrush handle protective covering, which spans from the base of the shoulders to the tip of the power source housing, leaving the batteries protected and accessible from the end of the handle without removing the cover. This durable type of protective covering is fixed in place on the brush, for the life of the brush.

One more example of an embodiment with a fixed protective covering comprised of three pieces of heat shrinkable plastic is shown in FIGS. 1A-1E and FIGS. 3A-3E, whereby the first piece is light permeable and placed over the ferrule/light/switch area (as previously mentioned), and the second and third pieces cover a portion of the paintbrush handle (with one overlapping the other), but only cover and protect the conductive leads portion of the illumination means and the paintbrush handle, and whereby the battery housing connector portion of the power source housing is fixed to the outer surface of the protective covering by an adhesive. In these embodiments, the protective covering is not considered a battery housing connector.

A further advantage of a slightly thicker covering material being employed as part of the protective covering (which may or may not be adhesive-lined), is that it also allows deeper textures of various shapes and/or patterns to be hot-stamped or imprinted into the surface of the heat shrinkable plastic protective covering (with one example shown in FIG. 25, relating to the brush of FIGS. 9A-9E), which may be located on the handle portion of the brush, and used as a gripping means, and which may be shaped in the form of a company's name or logo. This same principal of gripping may be positioned on a handle of an illumination means for a brush by moulding indicia 762 into the rigid portion, such as an outer shell or power source housing, or adding gripping shapes to the embodiment by a means such as an adhesive.

It should also be noted that a lighted paintbrush apparatus protective covering may also be a molded handle, similar to that described in the original application Ser. No. 13/508,710. For example, a lighted paintbrush apparatus may be molded in one or more pieces, comprised of a mouldable material such as plastic, and configured in an embodiment form which may or may not have a removable bristle apparatus; the outer shell of the one or more pieces could function as an outer shell or protective covering, which may also have lights protected by a removable lens or a lens, fixed to the body of the embodiment when assembled. Two or more pieces of a paintbrush gripping end moulded of plastic may be connected by means of an adhesive, or ultrasonically welded.

In the different embodiments within this application showing removable lighting accessories, protective coverings 756*a*, 758, 758*a*, 758, 856*a* cover and protect at least a portion of the handle, whereby light permeable protective coverings 756*a*, 856*a*, 956*a* may cover a portion of the handle and also cover and protect all lighting accessory components. The light-permeable protective covering 756*a*, 756*c* refers to angled brushes. Light-permeable protective covering 756*c* 856*a* refer to rectangular brushes, and light permeable protective covering 956*a* refers to round brushes. Examples are FIGS. 5A-5E, 7A-7C, 32A-32E, and 33A-33E shown on angular brushes, and FIG. 53A-53E for rectangular brushes. FIGS. 81A-81H show a brush with a round, tapered ferrule 901*f*, with a fixed, light-permeable protective covering 958*a*. By replacing the protective covering 956*a* to a fixed protective covering 958, the embodiment in FIGS. 81A-81H would be illustrated as a lighted paintbrush with a fixed illumination means.

In the different embodiments within this application showing fixed lighting accessories, protective coverings 758, 858, 958 cover and protect at least a portion of the handle, whereby light permeable protective coverings 758*a*, 758*c*, 858*a*, 958*a* may cover a portion of the handle and also cover and protect all lighting accessory components. The light-permeable protective covering 758*a*, 758*c* refers to angled brushes. Light-permeable protective covering 758*c* 858*a* refer to rectangular brushes, and light permeable protective covering 958*a* refers to round brushes. Examples are FIGS. 3A-3E, 6A-6D, 9A-9E, 12, 14A-14E, 23, 24, 26L, and 27B shown on angular brushes, and FIGS. 37A-37E, 38A-38F, 44A-44E, 45, 60-64, 66A-66D, and 67A-67C for rectangular brushes. FIGS. 78A-78K, 79A-79I, 80A-80I, 82-88, and 96 shows a brush with a round, tapered ferrule 901*f*, with a fixed, light-permeable protective covering 958*a*.

These illustrations are also some examples of embodiments having with one or more a fixed protective covering, 758, 758*a*, 858, 858*a*, 958 and 958*a* of one or more pieces of heat shrinkable plastic, which envelopes the outer shell of the illumination means, holding the outer shell 709, 809, 909 positioned between the ferrule, 701*a*, 801*e*, 901*f* or the handle 700, 800, 900, (or both).

An alternate type of removable protective covering is illustrated in FIGS. 7A-7C, 8A-8C, 32A-32E, and 33A-33E, which may be moulded of plastic as one integrally formed outer shell, outer shell extension, and battery housing, which houses all illuminating components and at least one power source and at least one switch.

The bristle base protector (and front and rear seals similar to the ones listed in Applicant's parent application Ser. No. 13/508,710) may now be constructed as a flexible, resilient band. It is moulded, shaped, sized and configured to engage a gripping end of a brush and the base of the bristles, whereby when installed on the brush, applies relatively equal pressure to the base of all bristles and the front of the ferrule, at an angle similar to the front angle of the ferrule in order to span the joint between the ferrule and the bristles. It creates a paint barrier to the base of the bristles, and a water-resistant seal to the protective covering 758*a*, 858*a*, 958*a*. It is preferably constructed of material that is resistant to paint adherence. This material may be silicone or a medical grade silicone or rubber, or any combination of these. It could also be rubber latex, polyurethane, polyethylene, polyisoprene (synthetic latex), or nitrile (synthetic rubber). The bristle base protector 705, 805, 905 may be positioned over the joint at the base of the bristles and the front edge of the brush ferrule, stretched over the joint of the ferrule and bristle base connection, to form a water-resistant and paint-resistant barrier, preventing the paint from contacting the base of the bristles.

The bristle base protector may be moulded from a compressible, stretchable, resilient type of material, which may be non-slip, and may be ergonomically shaped and moulded, comprising one or more recessed areas 705*b*, 805*b*, formed to accept one or more tips of the painter's fingers, with each recess comprising a very thin gripping layer. A portion of these finger recesses may be thinned to as little as 0.1 mm, and increasing in thickness towards the most forward portion of the finger recess (shown enlarged in FIG. 12, from the top view, and one example, showing a side view, in FIGS. 9A-9E), where the finger recess meets the protective covering, between the painter's fingertip and the brush ferrule, in order to keep the gripping area to a minimum thickness.

Figure 12:
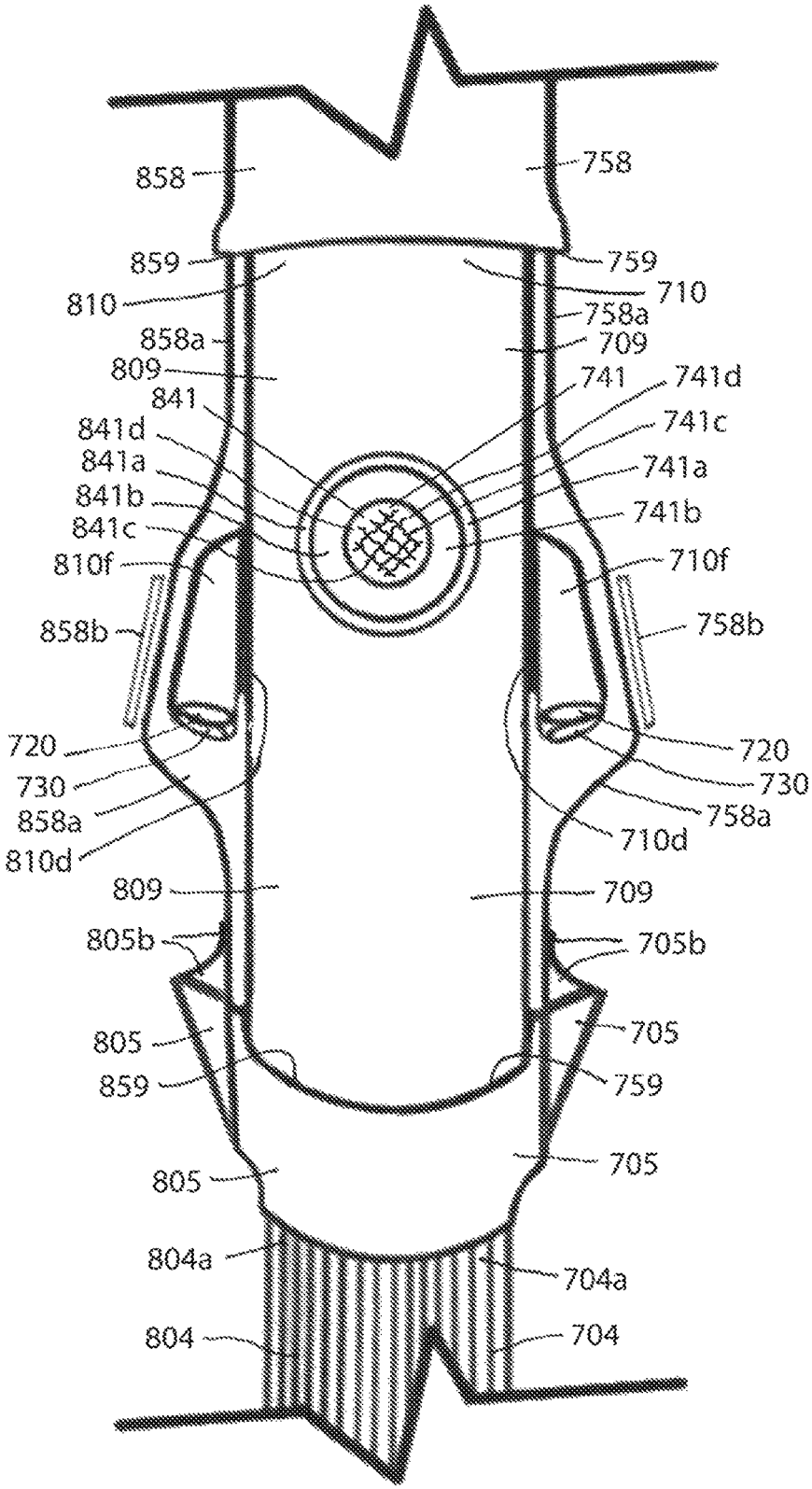
FIG. 12 shows a top view of the embodiments of FIGS. 3A-3E, FIGS. 6A-6D and FIGS. 9A-9E, showing the activation switch components, protective coverings, anti-wear protection, bristle base protector, light housings, first and second LED light holders, risers, and ergonomic finger recesses.

The non-slip composition of the bristle base protector may grip the protective covering (in the ferrule area) by being stretched and positioned over the gripping area of the brush, and aligned and guided into place by one or more channels 760, 860, which may be fixed to the outer surface of the protective covering, and positioning the bristle base protector relatively centered over the connection of the base of the bristles to the ferrule. The pressure of the painter's fingertips located in the ergonomic finger recesses helps stop the seal from sliding forward or out of place. The bristle base protector may also comprise a hollowed-out groove 705*c*, recessed in the underside of at least one part of the bristle base protector, which may correspond and interlock with a raised channel of a corresponding opposite shape moulded into the light pack or fixed to the surface of the protective covering near the base of the bristles. A channel 760 and groove 705*c* may interlock when the bristle base protector is installed on the brush, and together they position the ergonomic finger recesses correctly, and may prevent the bristle base protector from sliding forward or out of place. In some embodiments, the channel below the bristle base protector may also be a double-walled (adhesive-lined) heat shrinkable band (approximately 9 mm wide after it has been shrunk into place), which in at least one embodiment, may create a watertight seal between the protective covering and the brush ferrule. The channel 760 mounted on a protective covering may interlock with a grooved recess 705*c* located in the underside of heat shrinkable band. Examples of a bristle protector used in combination with a back seal are shown in the embodiments as follows: bristle base protector 705 and back seal 759*a* shown in FIGS. 5A-5E, 8A-8C, 32A-32E, and 33A-33E, and bristle base protector 805 and back seal 859*a* shown in FIGS. 53A-53E, and bristle base protector 905 and back seal 959*a* shown in FIGS. 81A-81H. In these cases, the bristle base protectors and the back seals, may be moulded as a stretchable band of approx. 3 mm in thickness and approx. 25 mm-32 mm in width. The bristle base protector may also be thinned to approx. 1.6 mm or less, in locations where the light must project past the band, and may be ergonomically raised towards the front portion of the finger recesses, whereby the front portion of the recess may be approximately 5-7 mm thick. In certain embodiments, the bristle base protector may be one wide band, consisting of various thicknesses. The wide band may be 35 mm-38 mm wide (and may be 3 mm thick or less), and may be thinned in the central portion, preferably in front of the LED's, fixed lens, and/or light housings of the lighting accessory (as shown in FIGS. 31C, 65A-65D, and 66A-66D), to as little as 0.1 mm thick. This type of bristle base protector may be stretched completely over the illumination means, allowing the light to shine through the thinned portion without distorting the light rays. When the bristle base protector of is in place on the brush, the thickness of the ergonomically raised area located towards the front portion of the finger recesses is similar in height to the raised area of one or more light housings (5-7 mm depending on the size of LED within the housing), as shown in FIG. 12, but positioned much lower than the lights, so as to not interfere with the light rays. The similar matching of heights may allow the brush to be set down on flat surfaces without collecting debris on the wet bristles, or transferring paint to the flat surface where it rests. It should be noted that a bristle base protector may stand alone as an item that can be installed on a paintbrush, which may or may not be equipped with an illumination means, to eliminate paint buildup at or near the base of the bristles.

All bristle base protectors function as a paint barrier to the base of the bristles, virtually eliminating paint build up around the base of the bristles while painting, where it is hardest to wash out, saving time and frustration during the cleaning process, also adding extra life to the paintbrush. This bristle base protector may function as a front seal and/or a resilient bumper type of anti-wear protection 758*b*, and may also act as a protective cushion if the brush is dropped, especially when ergonomic finger recesses 705*b*, 805*b*, 905*b* are formed within A back seal can also be considered a type of ant-wear protection for one or more parts of protective covering.

Other lighting accessories may employ a ferrule covering material, which may be selected from magnetic materials, cloth, an adhesive-backed foam tape, spray foam, paint, adhesive (or other adhesively attachable material or resilient material (that may be in the shape of a band, or folded or moulded or both), an adhesive or heat shrinkable plastic tubing, or flat or molded plastic.

Examples of an adhesive being employed as a first or second ferrule covering material, and used as a means of fixing one or more outer shells in place on the shoulder of a brush are shown in FIGS. 1A-1C, 3A-3E, 6A-6D, 9A-9E, 14A-14E, 21, 22, 23, 24, 25, 26C, 26E, 37A-37E, 38A-38F, 44A-44E, 45, 66A-66D, 67A-67C, 78A-78K, 79B-79E, 80A-80I, 81A-81H, 92, 93, 94, 95, and 96.

In the embodiment of FIGS. 1A-1E, a first ferrule covering, such as adhesive, is employed to fix the mounting bases of the individually mountable outer shells (of the light housings), and the thin base of the switch assembly, and the conductive leads (which connect the lights and the switch), in position on the handle. Once these are in place, a second ferrule covering, may be installed, which is shown in FIGS. 1A-1E as a cut out in a flat pattern such as a fabric or a thin malleable vinyl covering material, and is wrapped over the sides and upper portion of the ferrule. The tab 707*b* of the ferrule covering is folded down firmly into position on the rounded, upper shoulder of the handle's gripping end. This second covering 707 covers a substantial portion of the ferrule and/or part of the handle as well as the thin mounting bases 710*c* of the lights and switch assembly, as shown in expanded illustrations of the light housings in FIG. 2A to 2F. This second ferrule covering also covers and protects a portion of the conductive leads or wires, which electrically link the lights, switch and power source. When installed, the second ferrule covering is configured to form one uniform thickness of covering over the ferrule area by spanning over the bases of the lights and switch, and the ferrule and handle, and is fixed in position to create one relatively smooth surface.

FIGS. 32A-32E, 33A-33E, 31A-31C, 66A-66D, and FIG. 68 show a relatively small, independent flexible protective covering 758 that spans over the switch only.

FIGS. 1A-1E also show a ferrule covering material (which is also a protective covering for the wires or conductive leads) which has openings for at least one light housing, and one or more switches, and covers a portion of the ferrule and a portion of the mounting base adjacent to the light housing. The light housing positioned to at least partially extend through the opening in the ferrule covering material. The openings in the covering correspond to the position, size, and angle of the light holders, which are mounted on the outer shell so that illumination is provided through the openings in the covering and away from the ferrule and outer shell. The riser projecting from the mounting base is configured to raise the housing through the openings in the ferrule covering.

Yet another form of integrally formed outer shell is illustrated in FIGS. 66A-66D, 67A-67C, 69, 70, 73, and 74, whereby a one piece, moulded outer shell has light housings and LED lights mounted within the light housings. The outer shell is slid into place over both the upper and lower shoulder of a brush, substantially enveloping a large portion of the ferrule of a brush and fixed into place by a first ferrule covering material, such as an adhesive or adhesive and wedge 808, as shown in FIGS. 65A-65D and 66A-66D. Once the outer shell is fixed into place, a handle protective covering (which may be heat shrinkable plastic tubing) may be slid over the narrow portion of the handle and the rear portion of the outer shell, and heated into position on the handle.

FIGS. 31A-31C, 32A-32E, and 33A-33E show a removably attachable illumination means, whereby the mounting base of the outer shell comes in direct contact with a substantial portion of the gripping end. A first ferrule covering (adhesive-backed foam tape, for this description) is held in position between the brush and the outer shell (and the outer shell extension), prior to the outer shell and bristle base protector being installed on the brush. The bristle base protector envelopes the front of the ferrule and the base of the bristles.

The outer shells of the lighting accessories of FIGS. 3A-3E, 9A-9E, 14A-14E, 15, 16, 20, 21, 22, 26C, 26E, 26J, 27B, 37A-37E, 38A-38F, 44A-44E, and 45 are mountable to the ferrule and/or handle of a variety of brushes, made by a variety of brush manufacturers, and having a similar overall shape. Various sizes of brushes having a similar shape can be fitted with a ferrule covering, if necessary. A ferrule covering such as the examples shown in FIGS. 9A-9E, 14A-14E, 37A-37E, 38A-38F, 44A-44E, and 45 may be positioned and secured between the ferrule and the mounting base of the outer shell, and may adjust for minimal differences of handle thickness and/or differences of gripping end shape, between a variety of brushes, which may be slightly thinner than the configuration of an outer shell sized for the majority of brush thicknesses.

A ferrule covering may also be utilized as a mounting surface for a fixed outer shell, which may comprise the lights and switch, as shown in FIGS. 3A-3E, 9A-9E, 14*a*-14E, 22, 37A-37E, 38A-38F, 44A-44E, 45, 53A-53E, and 54-59, and utilized as a means of adjusting the thickness of a handle, as a method of attaching a common outer shell to various thicknesses of brushes.

An alternate type of ferrule covering 807, as shown in FIGS. 65A-65D and FIGS. 66A-66D, may compensate for a slightly thinner brush handle and aid in achieving a snug-fitting lighting accessory. One or more ferrule coverings, which may be a rigid, slightly wedge-shaped material, may be fixed to the brush ferrule by an adhesive, and positioned between the ferrule and the outer shell of the illumination means as it is slid on over the brush handle.

Examples of a ferrule covering, whereby the protective covering comes in contact with a substantial portion of the ferrule, and is the only thickness added to the ferrule of the gripping end of the brush, and whereby the ferrule covering is a one-piece or a two-piece protective covering (which is heat shrinkable plastic tubing) are shown in FIGS. 3A-3E, 6A-6D and 26J.

FIGS. 9A-9E, 14A-14E, 37A-37E, 38A-38F, 44A-44E, 45, and 53A-53E show a first ferrule covering material installed over a substantial portion of the ferrule, and at least one portion of the handle; the mounting base of one or more outer shells is positioned and secured to at least a portion of the first ferrule covering material by a second ferrule covering (an adhesive), fixed to the first ferrule covering, and positioned on the shoulder of the paintbrush.

One or more ferrule covering materials may be positioned between the ferrule and the mounting base of one or more outer shells, covering at least a portion of the ferrule or handle, or both. FIGS. 9A-9E, 22, 25, 37A-37E, 38A-38F, 44A-44E, and 53A-53E show a first ferrule covering, whereby heat shrinkable plastic tubing is the ferrule covering. FIGS. 14A-14E show a ferrule covering consisting of two pieces, cut from a thin material such as flexible vinyl or fabric. A second ferrule covering, such as adhesive is then applied between the outer shell and the first ferrule covering. This type of installation adds minimal thickness to the main gripping area, such as the ferrule, but it should be known that unless the ferrule covering is being used to adjust the thickness of a brush (in a case of utilizing one or more common outer shells), or being used to smooth the surfaces of the handle and ferrule together, the surface of the ferrule coverings shown in FIGS. 9A-9E, 10A-11E, 14A-14E, 22, 25, 34A, 37A-37E, 38-56, 58, 59, 62-64 may be deleted from the assembly of the brushes shown in those figures, leaving the only added thickness being the protective covering (which may be less than 1 mm overall thickness to the gripping end of the brush).

In the embodiment of FIGS. 14A-14E, multiple ferrule coverings are employed. For example, two first ferrule covering pieces such as a ferrule covering 707 cut out of a fabric or a thin vinyl covering material, shown in a flat pattern view, is fixed to the sides of the ferrule and handle of the brush by a first ferrule covering, which may be adhesive, or an adhesive within the backing of the second ferrule covering. Another ferrule covering, such as adhesive, fixes the outer shell and wires in position on the on the first ferrule covering and the gripping end of the brush, and a third ferrule covering, such as heat shrinkable plastic (since it is heated into place over the entire gripping end and is in direct contact with the lower portion of the ferrule) is then installed in this embodiment.

Another type of covering may be a closable, removable, reusable packaging covering, having at least one cut-out opening or window. The openings and/or windows are positioned to match the location of one or more lights, or one or more switches, or both, when the packaging is installed on the brush. The openings are preferably light-permeable or clear, and allow light to be emitted through the covering or opening (when installed on the brush). The one or more openings allow at least a portion of the light housing and/or switch housing to protrude past the first protective covering, to allow access for a potential buyer to see the light and switch configuration, and activate the switch of the lighted paintbrush before purchase, without removing the covering. The cut-out openings or windows may also be covered with a flexible covering, such as latex or thin and flexible plastic, which may be fixed in place by an adhesive applied to the back or inside of the protective covering, and around the perimeter of the opening. The flexible covering protects one or more lights or switches or both, and is configured to be sufficiently flexible to allow the light and/or switch housing or assembly to partly protrude through or past the main protective coverings surface, maintaining a thin profile around a substantial portion of bristle end and/or gripping end of the brush.

FIG. 97, FIG. 98, FIG. 99, FIG. 100 and FIG. 101 show packaging apparatuses and protective coverings, designed to allow for viewing and testing the components of a lighted paintbrush before purchase, while protecting the same brush during shipping and storage. The one or more packaging coverings are configured to cover and protect at least a portion of the lighting accessory for a brush, the gripping end of a lighted paintbrush, the bristle end of a lighted paintbrush, or any combination of these. FIG. 97 shows an example of a common, known type of protective covering, whose particular shape and folding pattern is not part of the invention, but is a sample of a foldable type of covering, with FIG. 97A showing a folded version of FIG. 97, showing the flexible covering in place over the opening. This example of a foldable covering is now shown modified to include cut-outs/light permeable windows, suitable (after folding) for covering and protecting the bristle end, the one or more lighting and switch accessories, and ferrule of an embodiment of the lighted paintbrush, while allowing viewing and fingertip access for testing of the illumination components, without removing the covering. FIG. 98 and FIG. 99 illustrate a moulded protective covering to cover and protect at least a portion of the lighting accessory for a brush, the gripping end of a lighted paintbrush, the bristle end of a lighted paintbrush, or any combination of these. The embodiments of FIG. 98, 99, 100, and FIG. 101 have at least one self-hinge 781, whereby the two sides fold and may interlock with each other. FIG. 100 shows the embodiment of FIG. 9 and FIG. 98 mounted on a brush, and FIG. 102 shows the embodiments of FIG. 99 mounted on a round brush. FIG. 101 shows an embodiment mounted on a rectangular brush, with individual openings for the lighting accessories on the brush shown in FIGS. 37A-37E.

When a battery source is employed as the power source, within the handle and behind the ferrule of the lighted paintbrush apparatus, it is preferred (in most embodiments) that the battery housing connector be configured to receive or connect to a battery housing that may hold the one or more power sources in position, with the positive and negative terminals of the battery running parallel with Axes A and B. Examples are shown in FIGS. 261 and 26J, FIGS. 27A and 27B, FIGS. 78A-78K, FIG. 92, and FIG. 93. However, FIG. 7 shows an alternate embodiment whereby it is preferred to have the positive and negative terminals running at a 90 degree angle to Axes A and B. In this embodiment, each power source storage compartment 744 is configured and sized to hold 2 coin cell batteries. Four CR-32 batteries are positioned in groups of two, one group behind the other, above the handle and rearwardly of the transitional shoulder portion, avoiding the traditional gripping area of the brush, as a means of maintaining a streamlined configuration for that particular location on the gripping end, and for that configuration and type of power source. It has also been contemplated to use one or more thin batteries such as a 2032 battery, or a solar covering, in the shape of a thin ferrule covering, located forward of the back of the ferrule within the main gripping area of the brush, maintaining a thin gripping area, and enveloped by a thin protective covering (which may be heat shrinkable plastic).

Other power sources are also contemplated. For example, between the protective covering and the gripping end (which may also be a battery housing fixed to the handle of the brush by a battery housing connector, having one or more relief areas for the conductive leads), a laminate capacitor 791 may be formed over the handle structure (which may be a battery housing 743*a*), with outer layers (which may be a fabric) being saturated with carbon nanotubes. The two outer layers can be charged by a solar cell panel on the gripping portion of the brush and may be within the tubular protective covering, as shown in the illustration of the lighting accessory components in FIG. 16 (and similar to the exploded views of FIG. 15), or be charged by an internal conventional power source 746, which may be held within one of the two storage compartments 744. One of the power sources may be held within a battery holder 747, which may hold 3-AAA batteries. Though embodiments and illustrations within this application may describe a conventional battery power source, the lighting accessory for a paintbrush or any of the lighted paintbrush apparatus embodiments, may be powered by more than one power source or a combination of power sources, including kinetic (or other renewable energy sources), or various battery configurations. The power source in various embodiments may also be a rechargeable power source charged by means of a charging port positioned on the surface of the gripping end of the brush. Also, while the preferred brush is a paintbrush, the power assemblies and illumination sources may also be configured to be mounted to any suitable brush as described within this application.

A battery housing connector is one method of securing a power source and/or battery housing to engage at least one portion of the gripping end of a brush. Battery housing connectors are individually configured to be attachable to certain shapes and sizes of brushes, and considering the location where it will be attached on the brush handle. Certain configurations are fixed on the brush, and some are removably securable.

It is preferred to keep the brush size and shape as streamlined as possible, so the preferred battery housing connector is configured to be attachable to the gripping end of the brush and preferably relatively centered on the handle. The overall thickness of the handle portion of where the battery housing connector will be attached is also taken into consideration, as well as the type of power source, and power source sizes, and the weight of one or more power sources. When attaching a power source to a brush by means of a battery housing connector, it is also preferred to maintain an approximate original length and width of the brush, so in some cases the brush handle is preferred to be cut off in order to install the battery housing connector, battery housing and end cap and keep within the original preferred length of the brush (or less).

The size of the portion of the handle that may be removed from a brush is directly related to size of the battery housing connector and power source added to the brush to replace the cut-off portion (of the handle). For example, a battery housing connector made of more than one part and configured to be joined together and comprising more than one power source in line with axis A or B or both, will require more handle to be removed to remain streamlined, keeping within a total length of the brush as well as in a preferred total weight of the brush (including the illumination means). In some cases, the amount removed from the brush is longer than the total combined length of the battery housing connector, battery housing, and end cap. This may be due to the combined weight of the battery housing connector, battery housing, and end cap, and the attempt to keep a well-balanced brush for comfort and handling. In some cases, it is preferred that the battery housing connector and battery housing be slightly larger than the original brush handle thickness, which acts as an added means of gripping.

In FIGS. 7A-7C, 8A-8C, 32A-32E, and 33A-33E, the battery housing connector is in the form of an outer shell configured to engage at least one shoulder of the brush, and hold one or more power sources within. The integrally formed outer shell and outer shell extension, and the mounting base of the shell extension is formed with the battery housing connector having a hollowed area 782, which receives at least a portion of the gripping end of a paintbrush.

Figure 8A:
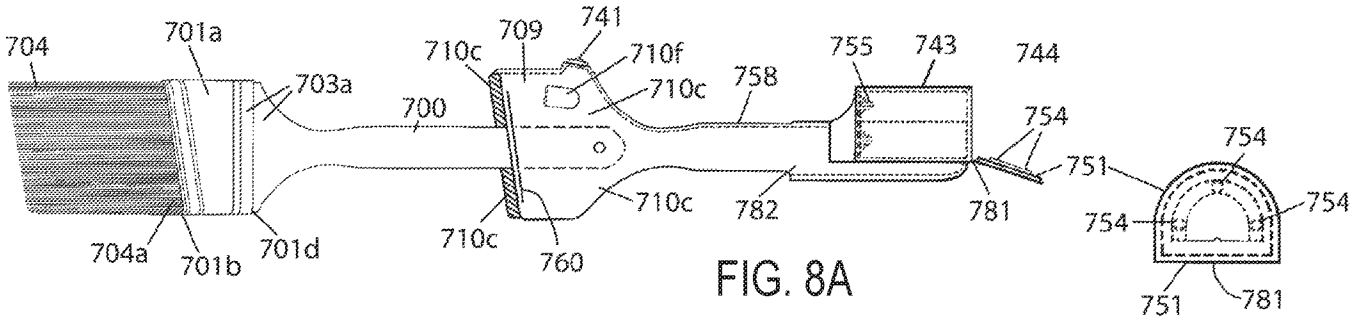
FIGS. 8A-8C illustrate accessories including an alternate self-contained illuminating embodiment that is removably attached, the outer shell mounting means, and the power source attachment means.
Figure 8B:
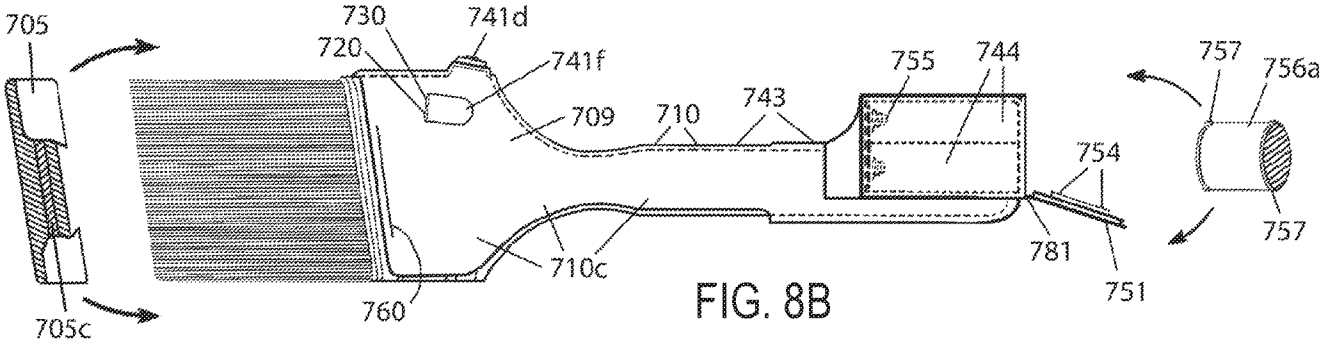
Figure 8C:
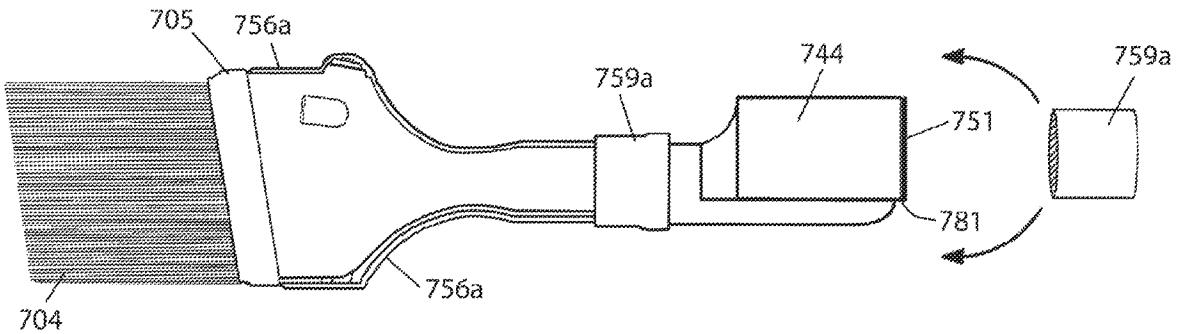
Figures 9A, 9B, 9C, 9D, 9E:
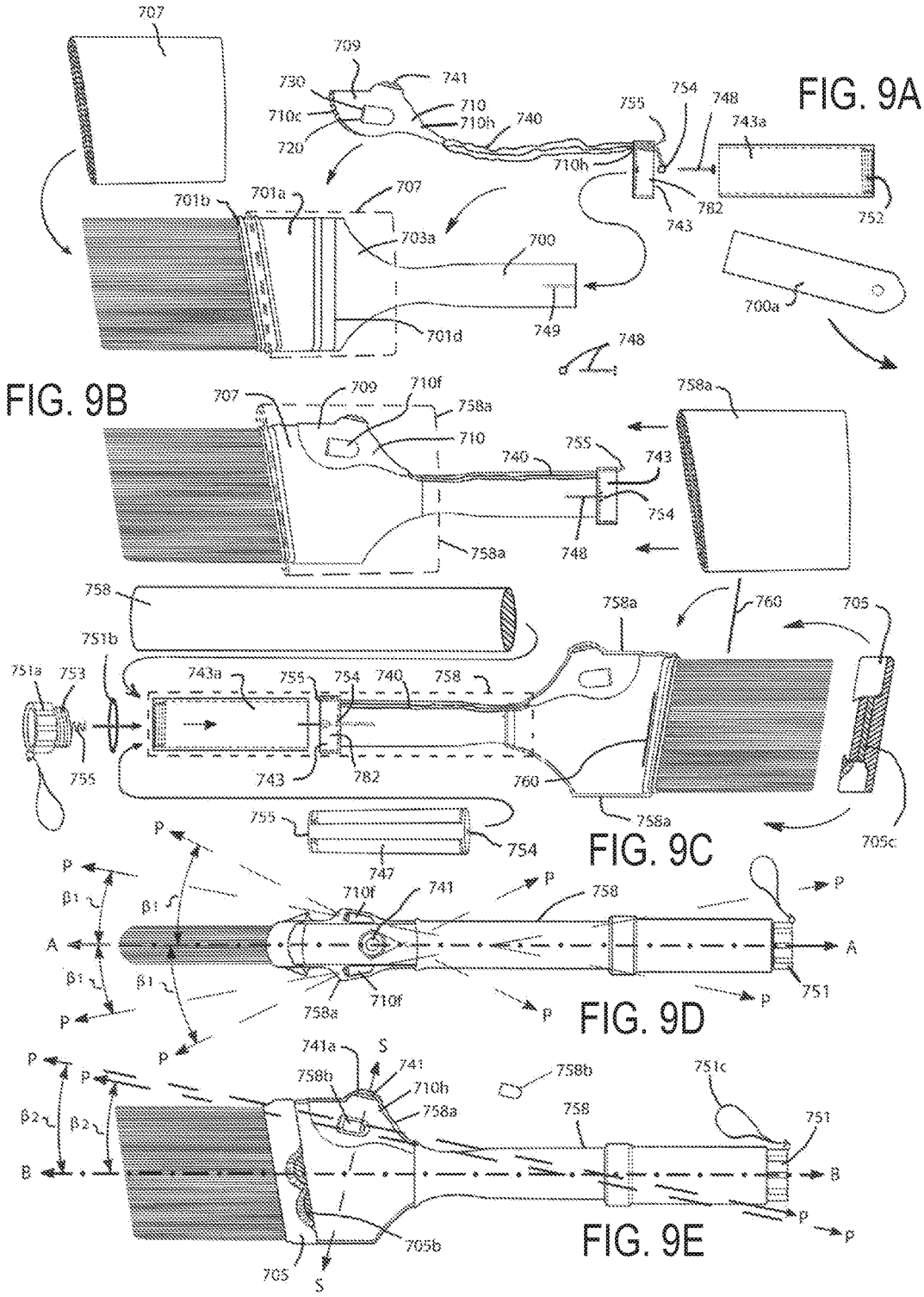
FIGS. 9A-9E illustrate accessories for a paintbrush, to be fixed to a paintbrush having an angled ferrule, and the assembly of same to create a preferred embodiment, and showing the angling of the lights from a top and side view, and the angling of a switch from a side view only.

The battery housing connector may be removably secured to the brush by two resilient flexible bands (a bristle base protector and back seal). FIGS. 7A-7C show a sliding access cover positioned on the side of the battery housing connecter as a means to access the power source, while FIGS. 8A-8C show an access cover on a self-hinge and positioned on the end of the embodiment.

Figures 31A, 31B, 31C:
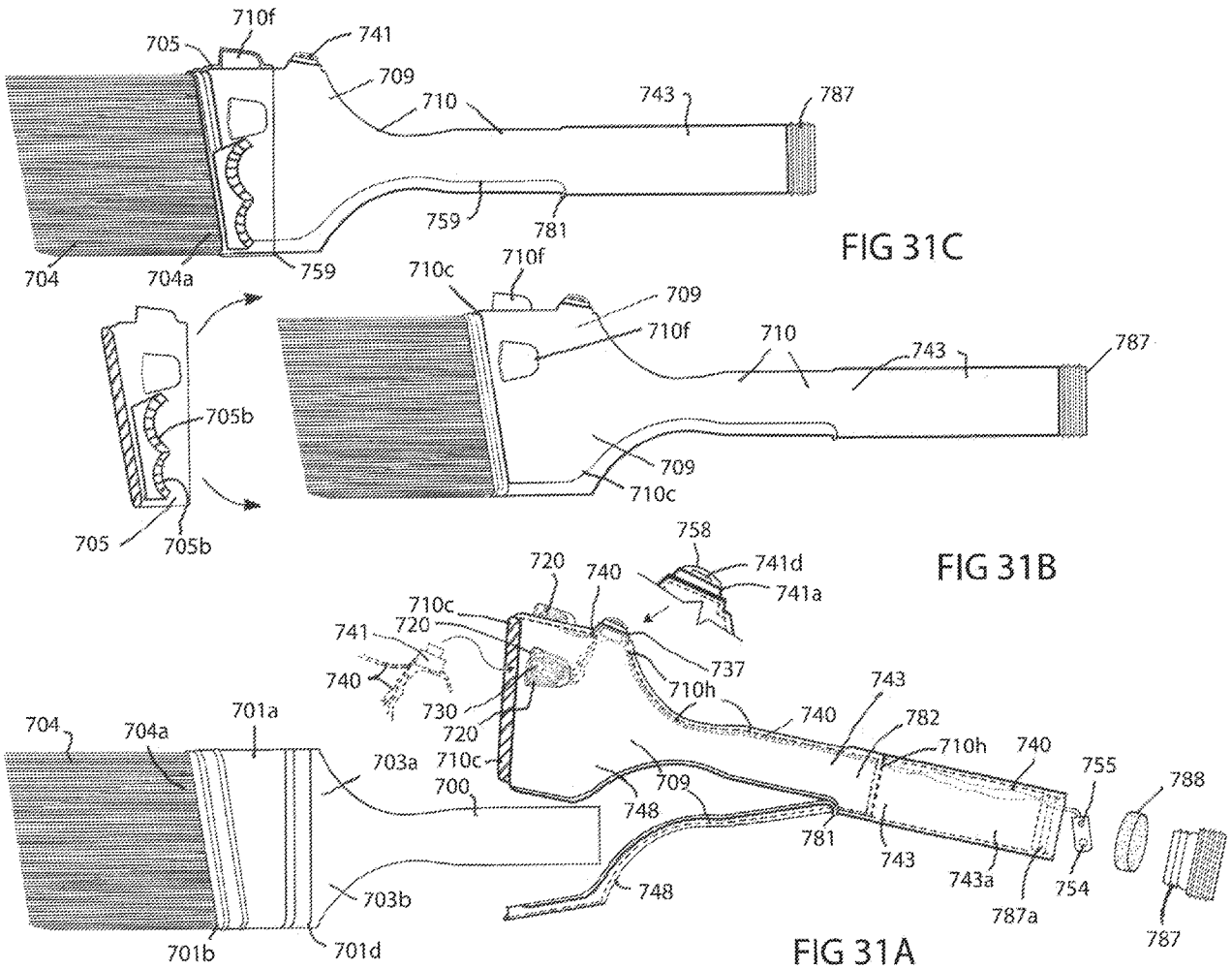
FIG. 31A illustrates an alternate illumination configuration to be removably fastened by two fastening means, a lower shell and a bristle base protector.
FIG. 31B shows the configuration of FIG. 31A closed tight around the brush, ready for the light-permeable bristle base protector, comprising ergonomic finger recesses, to be installed.
FIG. 31C shows the completed configuration of FIG. 31B, with the bristle base protector installed.
Figure 32A:
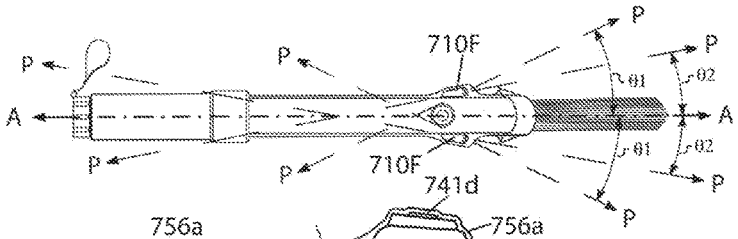
FIGS. 32A-32E illustrate an alternate illumination configuration to be removably fastened on to a modified brush handle, whereby the battery housing connector is slid over the modified end of the handle, with the outer shell resting on the upper shoulder, and the embodiment held in position on the handle by an ergonomic bristle base protector and a back seal, with a rolled-on protective covering spanning between the two seals, as well as the assembly of the lighted paintbrush, and the angling of the lights and switch in relation to Axis A and Axis B.
Figure 32B:
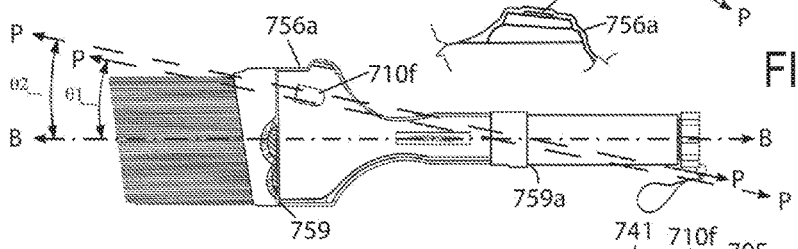
Figure 32C:
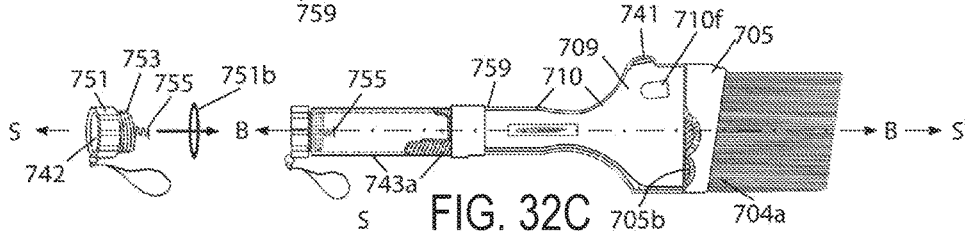
Figure 32D:
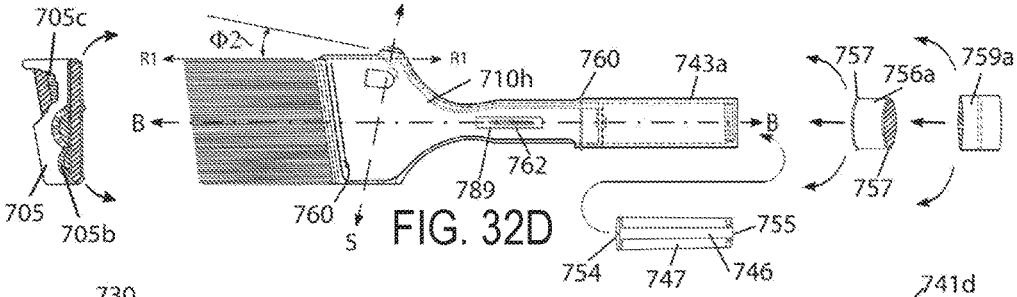
Figure 32E:
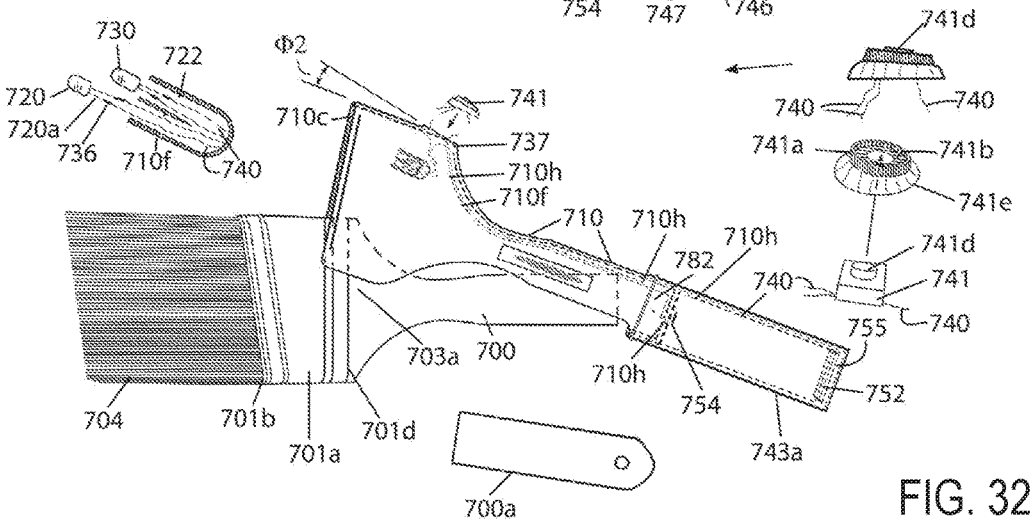

The battery housing connector 743 can also be removably secured, as seen in FIG. 31A, which shows two fastening means, the first being a lower shell 709, which is configured in a shape to interlock with the much larger outer shell 709 and movable by a self-hinge 781, closing shut around the lower shoulder 703*b* of the brush. The second means is by installing a light-permeable bristle base protector 705 configured with finger recesses 705*b* and a moulded portion sized and shaped to receive the light housings as it is installed over a thin mounting base 710*c* portion of the outer shell, and the base of the bristles 704*a*. The outer shell and outer shell extension, moulded and configured as part of the battery housing connector, is slipped over the upper shoulder and the modified brush handle engages a recessed area 782 in the battery housing connector before the lower shell is snapped shut. In the embodiment of FIG. 31A, the conductive connections 754, 755 to the battery terminals are not hard-fixed to the battery housing connector, but are attached to the battery and secured in the battery housing by a compressible material 788 such as foam, secured in place by a friction-fit end cap 787, which is mated with inside ridges 787*a* within the battery housing.

A lighting accessory may also be integrally formed with the outer shell and outer shell extension including a battery housing connector, moulded of resilient material suitable to be force-fitted over the end of a considerable portion of a brush handle as seen in FIGS. 5A-5E (removably secured) and FIGS. 6A-6D (fixed in position), with a form-fitted configuration matching a portion of the brush handle upon which it is installed, and may have relief areas for the wires.

In other cases, the battery housing connector is configured to have a flat surface on one end, which is suitable to abut, and be fixed to, brush handles of various sizes and shapes, which have been modified by being cut off, to shorten the handle and achieve a flat surface and drilling a pilot hoe in the center of the remaining handle. The battery housing connector may be fixed to the handle by inserting a center conductive fastener through the relief area in the center of the battery housing connector and turning it into the pilot hole in the handle. The other end of the battery housing connector is configured to have a recessed portion, which is sized and configured to receive a preferred battery housing, which may be a cylinder shape, and have at least a partly conductive component. This configuration of battery housing connector is able to be used on brushes having various bristle configurations and a variety of bristle patterns, due to the flat configuration of the battery housing connector being attachable to various brush shapes that have been modified and cut off, preferably perpendicular to Axis A and/or Axis B. Examples of the same configuration of battery housing connecter being attached to brushes of various bristle configurations and a variety of bristle patterns are shown in FIGS. 9A-9E installed on an angled brush, shown in FIG. 37A-37E installed on a rectangular brush and shown in FIG. 79B-79D installed on a round brush.

FIGS. 81A-81H show a brush with a modified handle 980*a* configured to engage a ridged fastener 980 within a battery housing connector which has a corresponding shape, such as a leaf spring bent in a shape that easily engages the modified handle 980*a* when it is inserted into a battery housing connector. It may also be constructed of a resilient material suitable to comprise a self-hinge 781, whereby two interlocking components friction-fit together around the brush gripping end, as seen in FIG. 31A. This figure also shows the other end of the battery housing connector engages the end cap, which may be friction-fitted into the battery housing.

Figure 23:
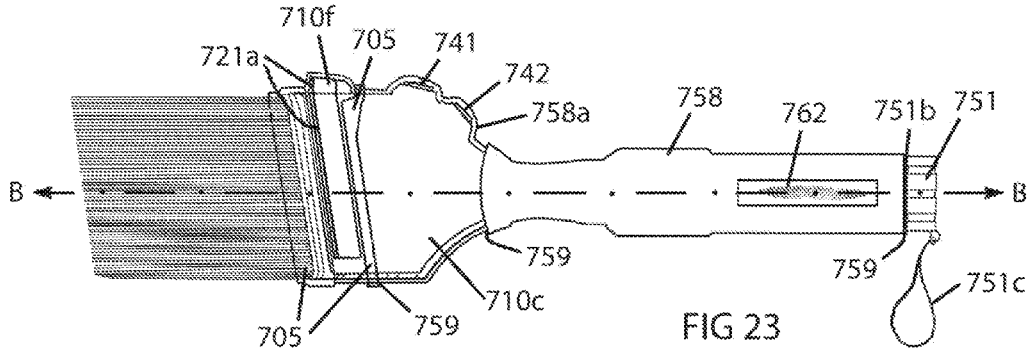
FIG. 23 shows the illumination means shown in FIG. 20 with two protective coverings and the bristle base protector installed, and indicia gripping stamped and visible on the handle.
Figure 24:
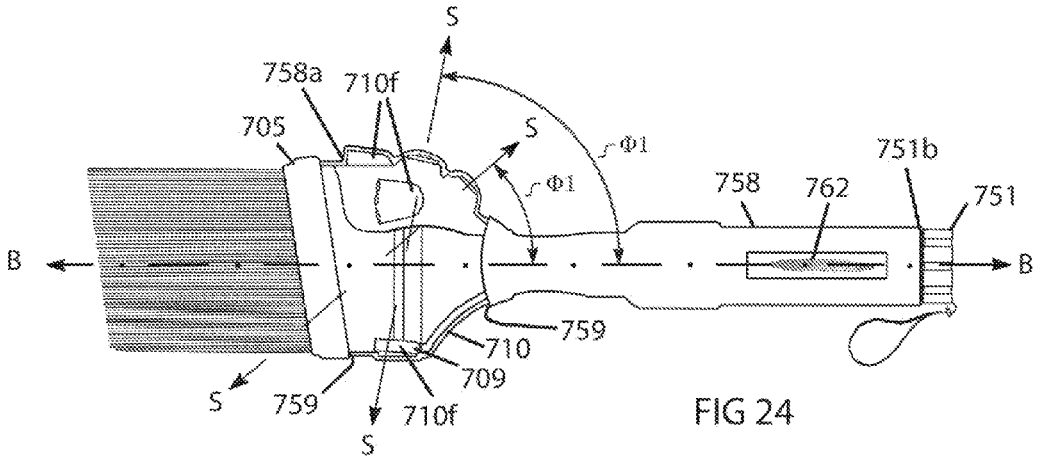
FIG. 24 shows the illumination means of the brush of FIG. 21, shown with two protective coverings and a bristle base protector installed, and the angle of the primary and secondary switch.
Figure 25:
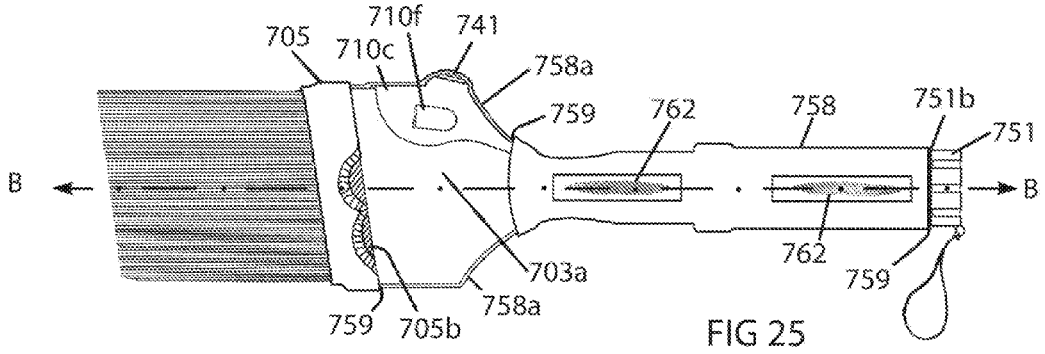
FIG. 25 shows the lighted paintbrush apparatus of FIG. 9 with indicia grips shown in two locations on the handle.

The lighted paintbrush illustrated in FIGS. 23, 24, and 25 shows the grip of the gripping end heat stamped into the heat shrinkable plastic tubing enveloping the handle and used as a gripping means. This heat stamping may be done in the form of a company name or logo.

An alternate type of handle gripping is illustrated in FIGS. 32A-32E, and FIGS. 33A-33E, showing the battery housing connector integrally moulded with the outer shell and outer shell extension, with the battery housing having a hollowed area 782 (battery housing connector) which receives the end of the paintbrush handle's gripping end. The handle has gripping molded into the handle portion (which may be in the form of indicia 789). The lighting accessory is configured to be removably secured to the end of the brush handle, and includes at least one outwardly projecting light housing from the outer shell, configured to surround at least one portion of the paintbrush handle. The surface within the light housing and outer shell, positioned next to the surface of the gripping end, create a relief area 710*h* located within the light housing, and between the outer shell and the gripping end of the brush. The bases of the switches are angled back away from the bristles, and the switch assembly is mounted at an oblique angle in relation to Axis B (side view).

The material from which one or more battery housing connectors are constructed takes into account the shape and size of the handle upon which it's being mounted and how it's to be mounted on the brush. It may be configured of resilient material suitable to be force-fitted over the end of a considerable portion of a brush handle as seen in FIGS. 5A-5E and FIGS. 6A-6D, with a form-fitted configuration matching a portion of the brush handle upon which it is installed, and preferably has one or more relief areas for the wires. The relief areas within its configuration allow the wires or conductive leads to be protected within, and allow the wires to pass through the relief areas within the battery housing connector as the wires electrically connect the one or more lights and switch(s) near the ferrule on the gripping end of the brush to the battery housing and/or power source preferably mounted at the other distal end of the handle. Some examples of conductive leads passing through relief areas in the battery housing connector are shown in FIGS. 6A-6D, 7A-7C, 19, 31A, 37A-37E, 44A-44E, 45, 65A-65D, 78A-78K, and 93.

A battery housing connector may also consist of two or more sections that are sized and configured to engage each other or a common coupler to form two or more storage compartments. The first section may be configured to engage a paintbrush handle (which may be modified or cut off), as well as configured to engage a second section, forming a storage compartment spaced between the first and second sections. This storage compartment may be used to store a first or second power source, or a circuit board and/or resistor, or one or more other first or second power source or switch components. The second section may also be configured to receive a battery housing, as shown assembled in stages in FIGS. 15, 20, and 23 as components are installed on a brush.

FIGS. 44A-44E and FIG. 45 show examples of two-part battery housing connectors with the outer shell extension portion relatively thin, and flexible enough to be installed on similar widths of brushes (similar to the different brush widths shown in FIGS. 38A-38F), whereby the battery housing connector is also an integrally formed outer shell and outer shell extension, and the mounting base of the shell extension is formed with the battery housing connector also having a hollowed area 782 which receives at least a portion of the gripping end of a paintbrush.

Figure 17:
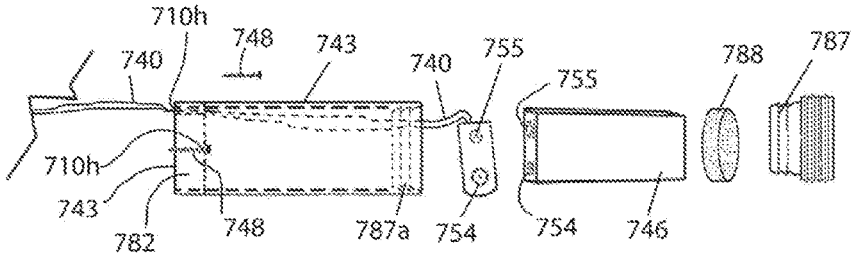
FIG. 17 shows a side view of an alternate power source means attachable to the end of a paintbrush handle.
Figure 18:
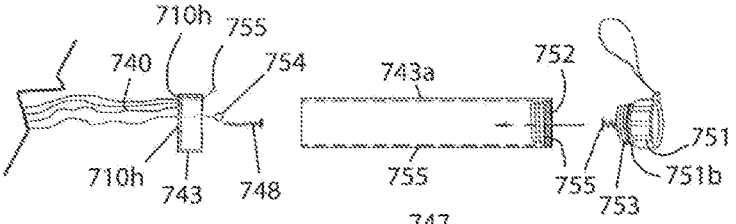
FIG. 18 shows a side view of an alternate power source means attachable to the end of a paintbrush handle, whereby the fastener that holds the battery housing connector is conductive and is connected to the positive leads leading to the switch and lights.
Figure 19:
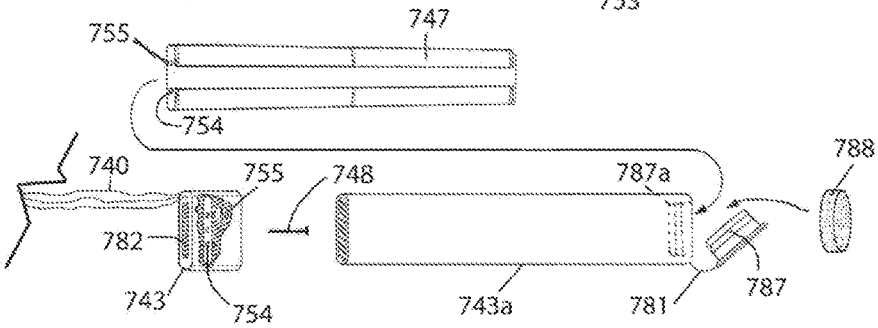
FIG. 19 shows a perspective view of an alternate power source housing and a battery housing connector attachable to the end of a paintbrush, whereby both the positive and negative connections are held within the battery housing connector, one directly mounted beside one other.
Figure 20:
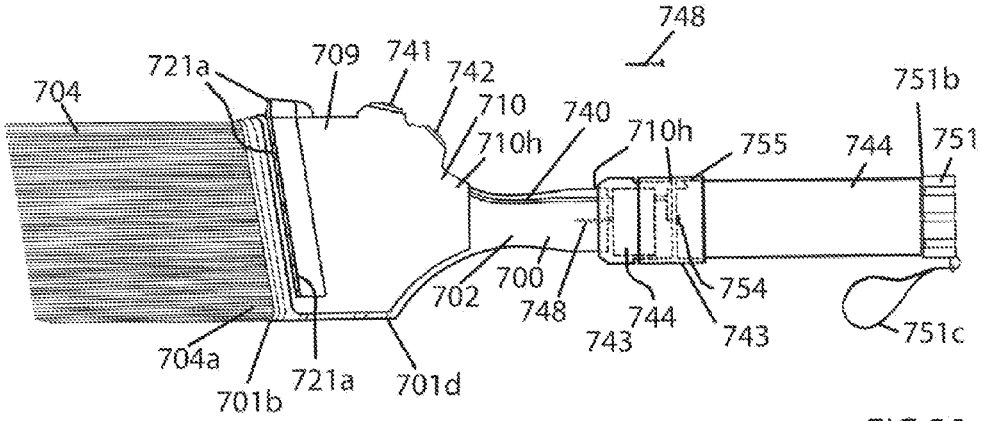
FIG. 20 shows the illumination means of FIG. 15 attached to the end of a brush handle that has been modified.

FIG. 17 shows a power source that may be connected to an outer shell comprising lights and one or more switches by a fastener 748 (which may be non-conductive). The conductive connections 754, 755 to the battery terminals are not hard-fixed to the battery housing connector, but are attached to the battery and secured in the battery housing (along with a battery) by a compressible material 788 such as foam, secured in place by a friction-fit end cap 787, which is mated with inside ridges 787*a* within the battery housing. The battery housing and the battery housing connector are moulded as one. The wires enter the battery housing connector through relief areas 710*h*. The fastener may be inserted into the battery housing, and a portion going through a relief area, and inserted into a pilot hole of a brush handle.

Heat shrinkable plastic can also act as an attachment means for a battery housing connector. For embodiments where heat-shrinkable plastic is the protective covering, adhesive may be the primary attachment means or a secondary attachment means.

Installing a heat shrinkable plastic protective covering over wires positioned on a handle, forms relief areas 710*h* between the plastic and the handle, and protects the wires 740 within, as shown in examples such as FIGS. 9A-9E, 37A-37E, and 38A-38F.

FIGS. 32A-32E and FIGS. 65A-65D show one or more relief areas 710*h*, 810*h* within the integrally formed battery housing, some of which extend parallel through the housing to the distal end of the embodiment, allowing the conductive leads 740, 840 or conductive components to be held within the structural body of the battery housing, as an alternate form of electrically linking the negative terminal of a power source without using a conductive battery housing. In an alternate embodiment (not shown), a battery housing connector may be configured whereby one or more conductive leads may enter through the battery housing connector (which may be electrically linked to a positive terminal), while one or more conductive leads (such as a negative lead) may be positioned between the outside surface of a battery housing connector and non-conductive battery housing, and the one or more protective coverings, and electrically linked to the power source negative terminal. An alternate form electrically links the power source by using at least a partly conductive battery housing 743*a* inserted into an integrally formed outer shell extension and battery housing connector, as shown in FIGS. 33A-33E. A conductive component, such as a conductive member, may also be integrally formed within the mould, as shown in FIGS. 32A-32E, whereby the conductive member may be a negative conductive lead 740, and is employed as a negative contact 755 and moulded within the battery housing portion.

Some examples of the types of lighting accessories and lighted paintbrush apparatuses which may be found within the embodiments of the illustrations within this application are shown on brushes with angled brush ferrules in FIGS. 1A-1E, 3A-3E, 5A-5E, 6A-6D, 7A-7C, 8A-8C, 9A-9E, 14A-14E, 23, 24, 25, 26J, 27B, 31C, 32A-32E, 33A-33E, 34A, 34B, and 35. Illustrations referring to rectangular-shaped brush ferrules are shown in FIGS. 36B, 36C, 37A-37E, 38A-38F, 44A-44E, 45, 53A-53E, 65A-65D, 66A-66D, 67A-67C, 69, 70, 73, and 74, and shown on round brushes in FIGS. 78A-78K, 79F, 79G, and 96.

These illustrations include removable and fixed embodiments, whereby the illumination means is configured to be secured or permanently fixed to the brush. The apparatuses comprises a first light source for generating a first beam of light, the first light source mounted to the gripping end in position to project the first beam of light in a forward direction.

Certain embodiments, such as is shown in FIGS. 78A-78K, may only have one light source. Other embodiments have a second light source for generating a second beam of light. The second light source is mounted to the gripping end in a fixed position to project the second beam of light at an oblique angle to the forward direction in an upward or downward and/or inward or outward direction relative to the forward direction of the first light.

Figure 21:
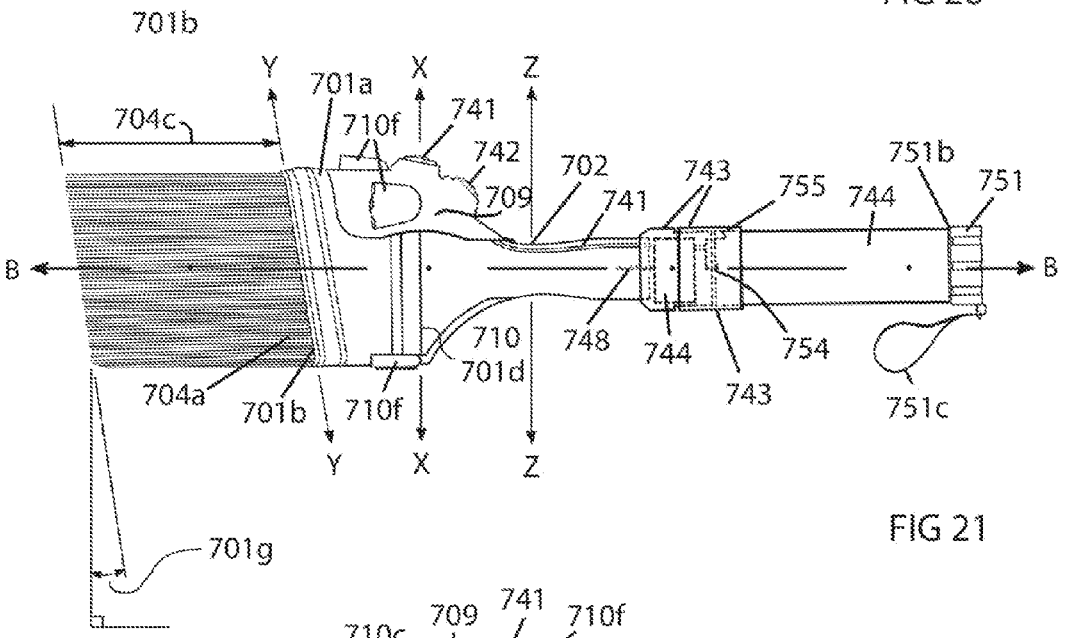
FIG. 21 shows the specific detail of the preferred mounting location of an illumination means mounted on a brush with an angled ferrule, showing at least one switch and one light positioned between the front of the ferrule and the narrowest part of the handle from a side view of the brush, and a preferred mounting location of at least one power source located behind the back of the ferrule.
Figure 22:
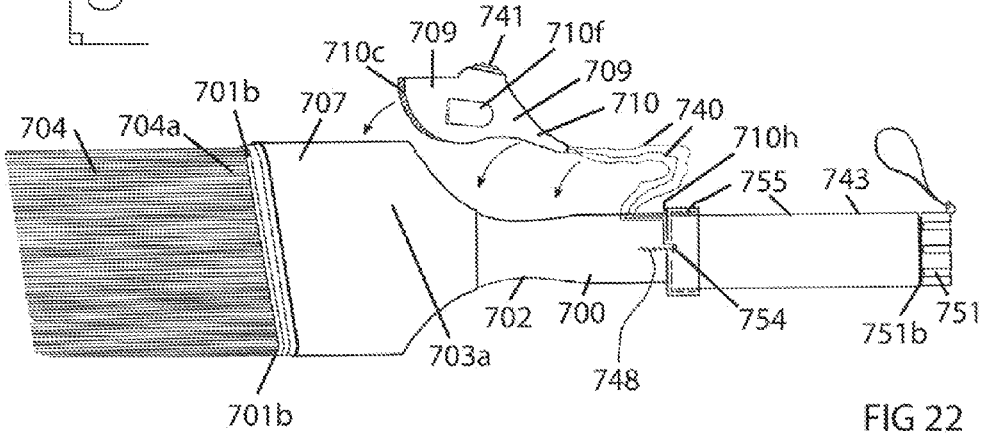
FIG. 22 shows the illumination means of FIG. 9 with the power source housing connector fastened to the end of a modified brush handle, heat-shrinkable ferrule covering fixed in place over the ferrule, and the light housing and conductive leads prior to attachment.
Figures 67A, 67B, 67C, 68:
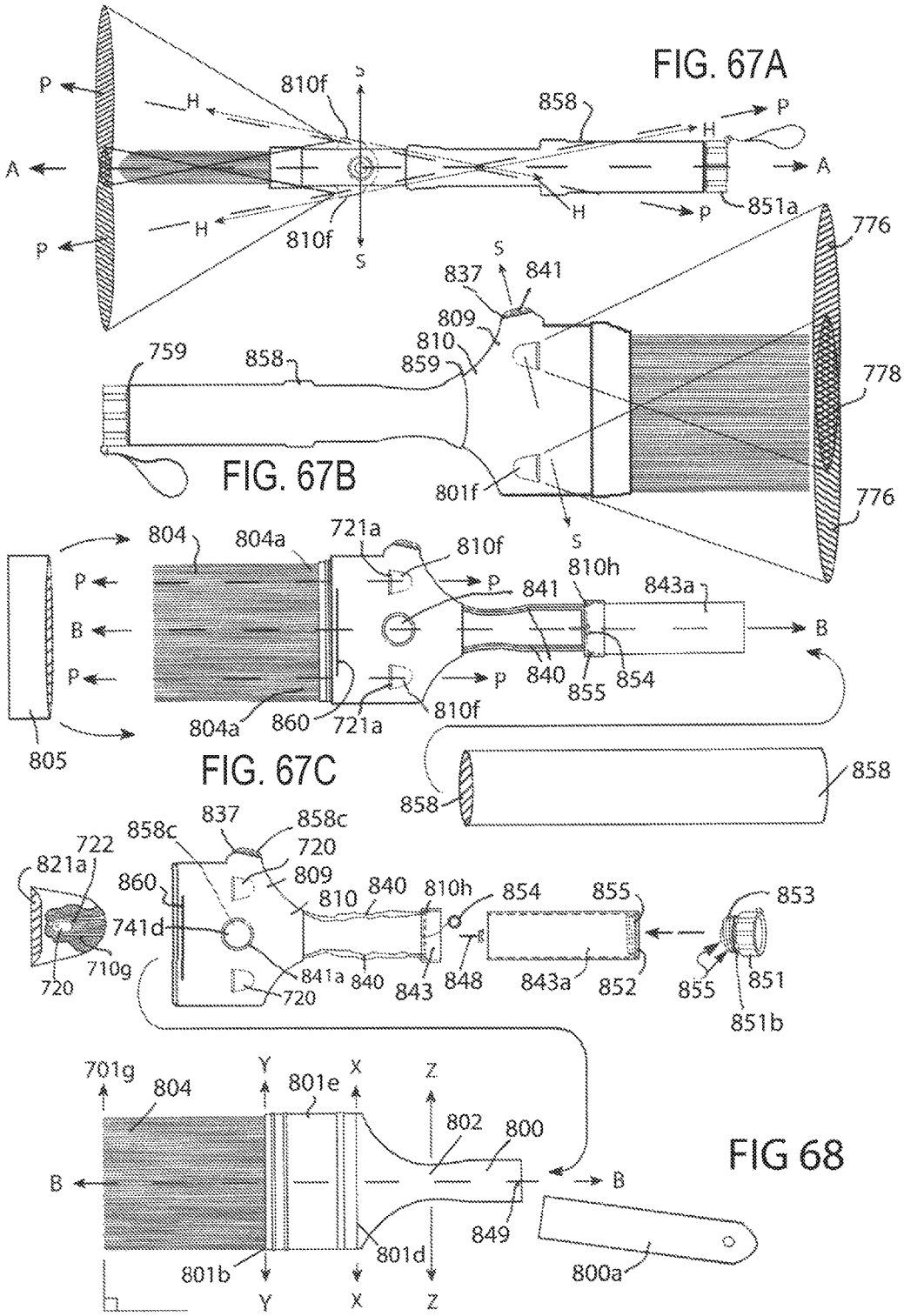
FIGS. 67A-67C illustrate a top and side view of overlapping light cones of an embodiment on a rectangular brush, and the installation of protective coverings.
FIG. 68 shows a side view of the assembly of an apparatus, and handle modification.
Figure 70:
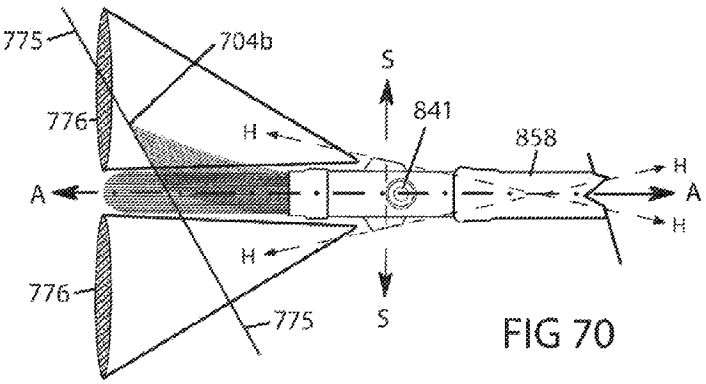
FIG. 70 shows a top view of a lighted paintbrush in a relaxed state and a painting state with bristles bent to the right of the brush, contacting a surface being painted, and the light cones produced and overlapping.
Figure 71:
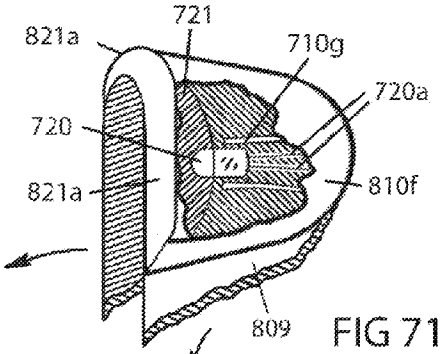
FIG. 71 shows a cross-section of the light housing of FIG. 69, enlarged.
Figure 74:
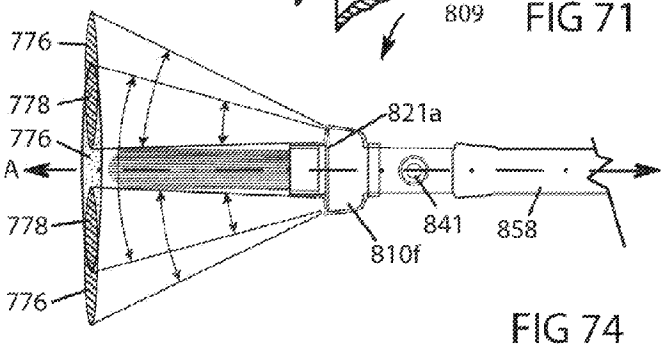
FIG. 74 shows a top view of the brush of FIG. 73, but with bristles relaxed, and the light cones produced and overlapping.
Figure 69:
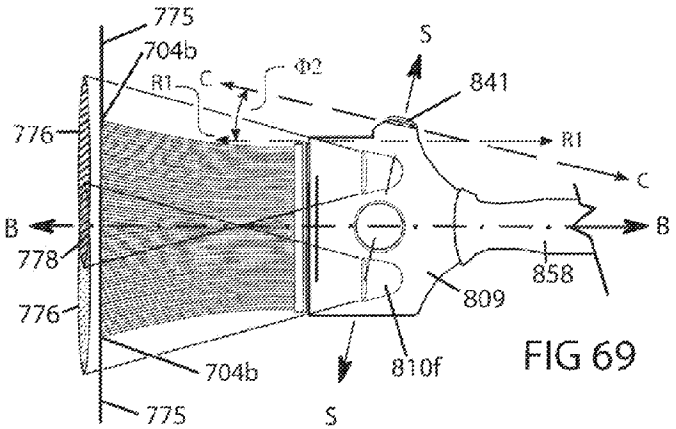
FIG. 69 shows a side view of lighting apparatus with bristles bent in the painting process.
Figure 72:
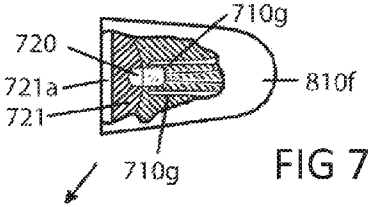
FIG. 72 shows a cross-section of the light housing of FIG. 73, enlarged.
Figure 73:
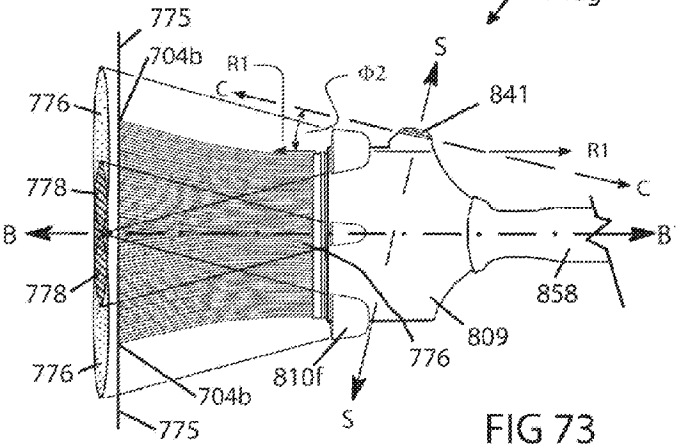
FIG. 73 shows a side view of an embodiment with the bristles in painting action, with housings that "wrap" around the ferrule at the top and bottom, and the light cones produced and overlapping.

The lighting accessories have at least one light source, and at least one switch controlling one or more light sources, preferably located between the front of the ferrule Axis Y and the narrowest part of the paintbrush handle Axis Z relative to a side view, and shown in FIGS. 21, 68, and 79A, when the lighting accessory is installed on the gripping end of the paintbrush. It is most preferable to have the front end of a light holder positioned between the front of the ferrule Axis Y and the back of the ferrule Axis X. At least one switch location is selected in relation to how a particular brush is normally held for its intended use and direction of brushing.

For example, a preferred switch location for at least one switch on an angled ferruled brush may be relatively centered to Axis A (top view, as shown in FIGS. 9A-9E) of the paintbrush, and conveniently positioned between Axis Y and Axis Z, as shown in FIG. 21. It is easily activated by the pointer finger of a left or right handed painter, and shown in FIGS. 1A-1E, 3A-3E, 6A-6D, 9A-9E, 24, 26G, and 27B. A preferred switch location for a brush with a rectangular ferrule, having lights on one side only (of the wide part of the gripping end near ferrule area), may be positioned relatively centered near Axis B (side view), and conveniently positioned to be activated by the thumb of a left or right handed painter, as shown in FIGS. 37A-37E, 38A-38F, 44A-44E, and 45. Two switches may be employed together, with one switch being an on-off switch, activated by the pointer finger and relatively centered to Axis A. The second switch may be positioned on the side of the handle, relatively centered to Axis B, and may be employed as a mode switch, which may select one or more lights or groups of lights, which may be mounted on any side of the brush handle, with one example shown in FIG. 68. A similar switching means may be employed in the brushes of 26A, 26J, 27A, and 27B, whereby both are centered in Axis A. The diameter of the curb/switch actuator would be enlarged, to accommodate the thumb.

The cone of light from the first light source preferably (and at least partially) overlaps the light cone of the second light source, and the first LED illumination means produces and projects a wider cone of light 776, with an approximately 20 to 40 degree cone. The narrower cone of light 777 projected from the second LED has an approximately 15 to 20 degree cone. FIGS. 10E-10G, 11E-11G, 28A-28B, 29A-29B, 30A-30B, 34A-34B, 36B-36C, 67A-67C, 79B-79C, and 81A-81H illustrate embodiments showing that the first LED produces and projects a wider cone of light of approximately a 40 degree cone, and the narrower cone of light projected from the second LED is approximately a 20 degree cone, and shows an examples of the overlapping light cones 778. For added clarity, some of the light cones illustrated in the figures of this application are drawn shorter than others, rather than attempting to show the complete overlapping of all cones.

In some embodiments, the lighting accessories are removably attached to the ferrule's outer surface, encompassing the end of the brush handle, or the handle adjacent to the ferrule, or the transitional portion of the gripping end or a combination of these. Examples of removable lighting accessories are shown in FIGS. 5A-5E, 7A-7C, 8A-8C, 31C 32A-32E, 33Aa-33E, 53A-53E, and 65A-65D.

A preferred light source for a light accessory for a paintbrush is one or more LEDs; a first light source may be an LED projecting a wide cone of light, and the second light source may be an LED projecting a narrower cone of light than the wide cone of light projected from the first LED. The first light source and second light source may be mounted adjacent to the ferrule. The first light source has a cone of light to illuminate the more general work area around the bristles of a paintbrush, and the second light source has a cone of light to provide illumination toward the edge of the bristles when the bristles are bent when an object is painted.

This disclosure refers to an illumination means for a paintbrush; the angling of one or more lights of the illumination means takes into consideration structural and non-structural aspects, which together determine the type of light, and the configuration of the one or more lights, and the angle the light(s) are pointed in relation to Axis A and/or Axis B, to achieve a superior paint job.

Structural aspects may include a) the configuration of the gripping end of the brush (including various configurations of angled brushes, rectangular brushes and round brushes, as previously described), and b) the various bristle configurations of specific brushes, which have been developed to simplify a specific painting task, and includes characteristics such as the bristle material, bristle length, and the stiffness of the bristles.

Non-structural aspects include common brushing techniques, such as bristle manipulating techniques (related to a specific bristle configuration), including a combined optimal pressure being applied to the bristles, and the manipulation of the bristles (while performing a painting task), which together form the edge of the compressed bristles, and determines the location of where the one or more lights are pointed (in relation to the centerline of the gripping end of a brush Axis A and/or Axis B and in relation to the surface area being painted), and determines where the compressed edge of the bristles are located (during a painting task) in relation to the brush handle Axis A or Axis B.

By knowing and understanding the bristle manipulating techniques used by a painter while painting with a certain type of brush (having a particular handle and bristle configuration), and by determining an optimal pressure to be applied to the bristles in relation to an optimal angle formed between the brush handle Axes A and B and the surface being painted (while performing a painting task intended for that particular brush), it is possible to mount at least one LED to a brush (secured in position relative to the brush handle Axis A and/or B), pointed at an angle such as where the compressed edge of the bristles are located relative to the brush handle Axis A and/or B (while stroking the brush) during a particular painting task. It should also be known that by securing such an illumination means to a brush and angling one or more LEDs toward a specific location (such as the edge of the compressed bristles as shown in FIG. 10A, 11A and FIG. 11G), the illumination means may guide a user to hold the brush (handle Axis A or Axis B) at one or more optimal angles (in relation to the surface being painted) to achieve a superior painting job. The angle created between the handle centerline Axis A and/or Axis B, and the surface being painted 775, is referred to as the angle λ Lambda. It is the pressure that is applied to the bristles while painting, and holding a brush at an angle λ Lambda, that determines the location of the edge of the bristles against the surface being painted. This manipulating of the compressed bristles, due to angling of the brush's centerline of the gripping end Axis A or Axis B in relation to the painting surface 775, must be taken into account when choosing the optimal angle the lights may be preferred to be pointed in relation to the Axis A and Axis B.

Examples of this angling of the brush Axis A in relation to the surface area 775 is illustrated in FIG. 10A and FIG. 11A (referring to an angle-ferruled brush), and FIG. 39, 48, 54 and FIG. 60 (referring to a rectangular-ferruled brush) where the brush is shown painting around a moulding 790 (being stroked in a direction away from the viewer). In all of these illustrations, at least one first light source (preferably a wide angle light source) is angled at the general work area and at least one second light source (which is preferably a narrow angle light source) is pointed directly at the edge of the compressed bristles, and the first light source and second light source are secured at an angle relative to the handle Axis A, from a top view. As mentioned, in these illustrations, the angle created between the handle centerline Axis A and the surface being painted 775 is referred to as λ Lambda.

Other examples of the angle λ Lambda and why the angling of the brush handle Axis B in relation the surface area 775 must be taken into account when choosing the optimal angle the lights may be preferred to be angled are illustrated in FIG. 10B, 10F and FIG. 11B. In these illustrations the brush is being stroked in a direction (towards the bottom of the page) while cutting in to a moulding, and at least one light source is pointed directly at the edge of the bristles 704*b*. The preferred structural angling of the one or more lights in relation to Axis B takes into account the angle λ Lambda, which is not a structural angle, but an angle naturally created between the handle Axis B (in these illustrations) and the surface being painted 775 by applying even pressure to all the bristles while painting with a brush having an angled ferrule. The front angled configuration of the bristles 701*g* shown in FIG. 21 is very similar on angled brushes of many different manufacturers. For example, the angle of the front of the ferrule of an angle-ferruled brush may vary from approximately 8 to 15 degrees, but is most commonly between 13 and 15 degrees off perpendicular, on angled brushes of many different manufacturers. The end of the bristle configuration typically follows the same ferrule angle (13 to 15 degrees), as shown in FIG. 21. This chosen angle of the configuration of the bristles (chosen by the brush manufacturer) guides the user to an optimal angle to stroke the bristles along the surface being painted 775 (when a preferred, relatively even pressure is applied to the bristles while painting), and also determines the optimal angle the brush handle Axis B is preferably held in relation to the surface being painted. By applying even pressure to the bristles while painting, the brush configuration, with bristles angled as shown in FIG. 21, guides the painter to hold the brush at an optimal angle λ Lambda while painting, best illustrated in FIG. 10F.

To more easily understand the significance of a preferred optimal pressure being applied to the bristles, it is known that an extreme case of applying too much pressure to the bristles, or an extreme case of applying uneven pressure to all of the bristles, the brush won't perform as well as possible (and it's not good for the brush), and it's virtually impossible to paint a straight line. On the other hand, not enough pressure applied to the bristles will prevent a brush from working at its peak performance. The angles the lights are pointed on an angle-ferruled paintbrush are selected with this approximate 13 to 15 degree angle of the bristles in mind and the lights may also be used as a second guiding means (along with the angle of the bristles on an angled ferruled brush or on brushes with other bristle configurations), to guide the painter to a preferred, even pressure on the bristles, and the correct angle λ Lambda, for optimal performance of the brush while painting. For example, if uneven pressure is applied to the bristles by painting at an incorrect angle to the painting surface 775, the lights won't line up with the edge of the bristles as they will when the correct pressure and angle are applied. The correct pressure on the bristles may also extend the life of the brush.

The lights are also angled with various brushing tasks contemplated, such as is illustrated in FIG. 10G where a brush with an angled ferrule is shown with the handle Axis A being angled towards a surface being painted and the brush is shown being stroked towards the bottom of the page, employing the widest portion of the bristle configuration. The illustrations of FIG. 40, 49, 56, 62, 69 and FIG. 73 show a rectangular-ferruled brush being stroked in a direction away from the viewer, and employing the widest portion of the bristle configuration, and at least one light source is pointed directly at the edge of the bristles 804*b*, and at least one other light source is pointed at the general work area. In another painting technique, FIG. 39, 48, 54 and FIG. 60 show a rectangular brush being stroked along a surface being painted away from the viewer and cutting in to a moulding 790 and at least one light is angled at the edge of the compressed bristles 804*b*, while one or more lights illuminate the general area around the bristles. Shown in FIG. 40, 49, 56 and FIG. 62, as well as FIG. 54, 39, 48, 54 and FIG. 60, one or more lights are angled towards the edge of the bristles 704*b*, while another light source is angled to illuminate the general work area around the bristles. FIG. 10G shows a light source pointed at the edge of the bristles 704*b*, producing a cone of light 777, while another light source produces a light cone 776 which illuminates the moulding 790 and the general work area around the bristles, whereby the two cones at least partly overlap 778.

Also, a typical cutting-in technique of angling of the brush handle away from a moulding is shown in FIG. 10A, 11A, (showing angled brushes) and FIG. 39, 48, 54, and FIG. 60 (showing rectangular brushes) cutting in to a moulding. This technique of angling the brush away from an object such as a moulding or a ceiling is used when using any brush style (having any bristle configuration) in an attempt to see the edge of the moulding and the surface to be painted adequately, as well as to bend and compress the bristles to a fine edge as a means of trying to achieve painting a straight line. This results in the brush handle Axis A (from a top view) shown in FIG. 10A, 11A, 55, and FIG. 60 being at an oblique angle to the surface being painted 775 when a relatively even pressure is applied to all bristles. This confirms a direct correlation of the angling of the lights in relation to the angling of the brush handle Axis A to the surface being painted, and is shown in FIG. 10A, 11A, 39 and FIG. 60 when painting close to a moulding 790, with the bristles in a compressed state.

The angling of one or more lights, in reference to an angled brush within this document, have been based on a bristle angle 701*g* of 13-15 degrees, shown in FIG. 21, whereby the bristle length 704*c* is approximately 3 inches, and whereby the distance of 704*c* shown in FIG. 10F after the bristles are compressed is approximately 2.5 inches, and the distance from the front of the light housing to the surface area is approximately 3.75 to 4 inches, depending on the pressure applied to the bristles.

When the lighting accessory is mounted on a brush, the first light source (wide light cone) is canted inward about 3 degrees, or outwardly at about 30 degrees from Axis A, and canted upwardly at about 0 to about 15 degrees or downwardly about 0 to about 15 degrees from Axis B. The second light source is canted outwardly about 5 to about 15 degrees from axis A, and canted upwardly about 5 to about 15 degrees or downwardly about 5 to about 15 degrees from Axis B.

Figure 4A:
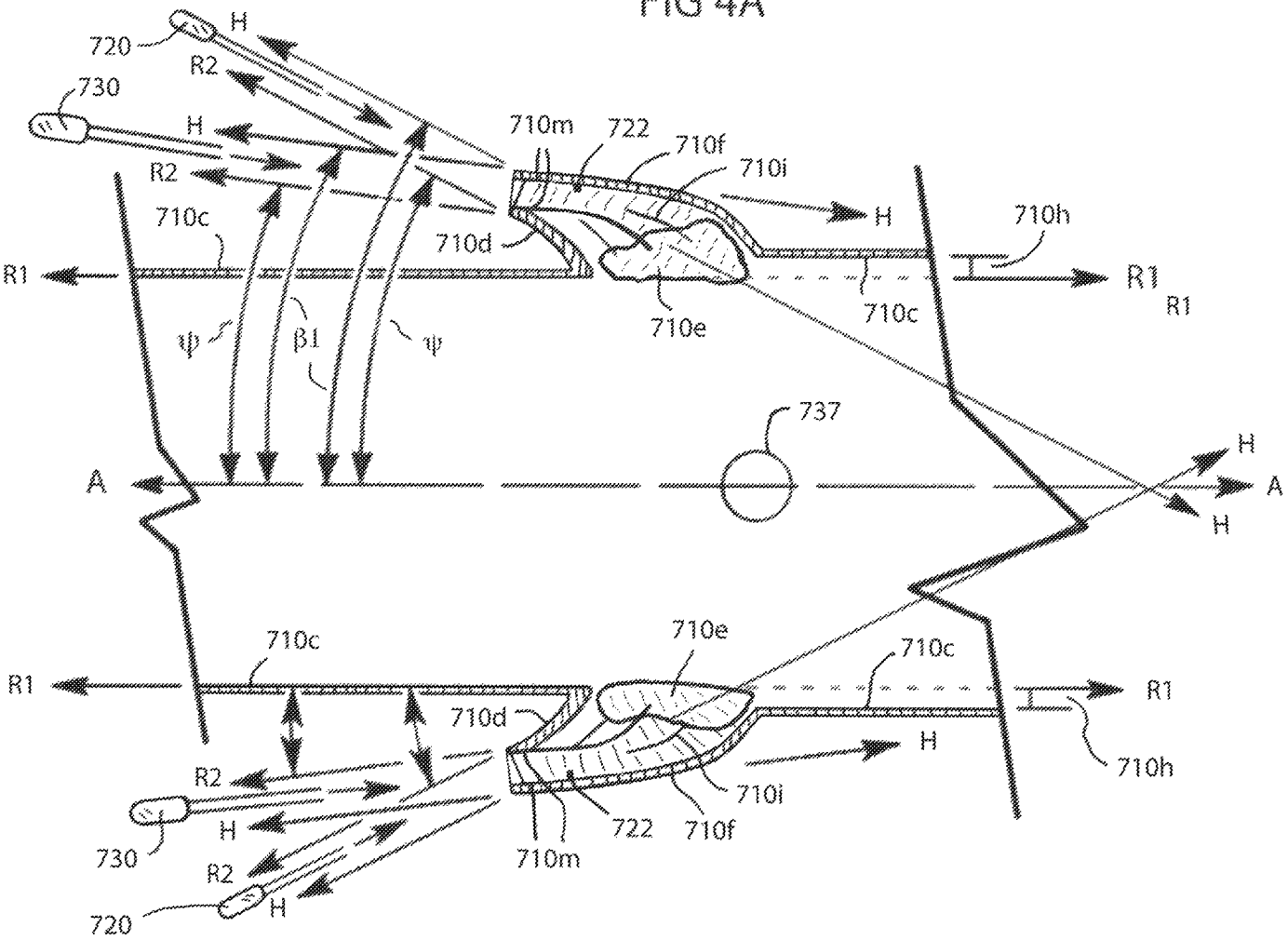
FIG. 4A illustrates a cross-sectional top view through the second light source holders of FIGS. 3A-3E, comprising two light housings ready to accept the first and second light sources into the first and second light holders and showing an activation switch porthole, prior to mounting on the brush.
Figure 4B:
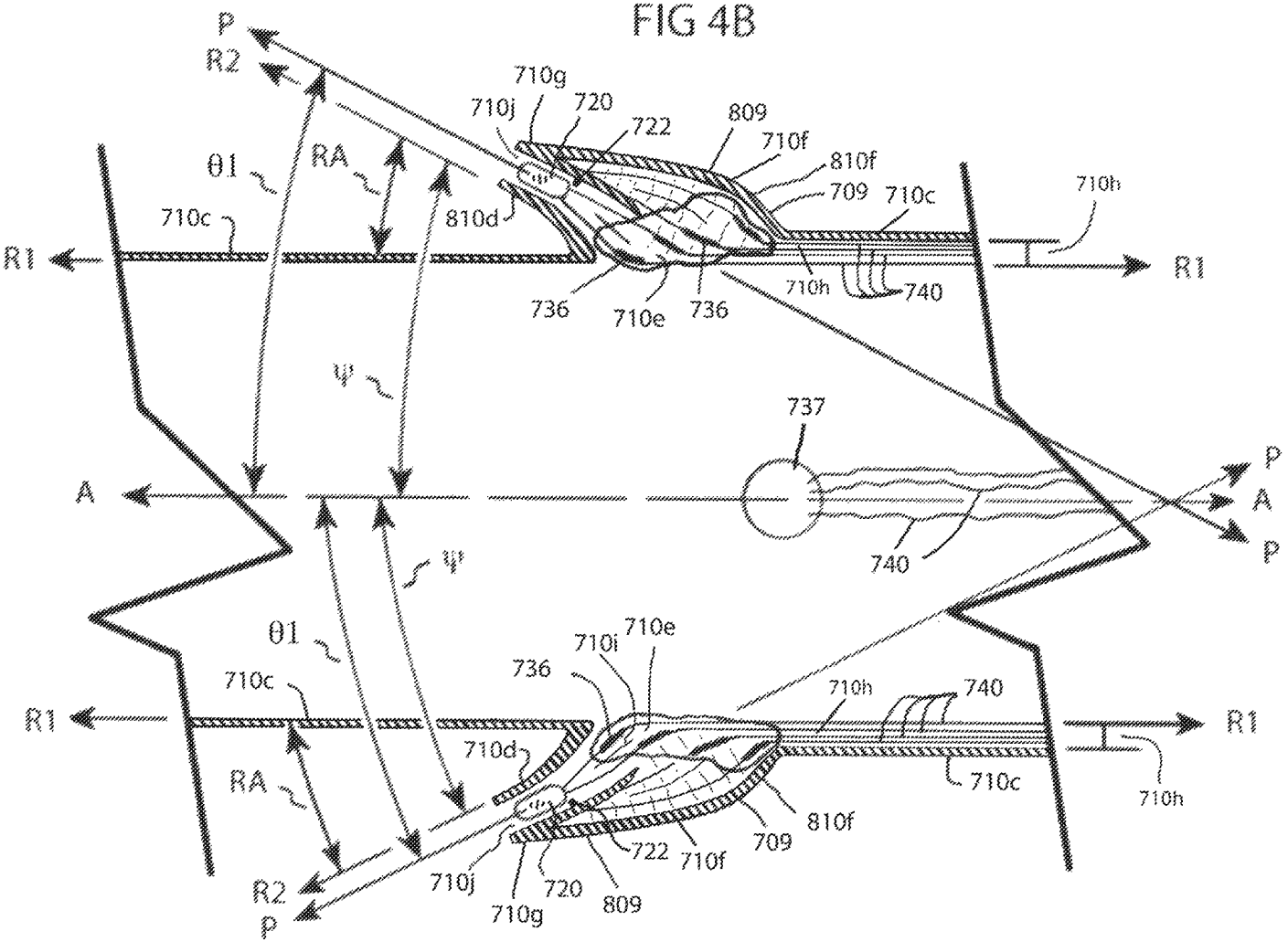
FIG. 4B shows a cross-sectional bottom view of FIG. 4A, showing conductive leads passing through an activation switch porthole through the first light source holders of the light housings.
Figure 4C:
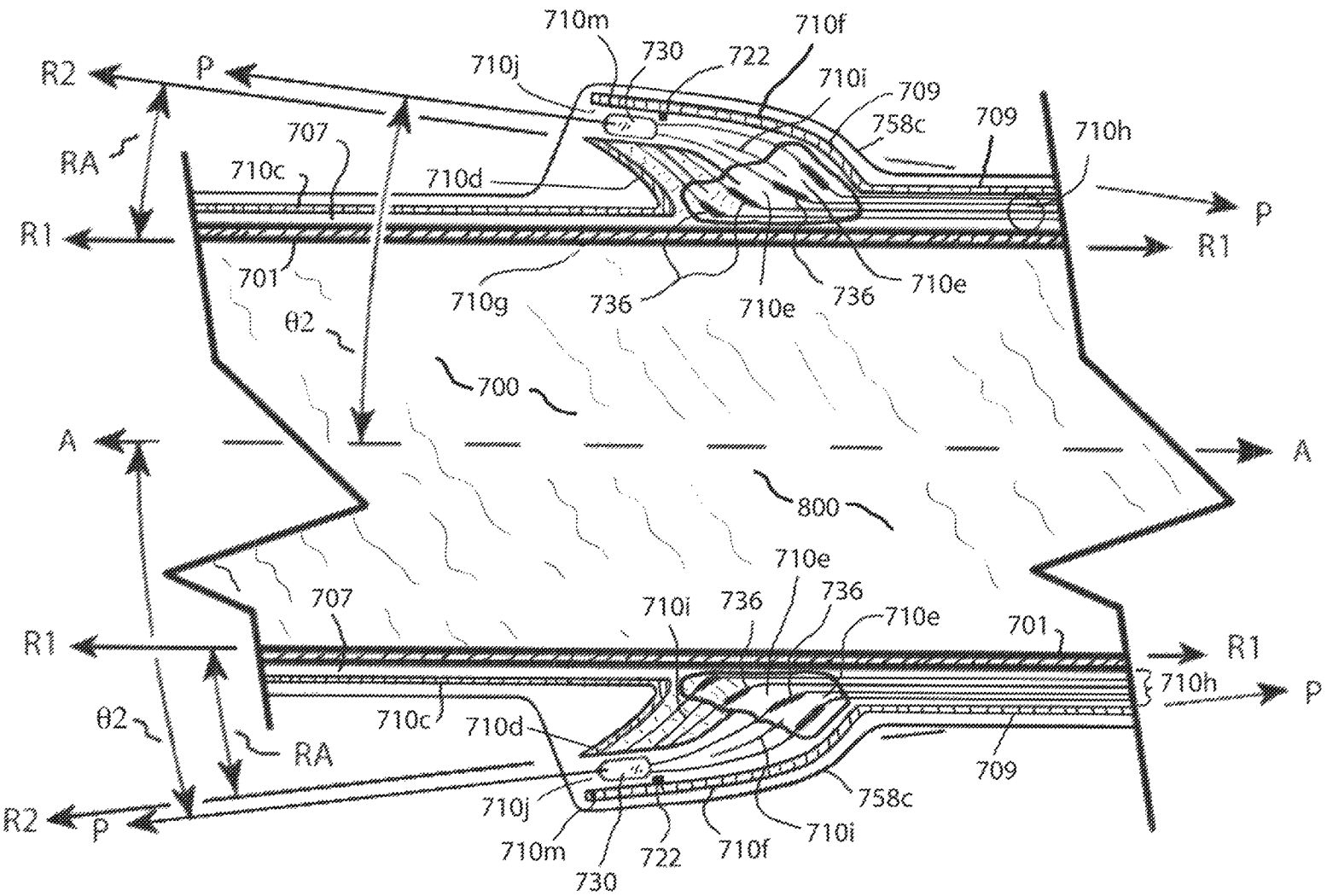
FIG. 4C shows a cross-sectional bottom plan view of the light housings of FIG. 4A and FIG. 4B, with an expanded partial view through the second light source holders, and the protective covering shown installed over the light housings.
Figure 4D:
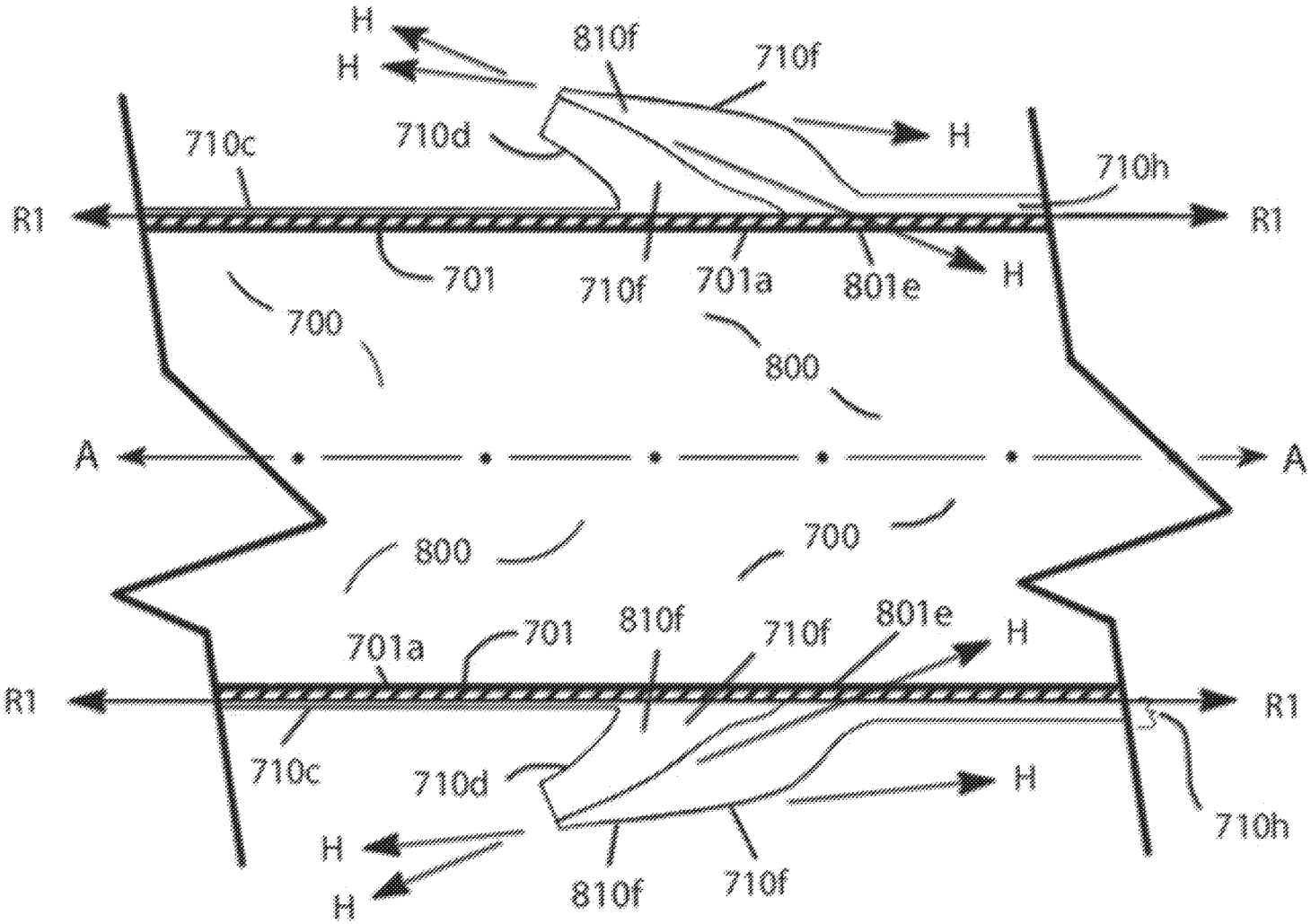
FIG. 4D shows a bottom plan view of the outer shell and the streamlined, contoured light housing portions of the outer shell of FIGS. 3A-3E, FIG. 4A, FIG. 4B and FIG. 4C, with protective covering not yet installed over the light housings or ferrule.
Figures 5A, 5B, 5C, 5D, 5E:
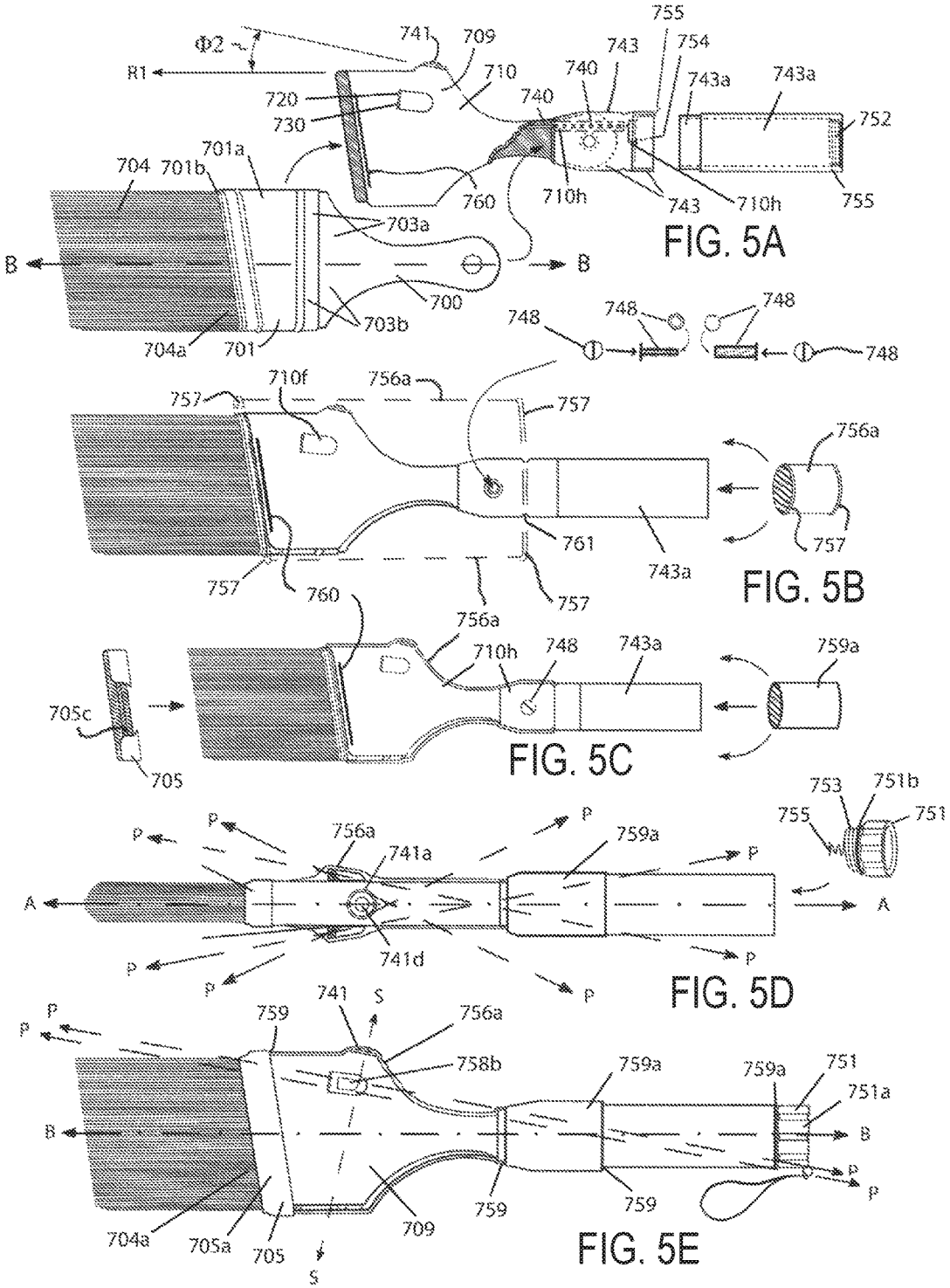
FIGS. 5A-5E illustrate an example of a group of accessories to be removably attached to a paintbrush, the assembly of one embodiment of the lighted paintbrush, and the angling of the lights and switch from the top and side view.
Figure 6A:
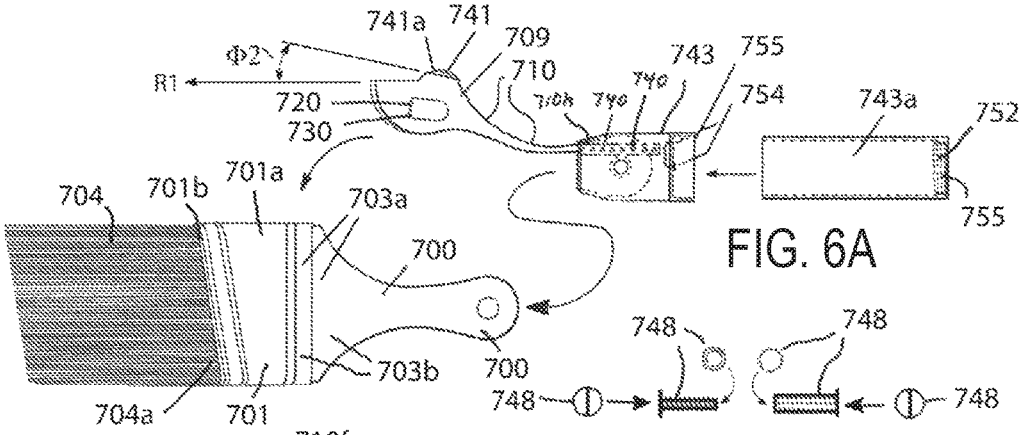
FIGS. 6A-6D show an alternate group of accessories to be fixed to the brush handle configuration of FIGS. 5A-5E, and the angling of the lights and switch from the top and side view.
Figure 6B:
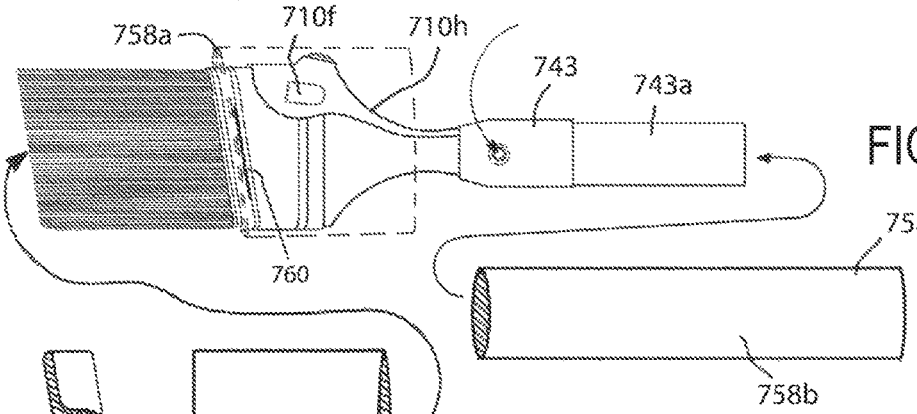
Figure 6C:
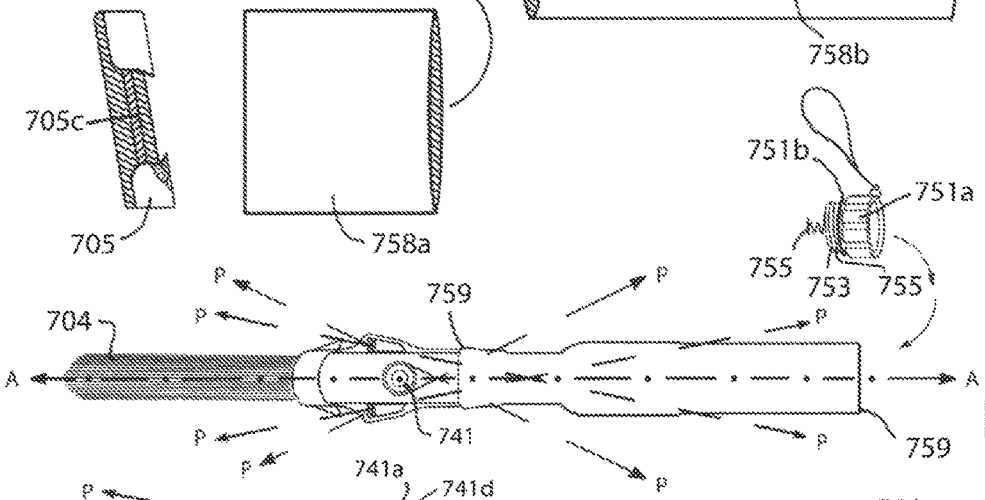
Figure 6D:
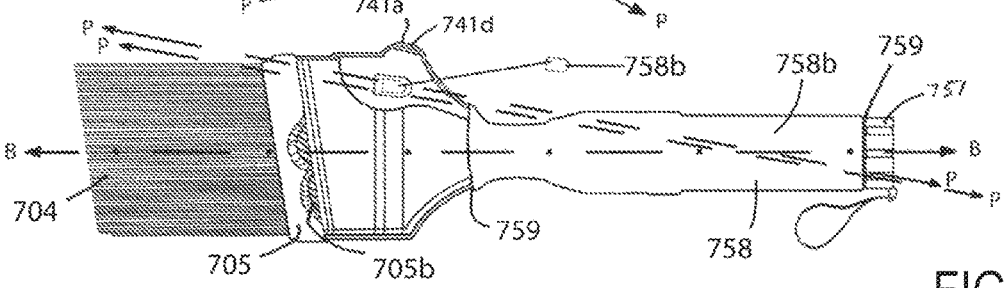

A lighting accessory may further include an outer shell, formed of resilient material and attached to the ferrule or handle (or both) of a paintbrush by a first ferrule covering, such as adhesive. The outer shell includes a mounting base, with a lower surface adapted to receive at least one portion of the ferrule or handle or both, and comprising at least one light holder, which is configured to receive a second light source therein, extending from the lower surface of the mounting base, with the mounting base secured to at least one part of the gripping end of the brush so that the outer shell fixes the second light source within the light holder in the forward direction at an oblique angle. This information is shown in an enlarged view of two light housings illustrated in FIG. 2A-2K, referring to two separately mounted outer shells as shown in the assembly of a lighted paintbrush apparatus of FIGS. 1A-1E. The illustrations of FIG. 4A-4C show an enlarged view of two housings fixed to a common outer shell, configured to be engaged to a shoulder of a brush, and the positioning of one light housing on each side of the brush, each light housing comprising two light holders within, and one first light source and one second light source, as seen illustrated in FIGS. 5A-5E, 6A-6D, 7A-7C, 8A-8C, 9A-9E, 12, 14A-14E, 32A-32E, 34, 34A, and 34B.

FIGS. 3A-3E, 9A-9E, 14A-14E, 15, 16, 20, 21, 22, 37A-37E, 38A-38F, and 79B-79G show outer shells configured to be securable to the gripping end of a paintbrush and engage at least one portion of at least one shoulder of a paintbrush. The outer shell has an outer shell extension, which extends from the shoulder, covering at least one portion of the transitional narrowing part of the brush handle. The electrical connection to the light source from the power source and switch(es) is positioned along the handle and protected within at least one protective covering 756*a*, 758, 758*a*.

The outer shell and outer shell extension have relief areas 710*h*, and a cavity 710*e* which are spaced areas, or a void, between the mounting base and the outer shell (and outer shell extension), which allow for the connections 736 of the leads to the wires, preferably within the cavity, and the wires to be positioned within one or more relief areas as they connect the one or more lights and switches to at least one power source. In this application, the power source housing connector is primarily a battery housing connector, integrally formed to receive the gripping end of a paintbrush.

In some embodiments, the combination of an integrally formed outer shell, outer shell extension, and a battery housing connector is configured to receive the gripping end of a paintbrush, and configured to house the batteries, or receive a battery housing. FIGS. 5A-5E, 6A-6D, and 8A-8C are examples of illumination accessories that can be attached to a brush that has not been modified or cut off.

Examples of paintbrush handles which have been modified and configured to receive a battery housing connector whereby the handle has been cut-off or modified or both, are shown as follows: FIGS. 9A-9E, 14A-14E, 26A, 27A, 31A, 32A-32E, and 33A-33E show modified angled brushes, FIGS. 37A-37E, 38A-38F, 44A-44E, 45, 53A-53E, 65A-65D, 66A-66D, and 67A-67C show modified rectangular brushes, and FIGS. 78A-78K, 79A, 79B, and 92 show modified round brushes. In some cases, the brush handle may be cut, drilled, notched or modified to include a dado or groove as shown in FIG. 26A as a means of configuring a gripping end to accept one or more switches or lighting components, which may be components such as resistors or printed circuits, or conductive leads (such as wires), as an attempt to try to maintain the original brush size.

Figure 34B:
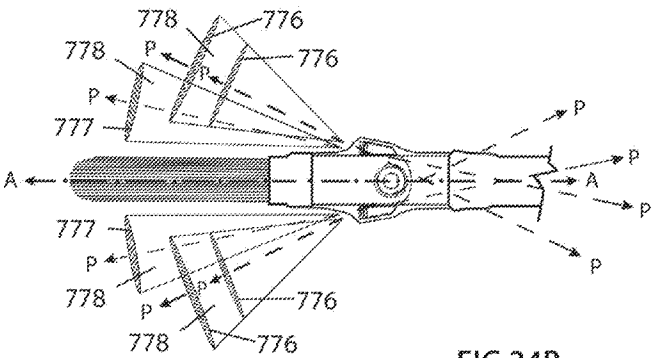
FIG. 34B shows a partial top view of the illumination means of FIG. 34A, with light emitted from an upper shell and a lower shell, and the lights pointed at an angle in relation to Axis A, showing the light cones produced from the lights, and their overlapping cones.
Figure 34A:
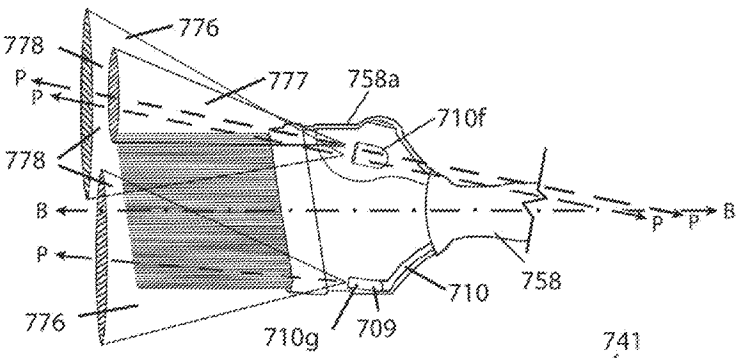
FIG. 34A shows a partial side view of an illumination means comprising two independently mounted outer shells on an angled brush, with one shell mounted on the top (with a switch and two housings) and one mounted on the bottom (comprising two light holders within housings) and LED's within them controlled by a switch assembly (within the shell) on the upper shoulder, as well as the angles the lights are pointed in relation to Axis B, showing the light cones produced from the lights, and their overlapping cones.
Figure 35:
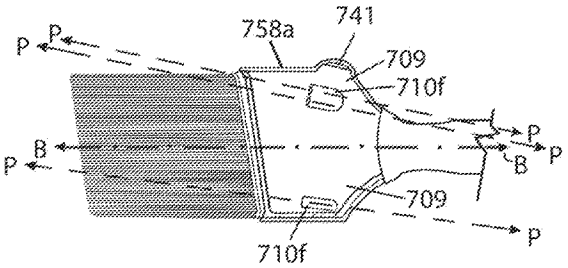
FIG. 35 shows a partial side view of an illumination means attached to a paintbrush with and protective coverings installed, and ready for a bristle base protector to be installed, the illumination means comprised of one common outer shell which substantially covers the upper shoulder and a partial lower shoulder of the brush, having a light housing mounted to each of the upper and lower shoulder areas.

A lighting accessory may be configured with light housings spaced and positioned on opposite sides of an outer shell, and when installed on the brush, are positioned on opposite sides relative to Axis A or B or both. The configurations relative to Axis A are shown in: FIGS. 3A-3E, 5A-5E, 6A-6D, 7A-7C, 9A-9E, 14A-14E, 28B, 29B, 30B, 32A-32E, 33A-33E, and 34B (on angled brushes), and FIGS. 36C, 60, 63, 66A-66D, 67A-67C, 70, and 74 (on rectangular brushes). The configurations relative to Axis B are shown in FIGS. 30A, 34A, and 35 (on angled brushes) and FIGS. 36B, 40, 43, 47, 49, 53A-53E, 56, 59, 62, 64, 65A-65D, 66A-66D, 67A-67C, 69, and 73 (on rectangular bushes). The configurations relative to both Axis A and Axis B are shown in FIGS. 30A and 30B, 34A and 34B, 36B and 36C, 60 and 62, 63 and 64, 66A-66D, 67A-67C, 69 and 70, 73 and 74.

It is preferred that the mounting base, a riser, and light holder within a light housing, together form the raised rigid portion of the outer shell where one or more LEDs are housed together to obtain a compact formation of the outer shell comprising one or more light housings. These one or more light housings are a raised, more rigid portion of the outer shell, extending from the more flexible mounting base adjacent to the housings.

It is also preferred that the thickness of the mounting base 710*c*, and the protective covering together, are approximately 10 times thinner than the combined total height of the integral light housing outer surface 710*f* and the mounting base of which the housing extends from, as illustrated in FIGS. 2A-2F and 4A-4D (not to scale).

FIGS. 2A to 2F, 2H, 2K, 4A, 4B, 4C, 13A, and 13B show the light source is held within the light holder, recessed from the frontal end of the light holder 710*g* 710*m*, creating a pocket; the light holder having a stop 722 to set the depth of the LED 720,730 during assembly and determining the size of the pocket 710*j*.

In these illustrations, the light source is an LED, and the leads 720*a* and the base of the LED extend into the light holder. The light holder has a flared end near the mounting base, which may have a divider 710*i* to separate the leads within the cavity, and the cavity 710*e* extends through the mounting base.

In certain embodiments, the outer shell may comprise at least one light housing, which has more than one light holder within the housing, and at least one additional light holder angled in the same general direction as the first light holder, parallel to the first light holder or pointed at an oblique angle from the first light holder upwardly, downwardly, inwardly or outwardly in a forward direction, and at an oblique angle in relation to Axis A and/or Axis B. Some examples of a light housing with two light holders within a single light housing are illustrated in FIGS. 81A-81H, 82, and 86, whereby the center of the light holders Axis P (on either side of Axis A), is pointed inward. FIGS. 1A-1E, 3A-3E, 5A-5E, 6A-6D, 7A-7C, 9A-9E, 10A-10G, 11A-11D, 14A-14E, 34A, 34B, 36B, 36C, 45, 39-43, 53A-53E, and 54-64, illustrate the center of the light holders Axis P pointed upwards in relation to Axis B, and outwards in relation to Axis A. FIGS. 79A-79G, 79H-79K, 80A-80I, 87-91 show the center of the light holders Axis P pointed outwards in relation to Axis A, and downwards in relation to Axis B.

Two or more light sources within different light holders, but within the same light housing, may project light parallel to each other, or at different directions from one another, whereby when the lighting accessory is installed on the paintbrush, at least one light source projects light at a fixed oblique angle in relation to Axis A or B (or both) and forward from the mounting base of the outer shell, away from the outer shell.

It is preferred that one or more light housings are positioned between Axis Y and Axis X, and in remote areas of the ferrule area, away from the normal gripping area of the brush, such as near the outer perimeter portions of the ferrule's top rear or bottom rear, or near the front of the ferrule.

The light housings are spaced from each other in a fixed position on the mounting base, and when installed on the brush they are spaced from each other in relation to Axis A or Axis B or both. Each light housing may include a plurality of cylindrical light holders, the cylindrical light holders integrally separated from each other, and each light holder configured to receive one LED within a holder.

In some embodiments, the outer shell includes at least two integral light housings, separated from each other, the formation of each light housing having at least one cylindrical light holder within, sized to receive a light source. It is contemplated to employ other shapes of light holders. For example, rectangular light holders could be employed with rectangular LED lights, though the outside edges of the light holders/light housings, and the outer shell would preferably be softened to a rounder shape, to maintain a streamlined appearance and shape. Two or more LEDs may also be electrically linked and positioned in a row near the base of the bristles, preferably within one or more protective coverings, as seen in FIGS. 20, 23, 29A, and 29B.

Light sources may be mounted in singular form, in group form, or any combination thereof, to provide illumination in different directions. Multiple light sources may be mounted in a light housing or light holder connected to a common mounting base, which is attachable to the ferrule, shoulder, handle or any combination thereof, whereby the mounting base may cover a small portion or the majority of the ferrule area, while the lights provide illumination in different areas and directions, while still allowing the ferrule and handle gripping area to maintain a low profile, so as to have a thin and natural appearance and shape for ease of handling. This is shown in FIGS. 7A-7C, which shows three various removable embodiments. Two embodiments cover a substantial portion of the ferrule. The first is an embodiment installed by sliding on over the back of the handle and enveloping the handle. The second is an embodiment that is slid on over the upper shoulder, covering three sides of the ferrule. The third embodiment covers a minimal portion of the upper shoulder, and the optional removable protective covering is the only added thickness to the thickness of the majority of the ferrule gripping area. Fixed embodiments are shown in FIG. 11A-11F on angled brushes, FIGS. 54-59, 60-64, and 65A-65D on rectangular brushes, and in FIGS. 80A-80I on a round brush, and FIG. 15 and FIG. 16 (which are shown, but not installed on a brush).

In yet another aspect, multiple light sources may be mounted in multiple light housings, which are connected to a common mounting base that is shaped to be removably slid over the handle and ferrule area of a paintbrush, and the mounting base of the outer shell envelops all or part of the ferrule, as well as all, or a portion of, the paintbrush handle. It may be removably positioned on one or more shoulders of the brush to provide Illumination from multiple light sources and multiple angles. Examples are shown in FIGS. 5A-5E, 8A-8C, 32A-32E, 33A-33E, and 53A-53E, and FIG. 65A-65D, depending on the ferrule covering employed between the brush and the outer shell.

Figure 36A:
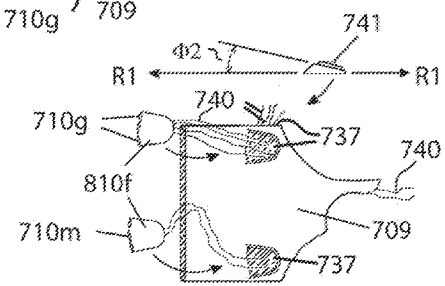
FIG. 36A shows a partial side view of an illumination means, prior to installation on an angled brush.
Figure 36C:
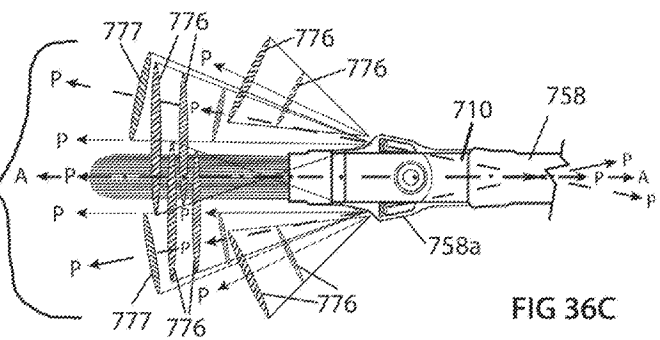
FIG. 36C shows a top view of the lighted paintbrush of FIG. 36B.
Figure 36B:
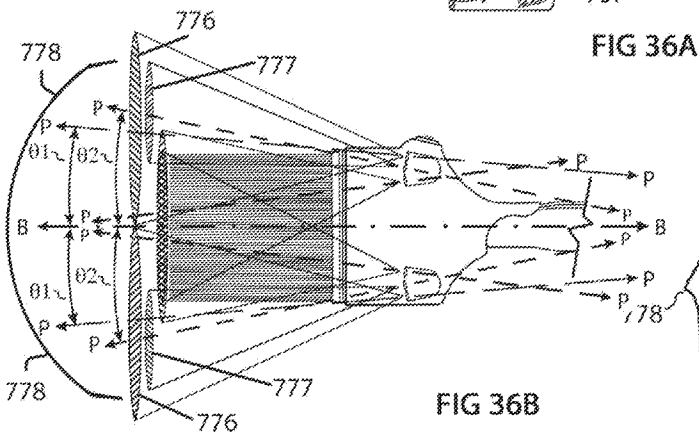
FIG. 36B shows a partial side view of the illumination means of FIG. 36A attached, in painting action, and the light cones emitted (and overlapping).
Figures 38A, 38B, 38C, 38D, 38E, 38F:
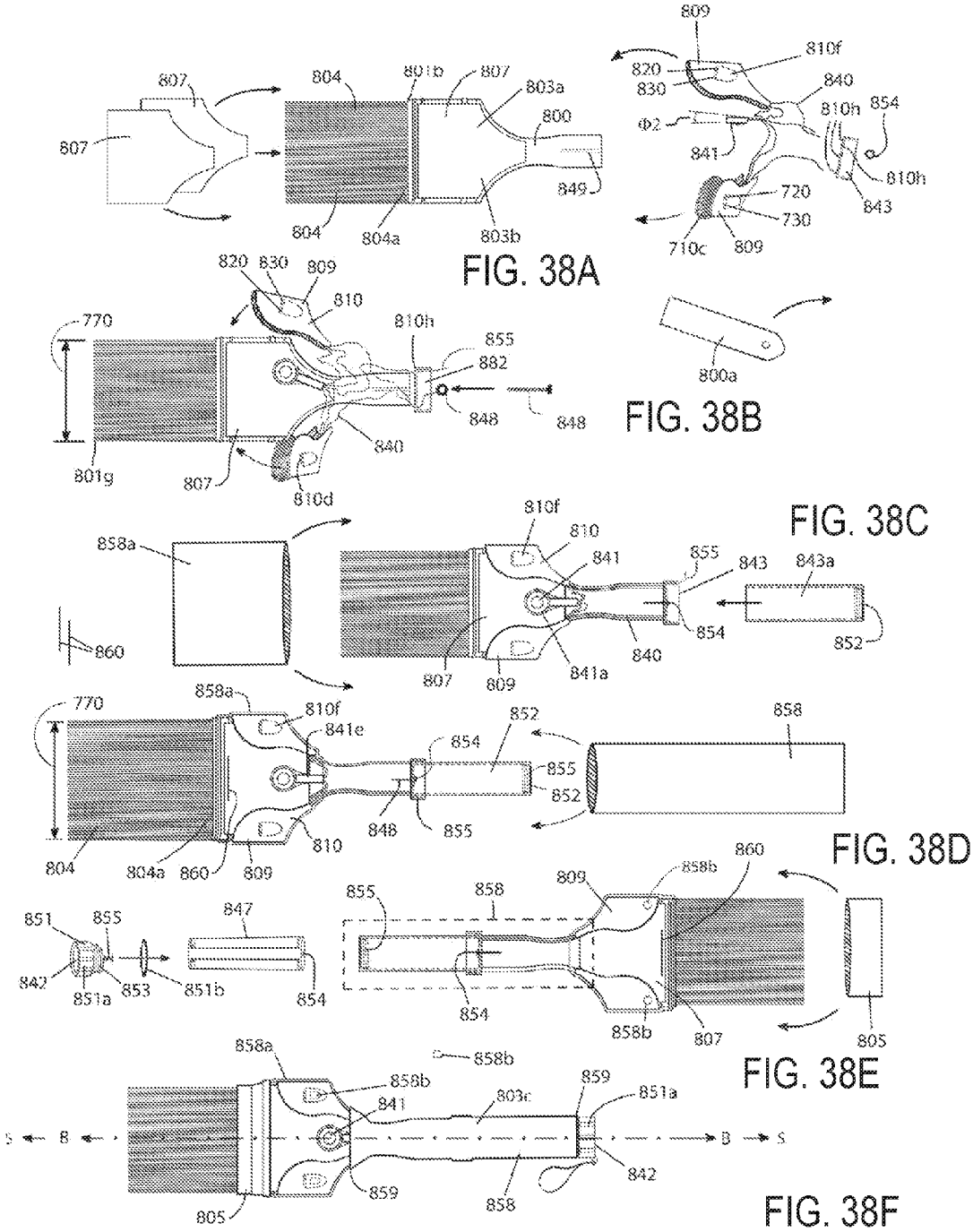
FIG. 38A-38F illustrates an alternate embodiment with two side views of a rectangular-ferruled brush with a modified handle, as a lighting accessory and protective coverings are installed.
Figure 39:
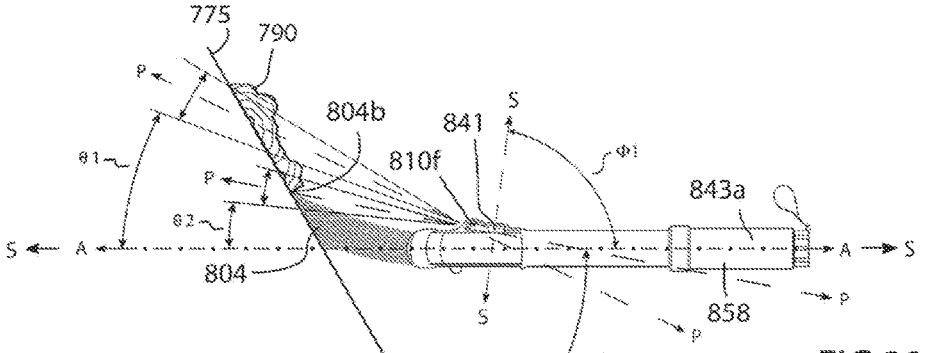
FIG. 39 shows a top view of the lighted paintbrush of FIG. 38 in painting action against a side view of a wood trim piece, and the angling of the lights.
Figure 40:
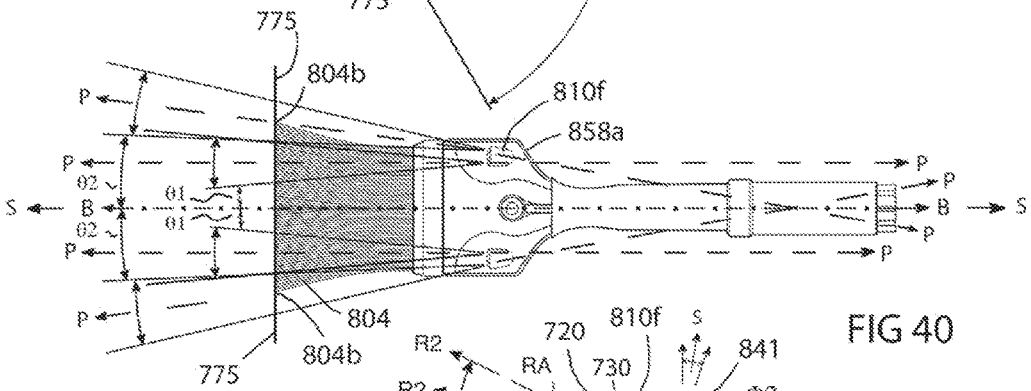
FIG. 40 shows a side view of the lighted paintbrush of FIG. 38, and the angling of the lights.
Figure 41:
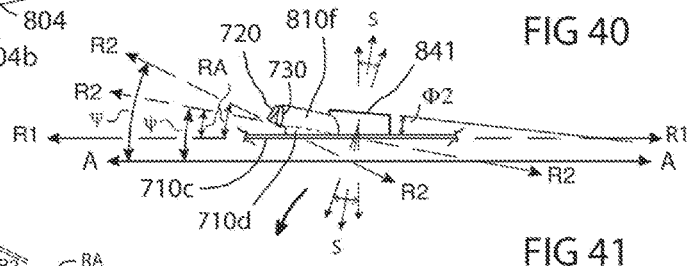
FIG. 41 shows an enlarged perspective view of the lights of FIG. 39.
Figure 42:
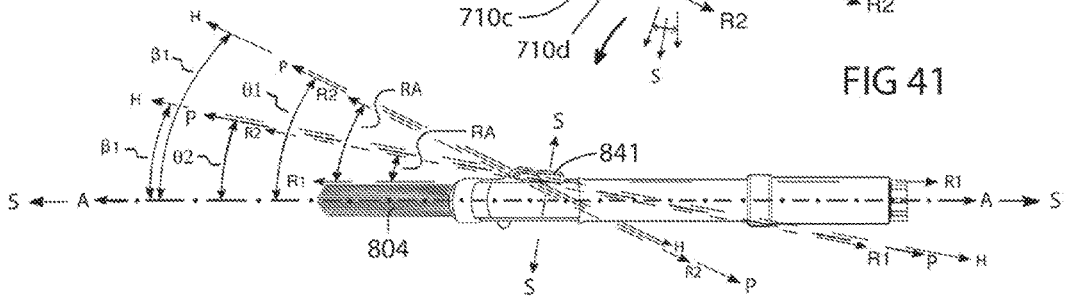
FIG. 42 shows a top view of the lighted paintbrush of FIG. 38, at rest, and the angling of the lights.
Figure 43:
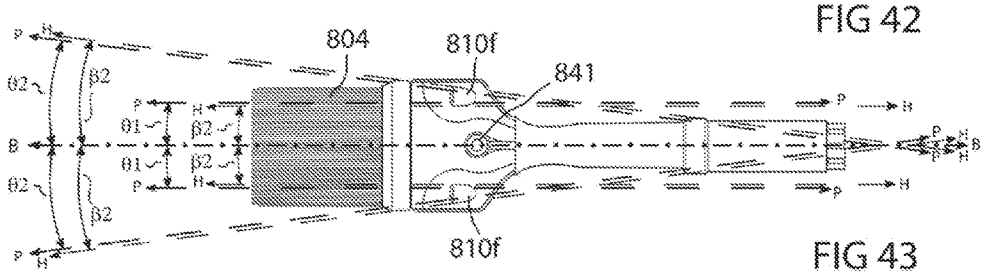
FIG. 43 shows a side view of the lighted paintbrush of FIG. 42 and the positioning of the lights and switch.
Figures 44A, 44B, 44C, 44D, 44E:
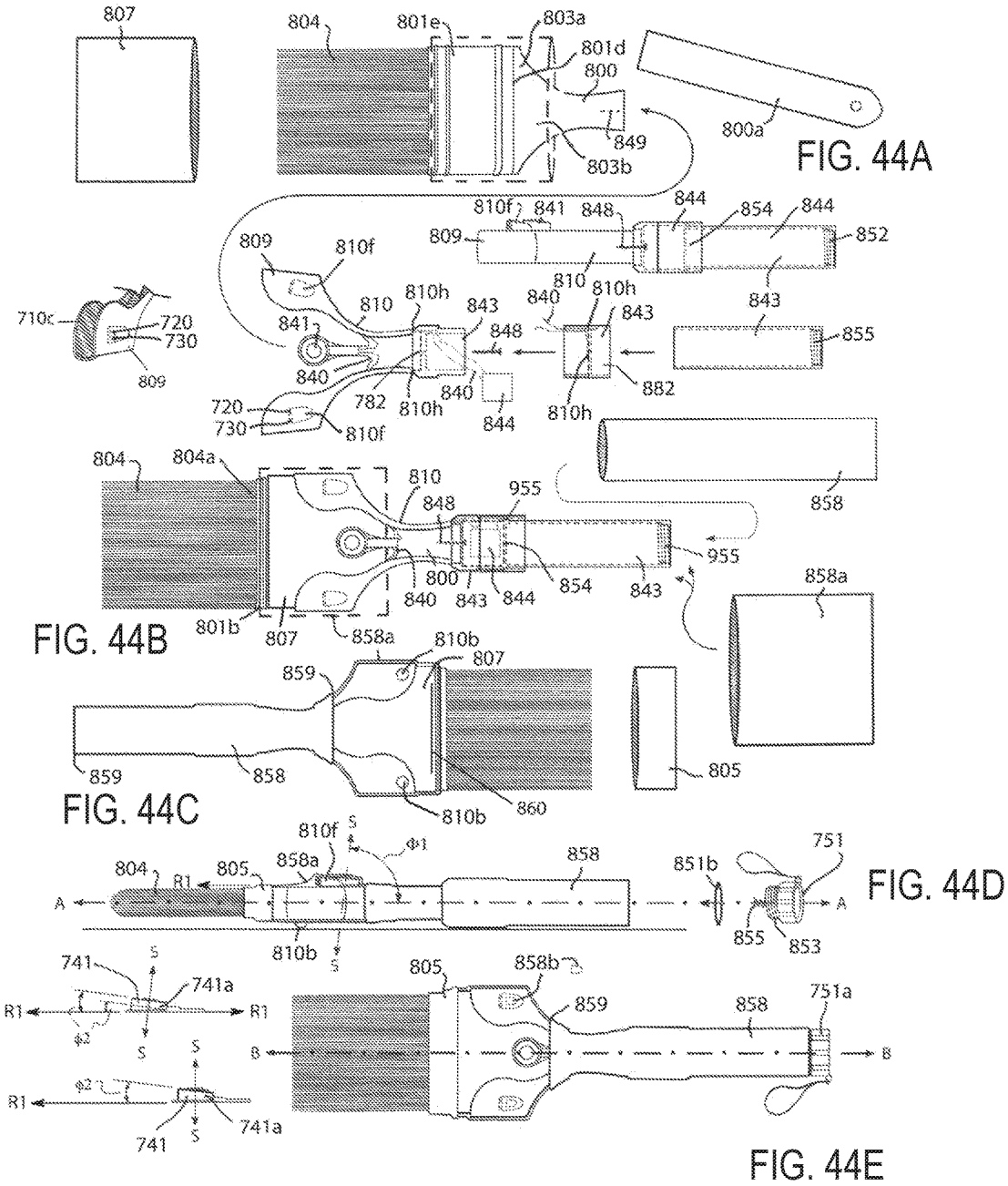
FIGS. 44A-44E illustrate an alternate embodiment with two side views of a rectangular-ferruled brush with a modified handle, as a lighting accessory and protective coverings are installed, and the top and side views of the positioning and angling of the switch.
Figure 45:
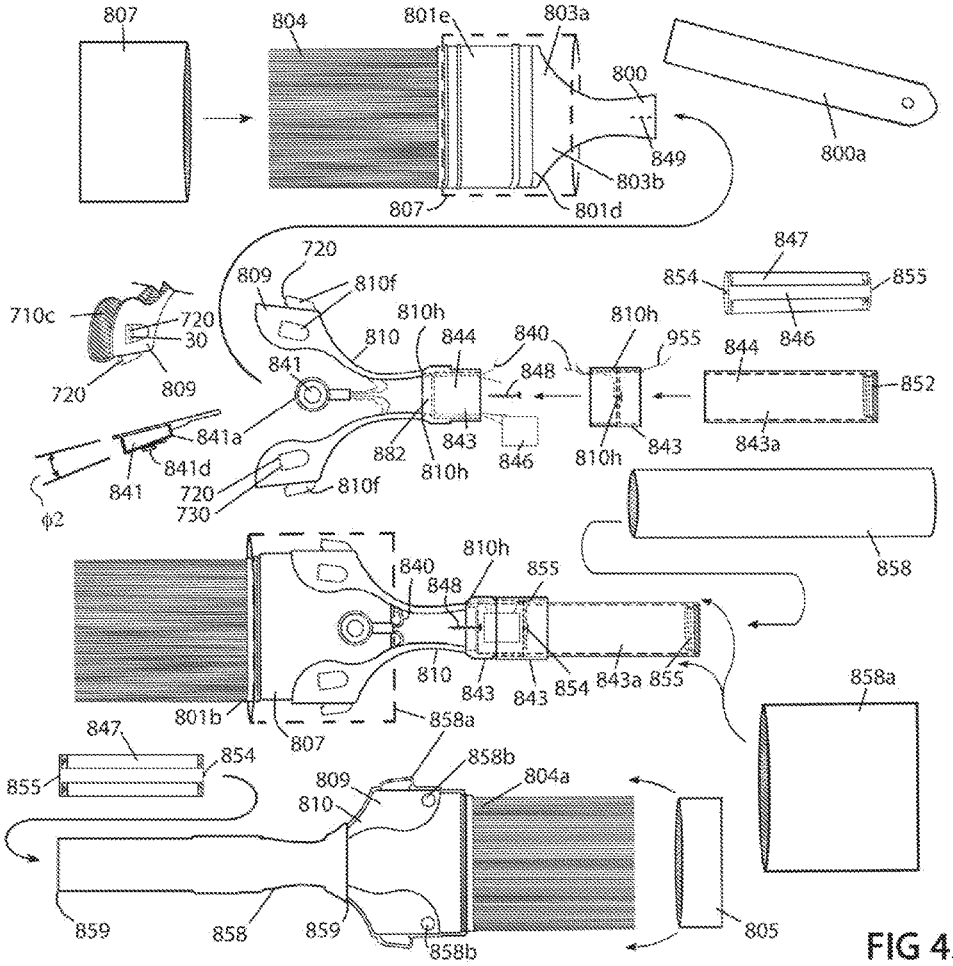
FIG. 45 illustrates an alternate embodiment with two side views of a rectangular-ferruled brush with a modified handle and with an alternate battery housing connector and alternate light configuration, as a lighting accessory and protective coverings are installed.
Figure 46:
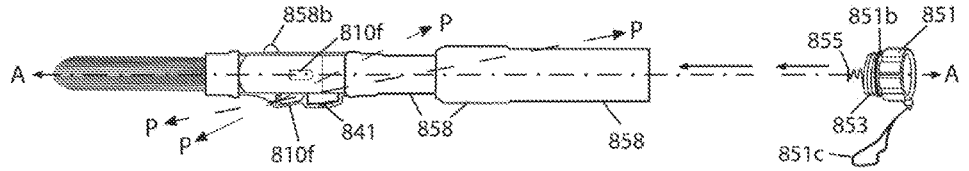
FIG. 46 shows a top view of the embodiment of FIG. 45, showing the angling of the switch and lights.
Figure 47:
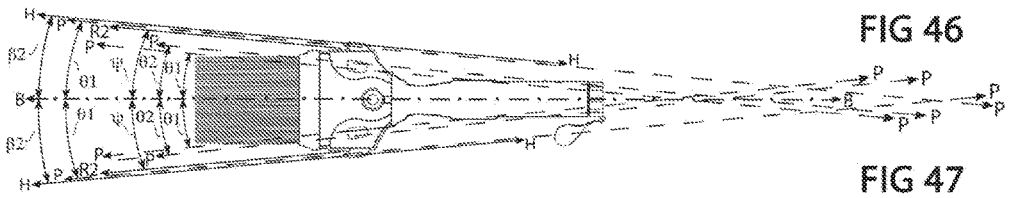
FIG. 47 shows a side view of the embodiment of FIG. 46, showing the angling of the lights.
Figure 48:
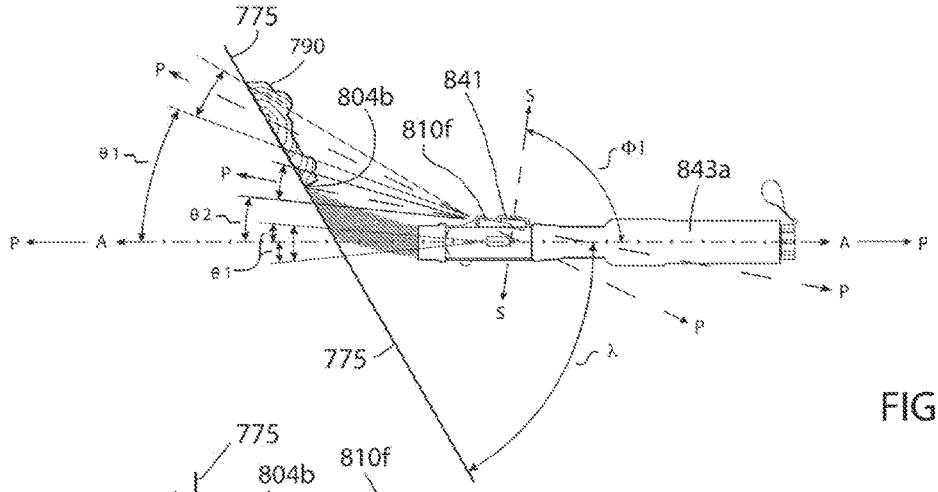
FIG. 48 shows a top view of the lighted paintbrush of FIG. 45 in painting action against a side view of a wood trim piece, and the angling of the lights and switch.
Figure 49:
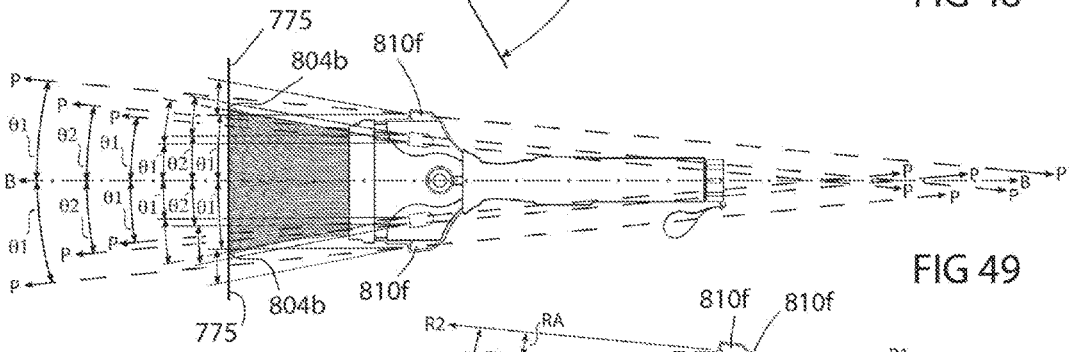
FIG. 49 shows a side view of the embodiment of FIG. 45, in painting action, with the bristles in a compressed state, brushing away from the viewer, showing the angling of the lights.
Figure 50:
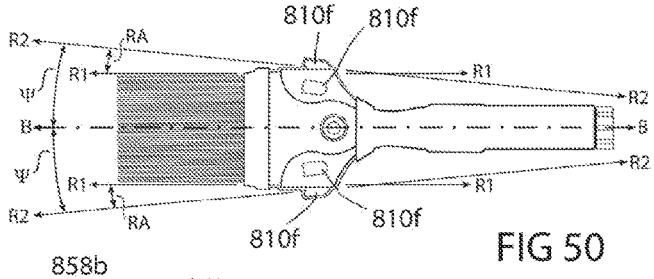
FIG. 50 shows the embodiment of FIG. 49, with the bristles in a relaxed state
Figure 51:
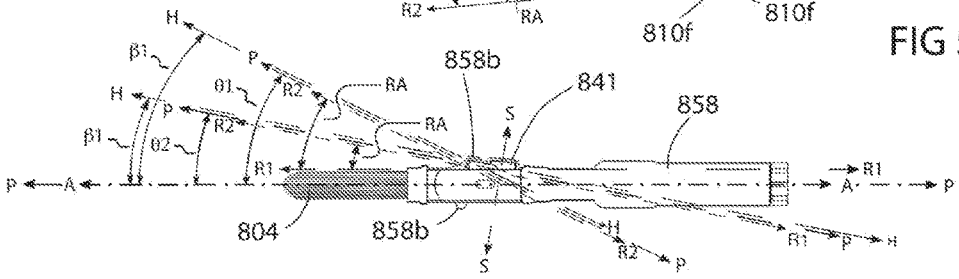
FIG. 51 shows a top view of the embodiment of FIG. 50.
Figure 52:
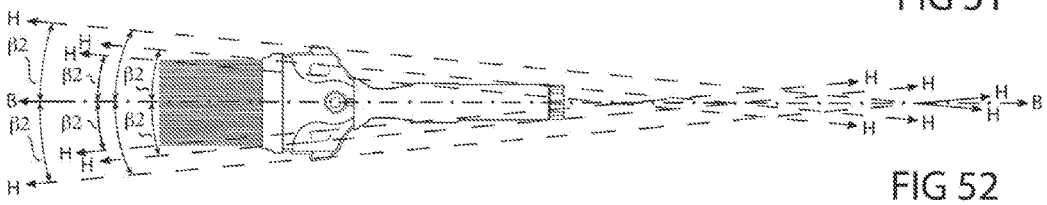
FIG. 52 shows a more detailed view of FIG. 50.
Figures 53A, 53B, 53C, 53D, 53E:
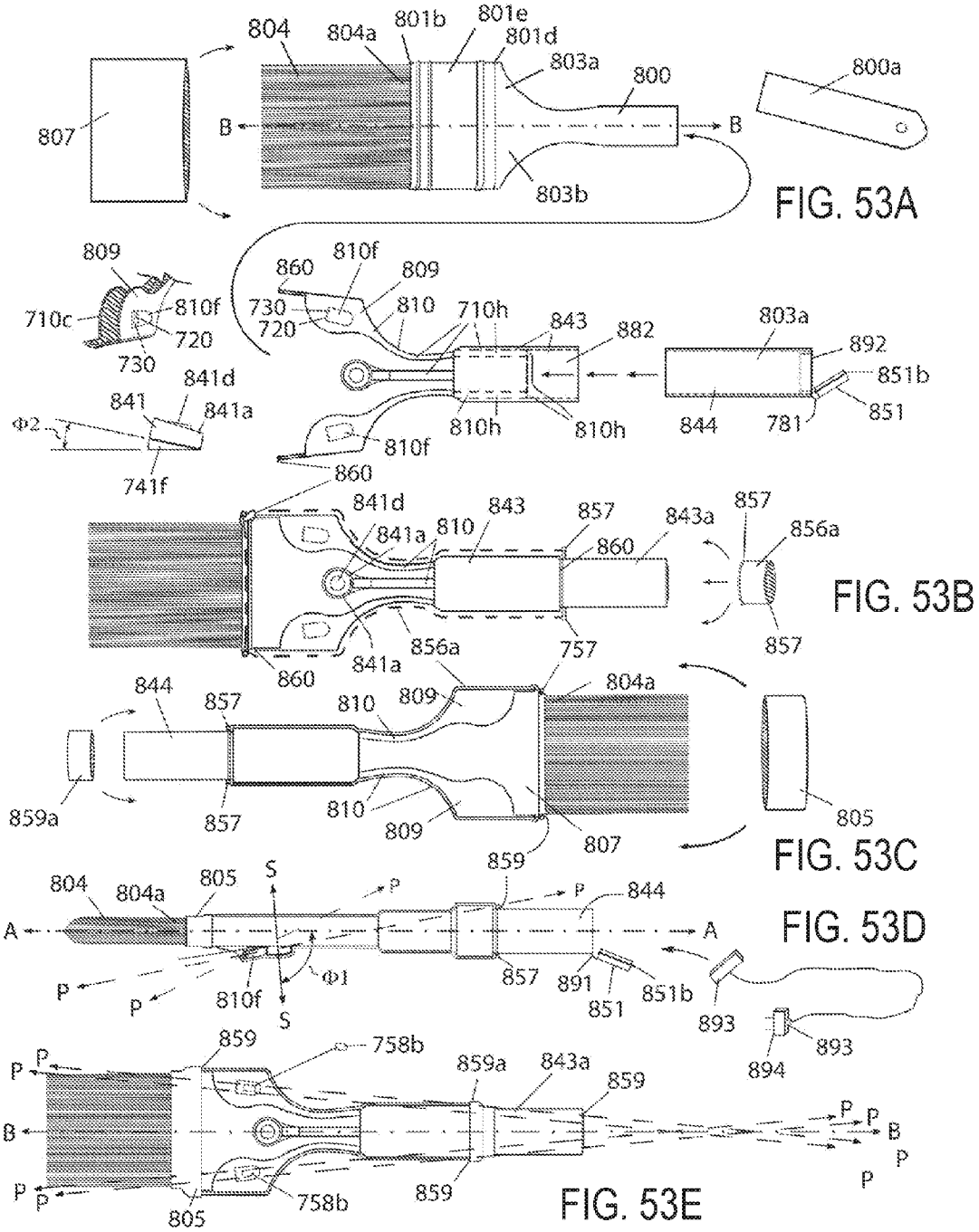
FIGS. 53A-53E illustrate an alternate embodiment with two side views of a rectangular-ferruled brush with a modified handle and with an alternate battery housing connector and alternate component configurations, as a lighting accessory and protective coverings are installed, and the angling of the lights and switch.
Figure 54:
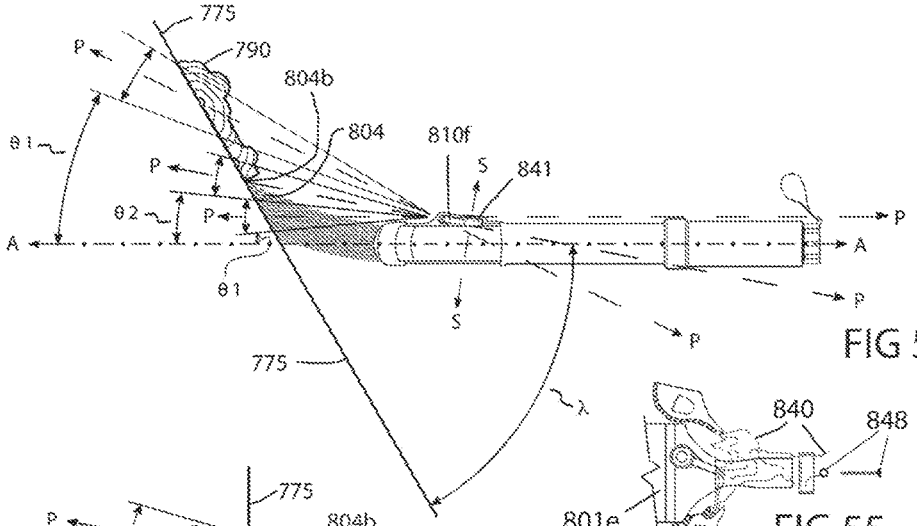
FIG. 54 shows a top view of the lighted paintbrush of FIG. 37 in painting action against a side view of a wood trim piece, and the angling of the lights and switch.
Figure 55:
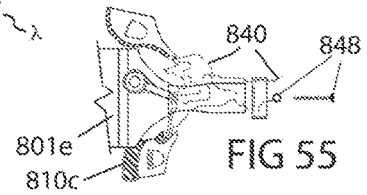
FIG. 55 shows a side view of the lighting configuration of FIG. 37 about to be installed, and the attachment to the modified brush handle.
Figure 56:
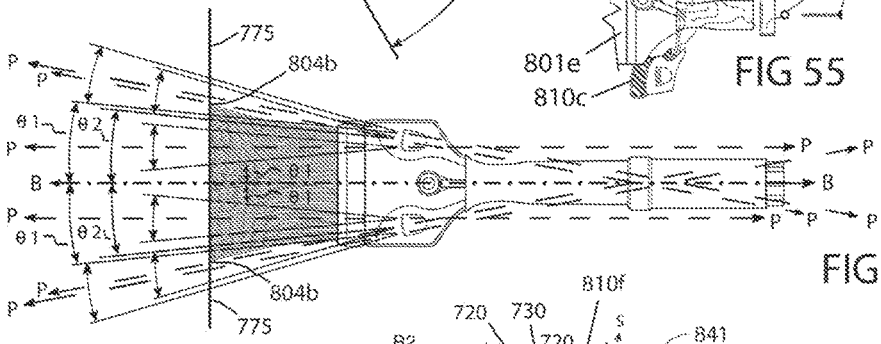
FIG. 56 shows a side view of the embodiment of FIG. 37, in painting action, with the bristles in a compressed state, brushing away from the viewer, showing the angling of the lights.
Figure 57:
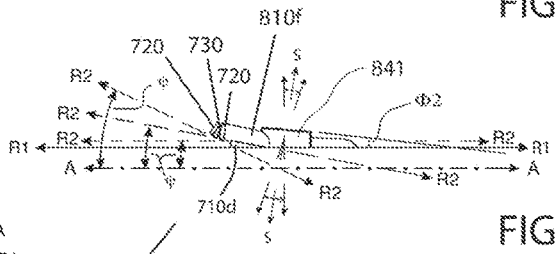
FIG. 57 shows an enlarged partial perspective top view of the lighting configuration of FIG. 54.

In another example, one or more of the light housings and/or switch housings may be fixed to the thin outer surface of a separately moulded outer shell and outer shell extension as a means of more easily assembling a lighting accessory. These housings may be fixed to a matching sized and shaped porthole 737 located in the outer shell, such as in a thin mounting base portion of the outer shell, using adhesive, ultrasonic welding, or other suitable fastening techniques. In this embodiment, the installation of the LED's and the connections from the LED's leads to one or more wires may be done within the light housing and switch housing, before the light housings and switch housings are fixed into place on the outer shell. The outer shell is then mounted to a surface of the shoulder of the brush, and a portion of a switch controlling the lights and the conductive leads are mounted substantially concealed within the natural outer perimeter of the outer shell as shown in FIG. 36A-36C.

An outer shell, outer shell extension and light housing which comprise a common mounting base, provides a quick, easy and convenient way to mount more than one light source canted in the same direction to two or more sides of the bristles and hold the lights in place relative to the ferrule and bristles. Some examples are shown in FIGS. 9A-9E, 49, 51, 62, and 63.

In FIGS. 81A-81H, the thin mounting base 910*c* between the light housing 909 and the actuator 941*d* within the switch assembly 941 is flexible enough to be bent into shape over the top shoulder of a brush of various sizes, acting as a self-hinge.

Figures 1A, 1B, 1C, 1D, 1E:
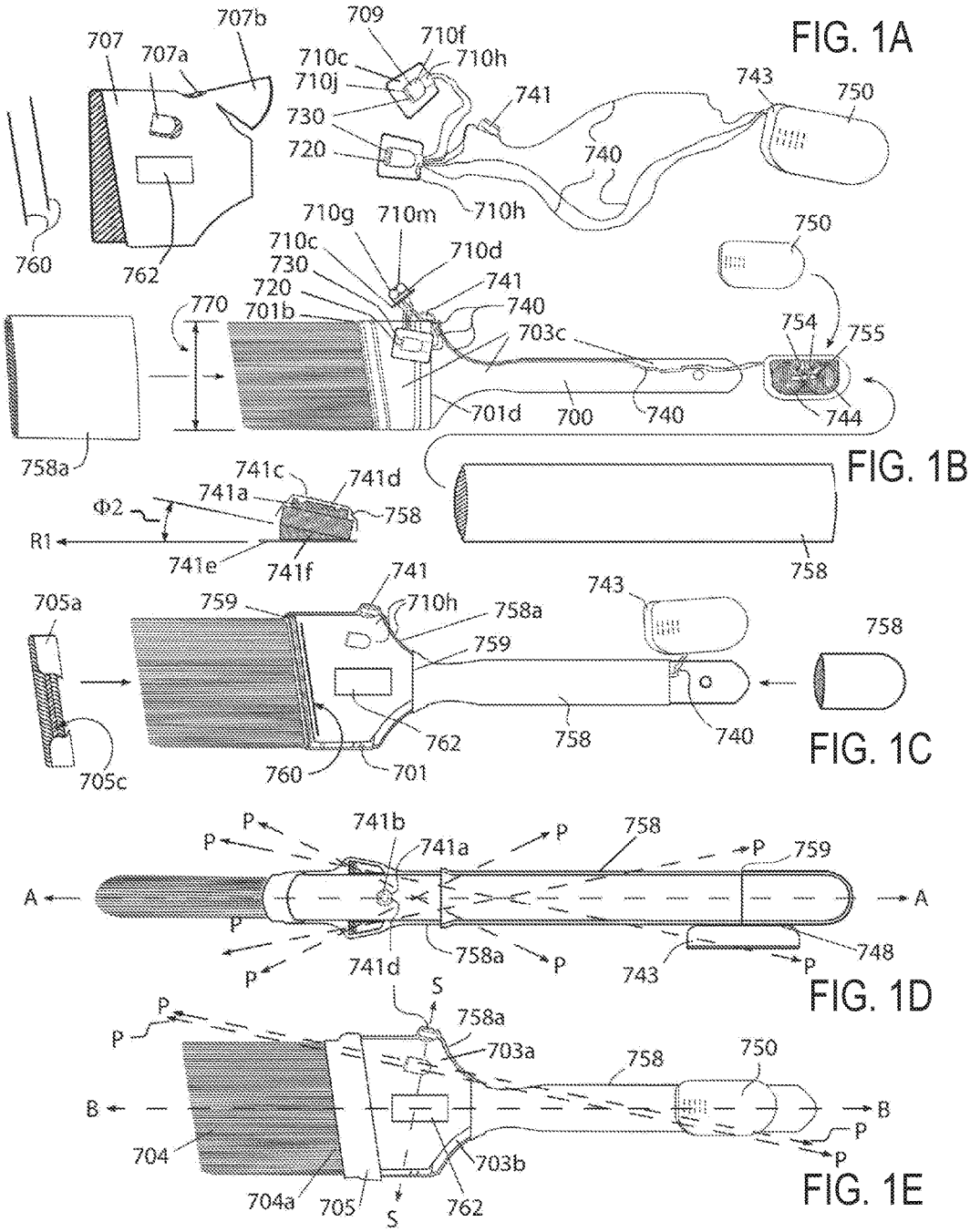
FIGS. 1A-1E illustrate a group of accessories that may be attached to a paintbrush, with an independently mounted switch and power source housing, the assembly of one embodiment of the lighted paintbrush, and the angling of the lights and switch from the top and side view.
Figure 2A:
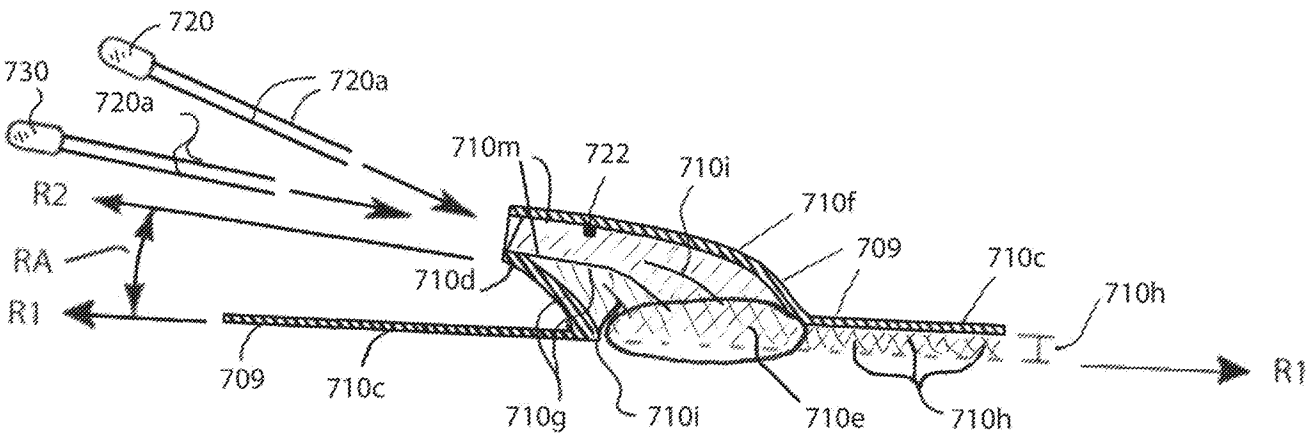
FIG. 2A illustrates an expanded cross-sectional view of a light housing of FIGS. 1A-1E, ready to accept the first and second light sources into the first and second light holders, prior to mounting on the right side of the brush.
Figure 2B:
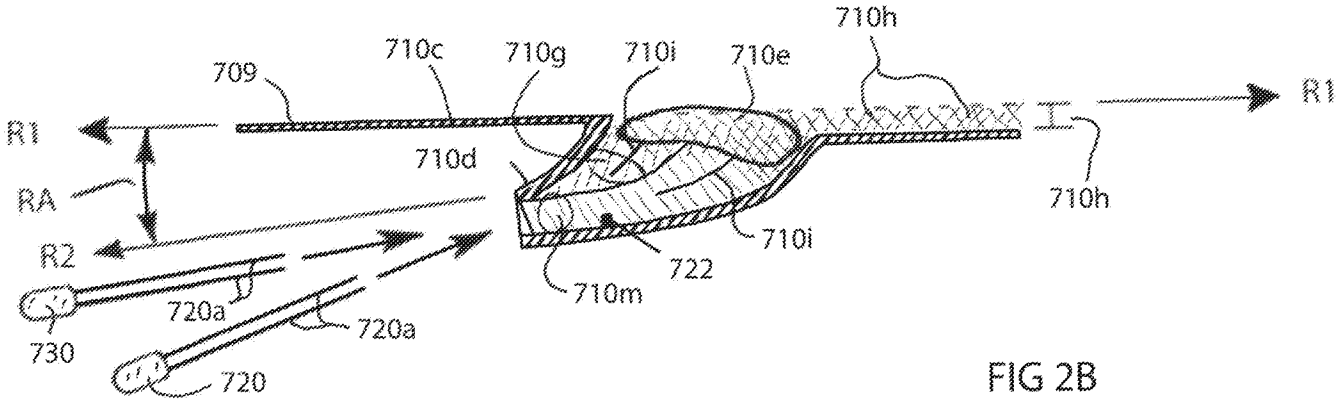
FIG. 2B illustrates an expanded cross-sectional view of a light housing of FIGS. 1A-1E, through the second light source holder, ready to accept the first and second light sources into the first and second light holders, of the independently mountable, integrally formed, outer shell, light housing and thin mounting base, prior to mounting on the left side of the brush.
Figure 2C:
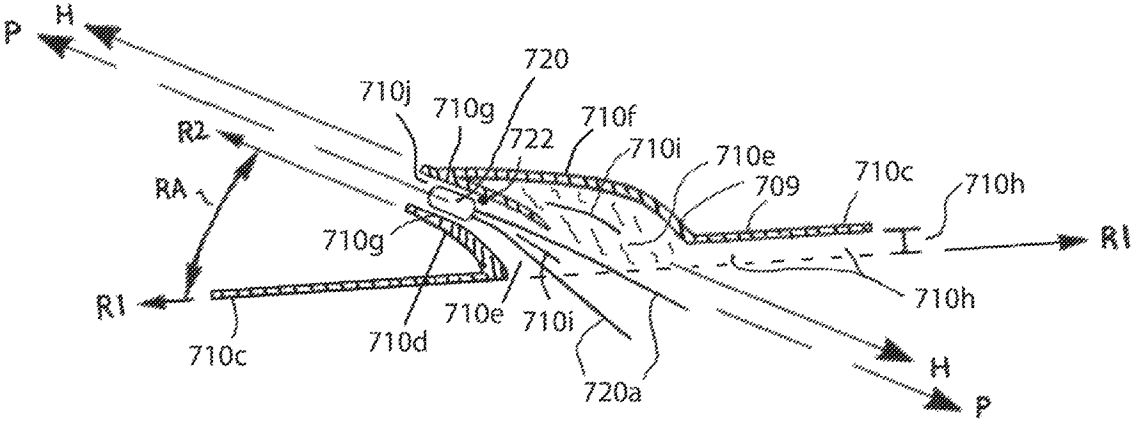
FIG. 2C illustrates a view of the light housing of FIG. 2A, with the first light source installed within the light holder at a fixed angle and orientation, prior to mounting on the right side of the brush.
Figure 2D:
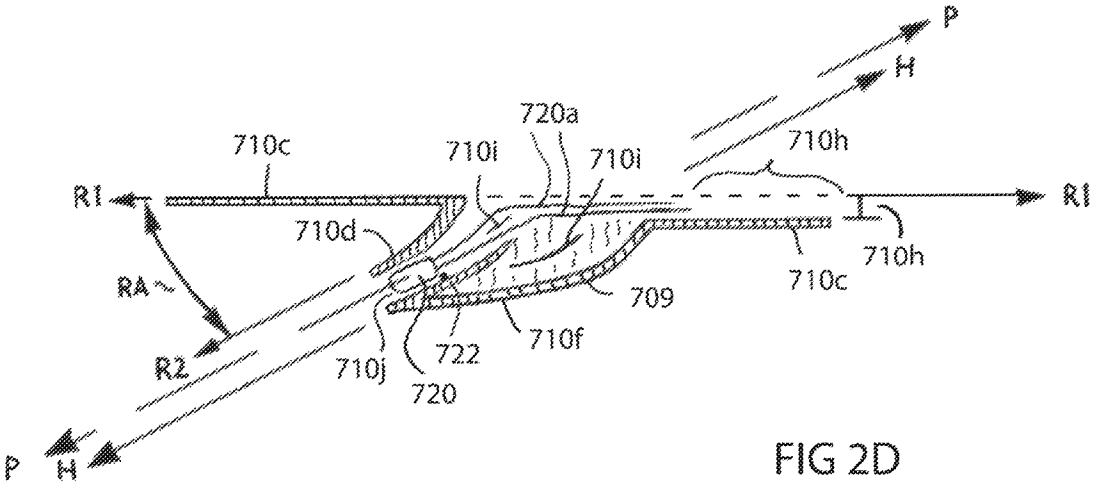
FIG. 2D illustrates a view of the light housing of FIG. 2B, with the first light source installed within the light holder at a fixed angle and orientation, prior to mounting on the left side of the brush.
Figure 2E:
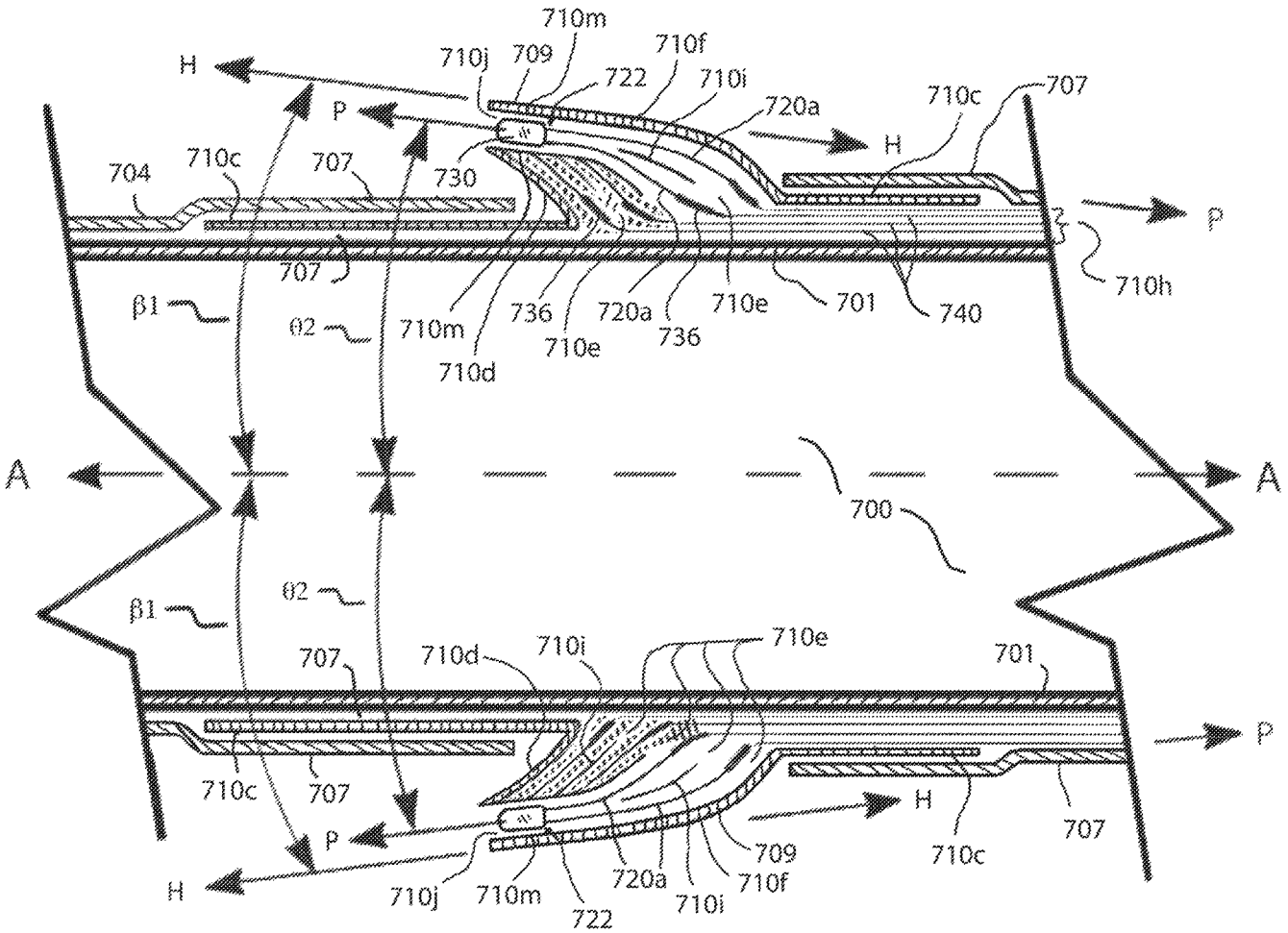
FIG. 2E shows an expanded cross-sectional bottom view of the brush, through the second light source holders of the light housings of FIG. 2A and FIG. 2B.
Figure 2F:
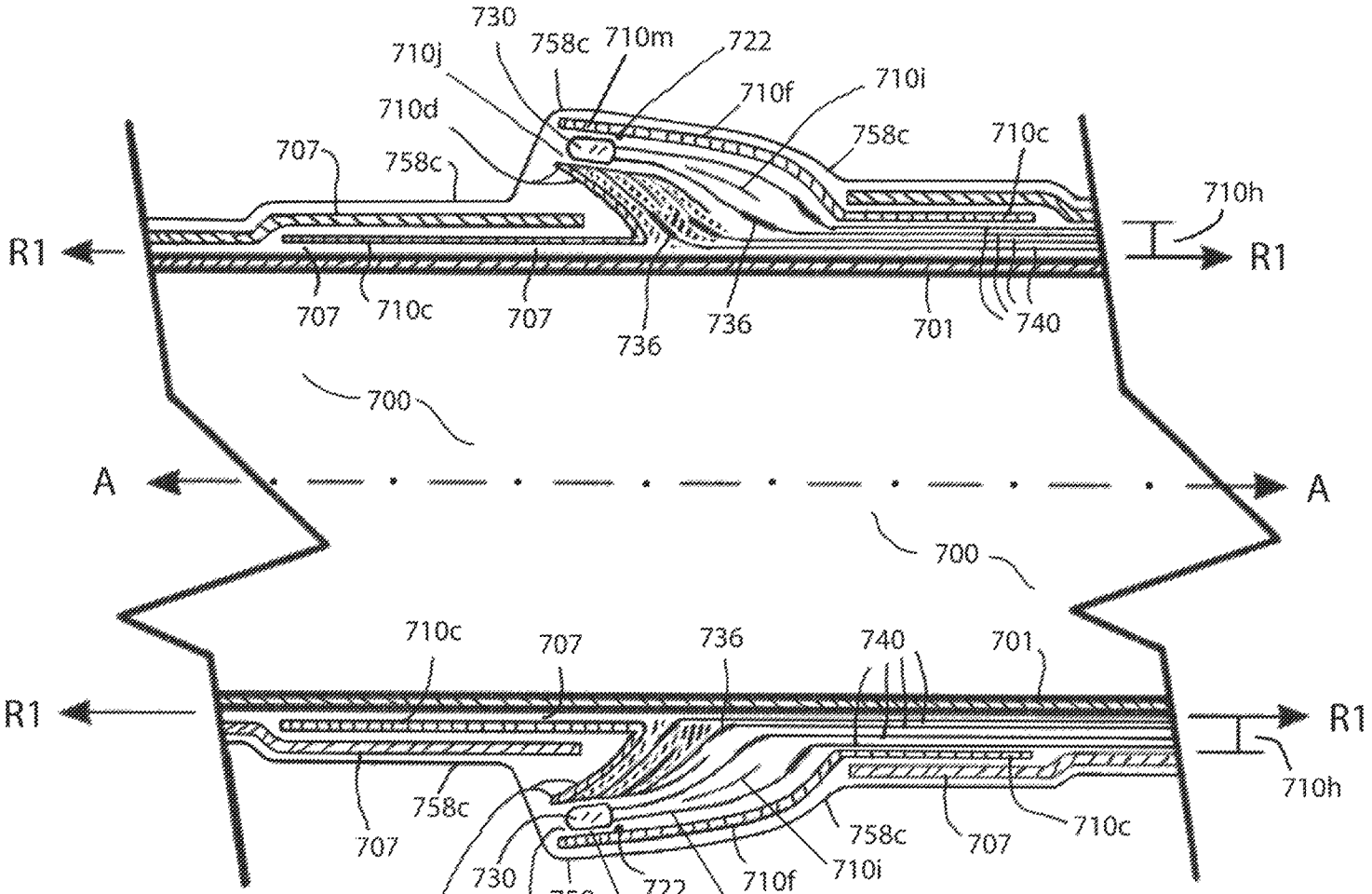
FIG. 2F shows the view of FIG. 2E with the protective covering installed over the light housing and the ferrule.
Figures 2G, 2H, 2I, 2J:
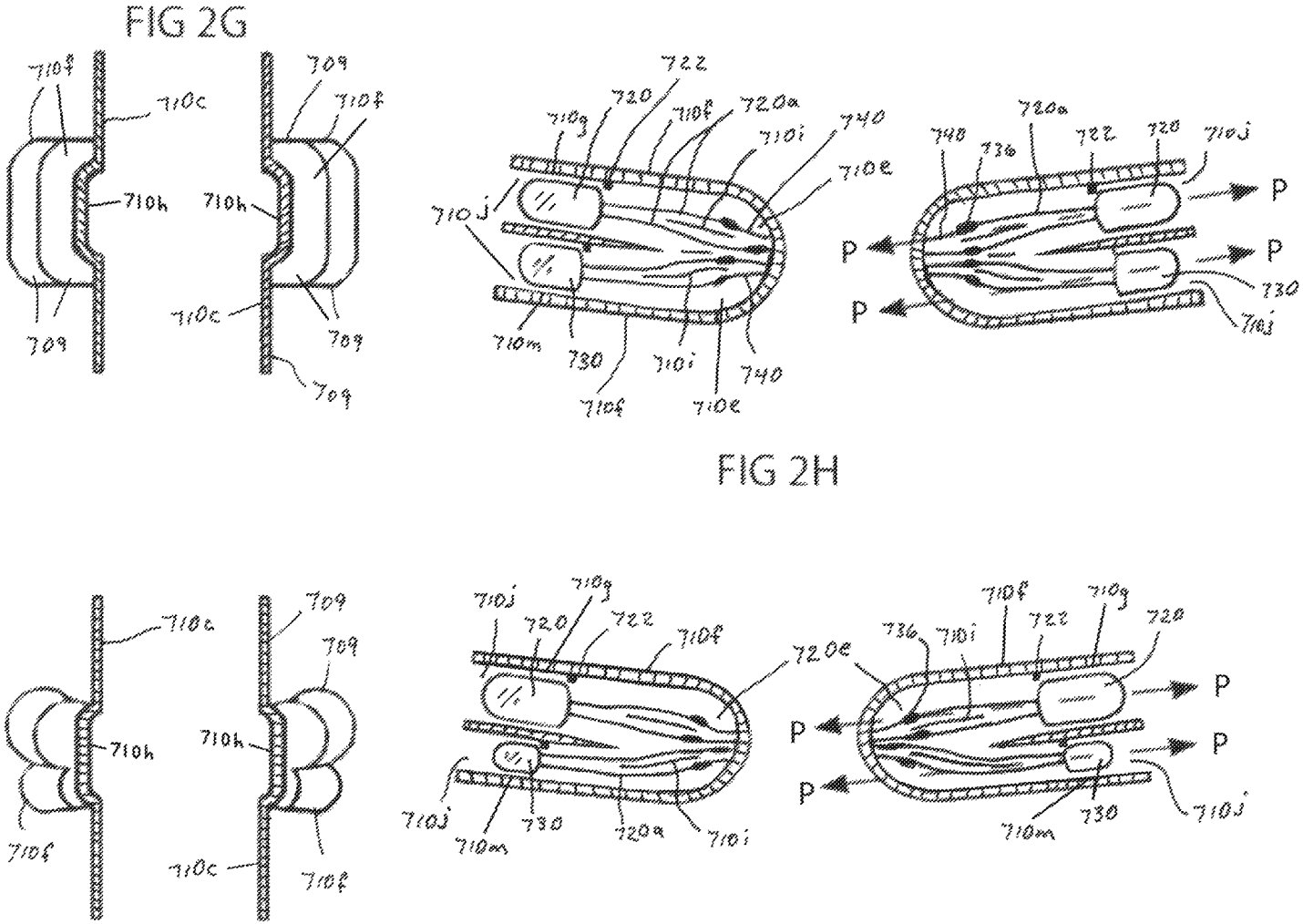
FIG. 2G illustrates an expanded back view of one configuration of the independently mountable, integrally formed outer shells and light housings of FIGS. 1A-1E and FIGS. 2A-2F prior to mounting one on each side of the brush.
FIG. 2H shows an alternate view of the light housings of FIGS. 1A-1E and FIGS. 2A-2F with light holders sized to match two same-sized LED's positioned within the light holders.
FIG. 2I illustrates an expanded back view of an alternate configuration of the independently mountable, integrally formed outer shells and light housings of FIGS. 1A-1E and FIGS. 2A-2F prior to mounting one on each side of the brush.
FIG. 2J shows an alternate view of the light housings of FIGS. 1A-1E and FIGS. 2A-2F with light holders sized to match two different-sized LED's positioned within the light holders.
Figures 3A, 3B, 3C, 3D, 3E:
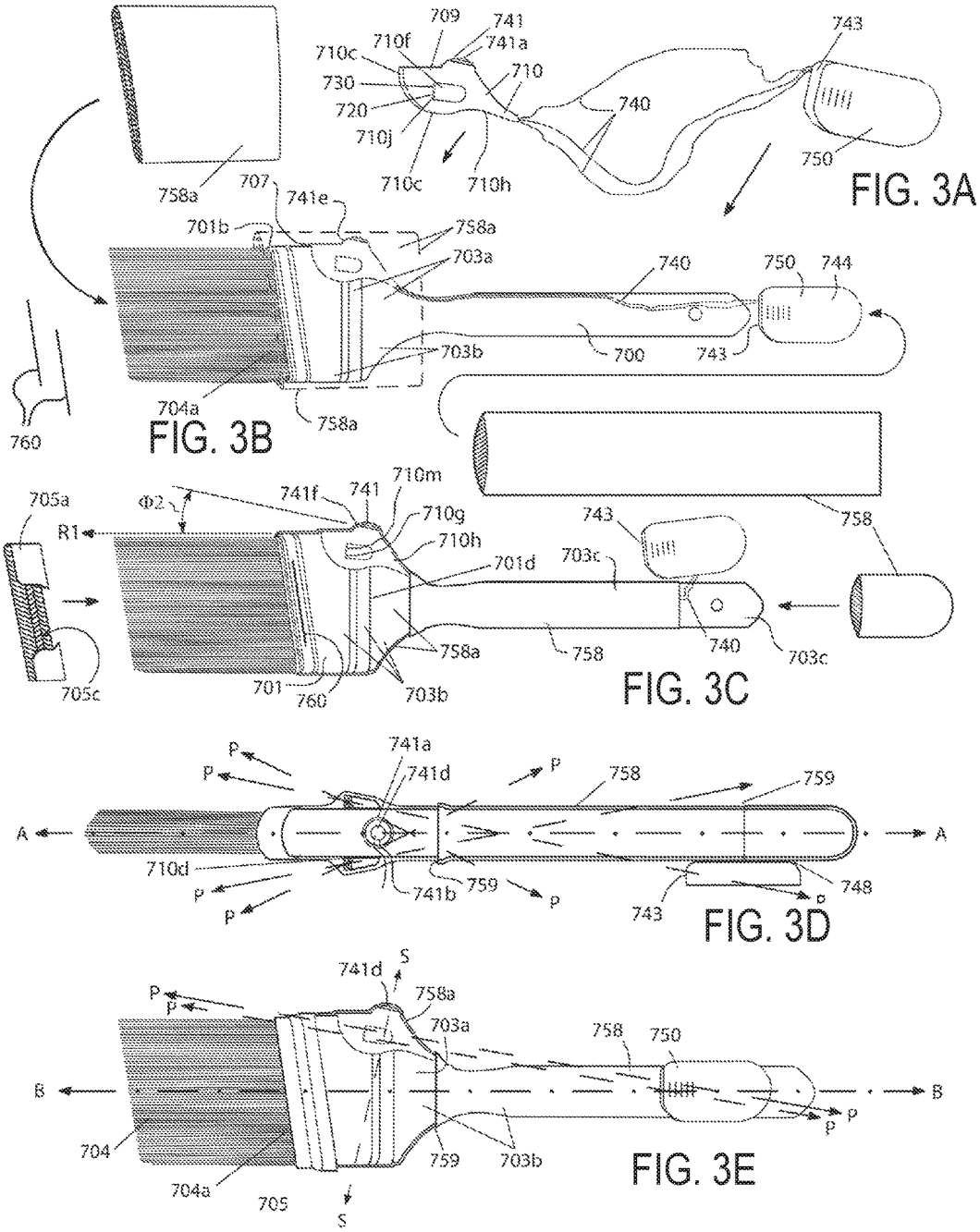
FIGS. 3A-3E illustrate an example of a group of accessories to be fixed to a paintbrush, the assembly of one embodiment of the lighted paintbrush, and the angling of the lights and switch from the top and side view.

FIG. 2G shows a thin mounting base comprising a relief area, whereby the outer shells of the two light housings are blended together to form one outer plane between them and do not follow the tubular shape of the first and second internal light holders held within the housings. This configuration is contemplated to be employed with 2 or more LEDs of 3 mm or less since it is not as compact as the light housing configuration shown in FIG. 13D which is more preferred for larger LED's or a combination of sizes of LED's such as the combination of 5 mil and 3 mil as shown in FIG. 13D.

Figure 75:
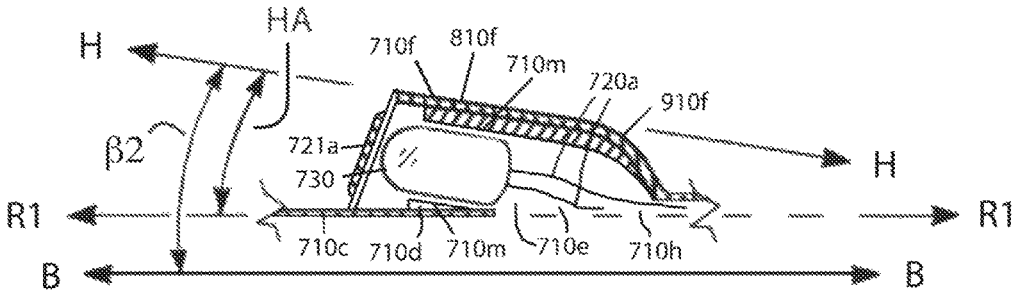
FIG. 75 shows an enlarged cross-section of a light holder, with a flat lens installed and acting as a stop for the LED.
Figure 76:
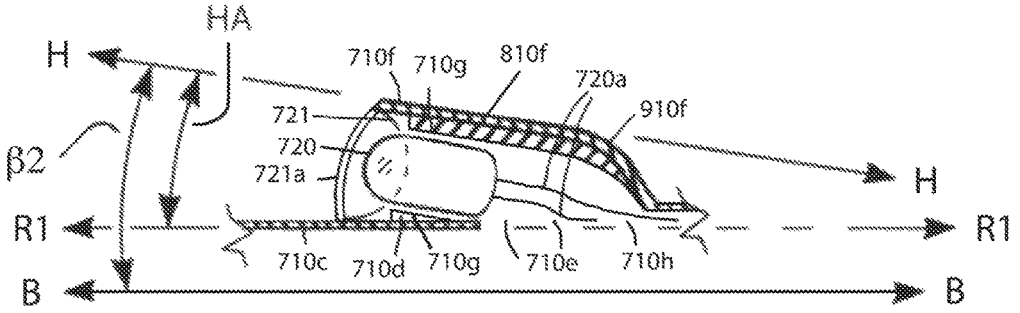
Figure 77:
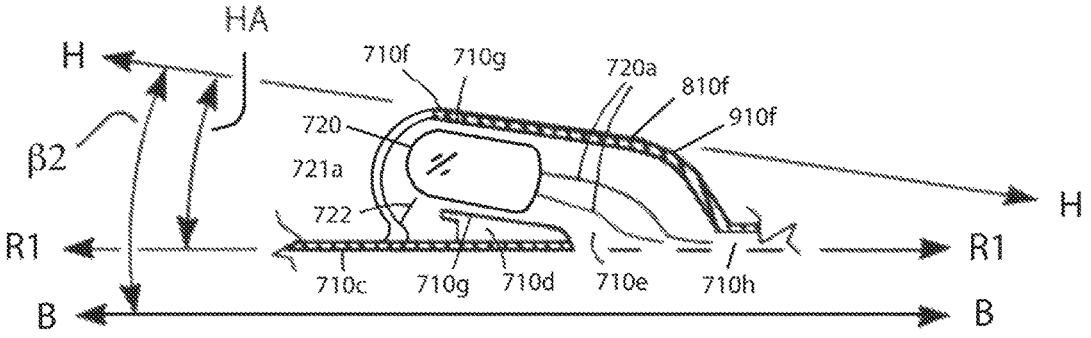

In one aspect, the lighted paintbrush is able is mounted on a paintbrush in such a way to simultaneously provide illumination in multiple directions from one LED, located in a housing mounted to a narrow edge of the ferrule on a paintbrush. Per FIGS. 69-74, and FIG. 76 the LED may be surrounded by reflective curve-shaped portion 721 that diffuses light in more than one direction, to illuminate the area around three sides of the bristles. This aspect allows an uninterrupted gripping portion of the paintbrush. FIG. 76 and FIG. 77 also shows a curved lens 721*a* that is fixed in position in front of the LED, that may be a Fresnel lens. FIG. 75 and FIG. 77 show an LED that is installed through a cavity in the bottom of the mounting base, positioned behind the light-altering lens 721*a*. FIG. 77 also has a stop.

As mentioned, it is preferable that the first and second light sources are protected by a shielding device, which also blocks indirect light rays from the eyes of the painter. The shielding device may be a light holder 710*g*, 710*m* or outer shell, whereby a light source is held in position recessed from the end of the light holder, and the light holder and outer shell portion of the light housing extend beyond the light source. FIGS. 2C-2F, 2H, 2K, FIGS. 4A-C, and FIGS. 13A-FIG. 13B show the LEDs recessed from the end of the light holders, creating a pocket 710*j*, whereby the light holder and outer shell are employed as a shielding device.

FIG. 2E and FIG. 2F illustrate outer shells that are mounted on a brush ferrule, whereby the outer shells do not have an outer shell extension (as seen being mounted on a brush in FIG. 1). FIGS. 3A-3E and FIGS. 9A-9E (and other figures) show an outer shell installed on a brush that is formed with an outer shell extension, which can also be seen in an enlarged view of FIG. 4C. In FIGS. 2E, 2F, and 4C, the outer shells are shown mounted to a ferrule 701 of a gripping end, by means of a first ferrule covering, such as an adhesive 707. Each light housing 710*f* is shown having a riser 710*d* (see FIG. 4A and FIG. 4D) as a means of raising a light holder and light housing from the mounting base 710*c*, wherein at least one riser and housing extend from the mounting base at a fixed orientation to the mounting base. FIGS. 2E, 2F and FIG. 4C each show one or more lights pointed at an oblique angle in relation to Axis A in a fixed orientation on a paintbrush.

Figure 13A:
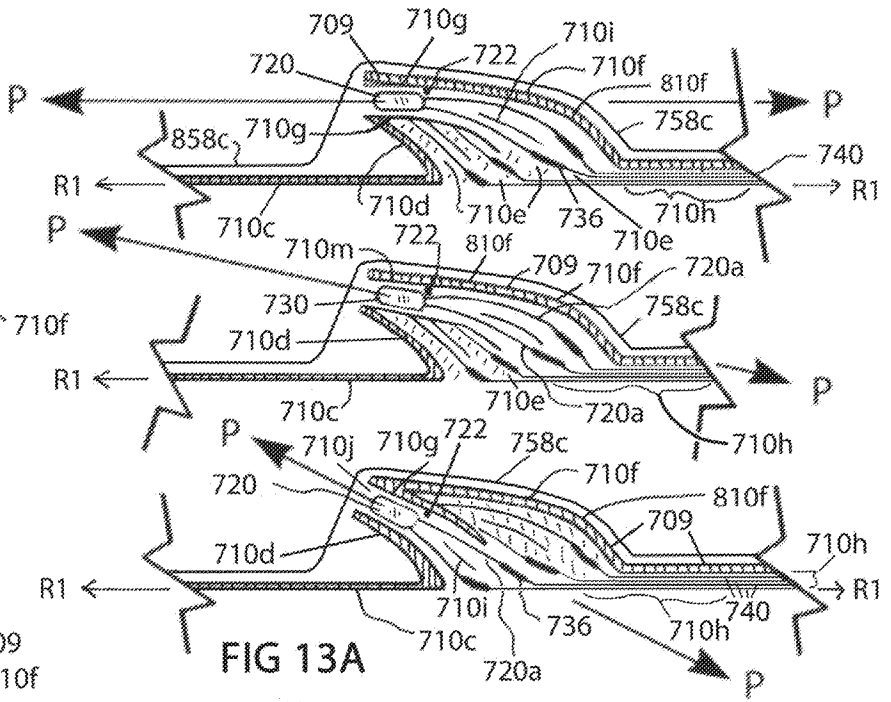
FIG. 13A shows three cross-sectional views of one light housing shown mounted on the right side of the brush, as seen in the top view of FIG. 11A. The light housing comprises 3 light holders, each sized to accept an LED, and each cross-section is drawn through the centre of each light holder, showing a relief area, and the angle of the LED in relation to the light holder, light housing, and thin mounting base.

The three enlarged light housing illustrations of FIG. 13A show three different cross-section views of one particular light housing, and three different LEDs positioned within that one light housing. The top and bottom illustrations are cross-section views through two different first LED light sources, and the middle illustration is a cross-section view through a second LED light source. Each illustration shows the placement of that particular LED in relation to the other light housing components. Each first LED light source 720 is positioned in a first light holder 710*g*, and second LED light source 730 is positioned within a second light holder 710*m*. FIG. 13A also shows the angle each light is pointed within the housing, by illustrating n Axis P drawn through the center of each light holder, and showing how that angle relates to the thin mounting base lateral line R1. FIG. 13A also shows the placement of each LED stop 722 within a first and second light holder, a light housing 710*f*, connections 736 between the LED leads 720*a* and the conductive leads or wires 740, configured to keep the total height, length, and width of the light housing 710*f* to a minimum.

FIGS. 1A-1E illustrate an outer shell configured to be fixed to a paintbrush for the life of the brush, and shows separately mountable outer shells comprising a light housing, and two light holders within a light housing. These are shown in expanded views of the light housings in FIGS. 2A, 2B, 2C and 2D which show two independently mountable, integrally formed outer shells, with light housings 710*f* comprising light holders 710*g* and thin mounting base 710*c*. Since these light housings are individually mounted, and comprise a relatively small flat mounting base 710*c*, they may be placed on any flat surface on a gripping end of a brush, and may be employed on a variety of different shapes and sizes of brushes having a flat surface to mount upon. They may also be moulded to comprise light holders pointing at different angles than one another to focus on different areas around the bristles. Though the independently mountable, integrally formed outer shells may be integrally formed with light holders pointing at different angles from one another, in FIGS. 1A-1E and 2A-2F they are shown formed in the same (but opposite) formation and fixed to the ferrule of a brush pointing at preferred angles for a brush with an angled ferrule.

FIGS. 38A-38F also show an embodiment with 2 independently mounted outer shells, whereby each mounting base is configured to engage a shoulder of a brush, one on the top shoulder, and one on the bottom shoulder. The shells are shown being mounted on two different size brushes of different widths 770 that have a relatively similar thickness. The outer shells are connected to each other and the switch and the power source only by conductive leads and the body of the brush, once they are mounted on the brush. Two independent ferrule coverings are placed on opposite sides of the brush, and may compensate for any slight variations in the width of one brush to another. An independently mounted switch is shown mounted relative to Axis B side view.

Any of the embodiments may include a safety mechanism to shut the light(s) off within a certain time period, such as 3-5 minutes after initial activation.

FIGS. 9A-9E show a preferred embodiment of a lighting accessory configured to be installed on an angle-ferruled brush. The lighting accessory has an outer shell 709, and the outer shell is secured to the gripping end of a paintbrush and engages at least one portion of the upper shoulder 703*a* of the paintbrush. The outer shell 709, shown in FIGS. 9A-9E has an outer shell extension 710, which extends from the shoulder portion of the outer shell, covering at least one portion of the transitional narrowing part of the brush handle. It also includes at least one ferrule covering material 707 positioned over at least a portion of the ferrule 701*a* and handle 700, and between the outer shell 709 and the handle 700 or gripping end. The outer shell 709 also includes a mounting base portion 710*c*, and at least one part of this mounting base portion 710*c* is relatively thin and flat, as seen in FIGS. 9A-9E. Integral light housings 710*f* extend from the integrally moulded mounting base and outer shell, with one light housing 710*f* located on each side of the outer shell 709, as seen from a top view when the outer shell is mounted on the paintbrush. The light housings 710*f* are mounted at a fixed oblique angle forward and outward from the mounting base 710*c* in relation to Axis A (top view), and forward and upward in relation to Axis B (side view). A riser and light holders within each integrally formed light housing, together form the raised rigid portion of the outer shell to house the light sources as shown in FIG. 4A to FIG. 4D. Now referring to FIG. 10D, two light housing outer surfaces Axis H are pointed forward and upward in relation to Axis B (side view), whereby at least one outer surface of a housing Axis H forms an angle beta β2 of between approximately 5-15 degrees, preferably about 10 degrees, upward in relation to Axis B. FIG. 10C also shows the outside surface edge of the light housing Axis H pointed forward at an oblique angle outwardly, which may be a cant angle θ1 of 20 to 30 degrees and preferably approximately 25 degrees, in relation to Axis A (top view) of the paintbrush handle.

Expanded views of the light housings are shown in FIGS. 4A-4D, and risers 710*d* are shown more clearly in FIG. 4A-FIG. 4C, with 2 light sources within each light housing. This embodiment could also be configured to have 3 light sources within each light housing, positioned on each side of the brush, as shown in the expanded views of the light housing shown in the three cross-sectional views of FIGS. 11A-11C, and FIG. 13A and FIG. 13B. Still referring to FIG. 4A-FIG. 4C, and FIG. 13A and FIG. 13B, each integrally formed light housing has at least one first light holder 710*g* and at least one second light holder 710*m* within, and at least one first LED light source 720 held in position within a first light holder 710*g*, and at least one second LED light source 730 fixed in position within a second light holder 710*m*. At least one first light holder 710*g* centerline Axis P is pointed in a first forward direction at an oblique angle outwardly, which may be a cant angle θ1 of 20 to 30 degrees and preferably approximately 25 degrees, in relation to Axis A (top view) of the paintbrush. Also, at least one first light holder 710*g* is pointed in a forward direction at an oblique angle upward and may be a cant angle θ1 of 5 to 15 degrees, and preferably approximately 10 degrees in relation to Axis B (side view), when the outer shell 709 is mounted on the paintbrush. At least one second light holder 710*m* centerline Axis P is pointed in a second forward direction at an oblique angle outwardly, which may be a cant angle θ2 of 5 to 15 degrees, and preferably approximately 10 degrees in relation to Axis A (top view) of the paintbrush, and at least one second light holder 710*m* (which may be the same second light holder) is pointed in a second forward direction at an oblique angle upward which may be a cant angle θ2 of 5 to 15 degrees, and preferably approximately 10 degrees in relation to Axis B (side view). As noted, the light cone projected from the second LED light source 730 has a narrower cone than the cone of light projected from the first LED light source 720. A first LED fixed within a first light holder 710*g* is preferably a 10,000 MCD or higher powered light emitting diode, of preferably a 20 to 40 degree cone and a wider, less focused beam of light than a second higher powered LED. A second LED 730 fixed within a second light holder 710*m* may be a 20,000 MCD light emitting diode having approximately a 15 to 20 degree light cone. The first and second LED are preferably positioned to provide some overlap in the light beams, most desired in the area of the edge of the bristles and the lights cones are overlapped in this area. It should be known that lights 720 and 730 may be interchangeable to create an alternate embodiment. Any of the embodiments described may be altered to include a higher-powered light, and a heat sink or other heat regulating mechanism may be held within the natural perimeter of the handle, which may be within a power source storage space 744, as seen in FIG. 15, 16, 20, and FIG. 21, or within the confines of a handle that has been modified, such as shown in FIG. 26A.

Referring again to FIGS. 9A-9E, the light holders 710*g*, 710*m* within the light housings positioned on the outer shell 709 and outer shell extension 710 also have relief areas 710*h* within a portion of the mounting base 710*c*, allowing space for the wires 740 or conductive leads to connect the one or more lights and at least one first switch 741 within the outer shell 709 and outer shell extension 710. The wires (or conductive leads) 740 are protected in the relief areas 710*h* between the gripping end of the paintbrush and the mounting base 710*c* of the outer shell 709 and outer shell extension 710. The connections 736 between the LED leads and the wires (or conductive leads) are preferably positioned within the cavity 710*e* of the light housing near the base of the light holders 710*g*, 710*m*. A power source comprising multiple batteries (preferably 3-AAA held within a battery holder 747, having a central positive conductor 754 at one end, and a negative conductor 755 at the other end), within a battery housing 743*a* is mounted on the gripping end of the paintbrush, and fixed secured in position behind the back of the ferrule (preferably relatively centered to Axis A from a top view and B from a side view) by means of a battery housing connector 743 which is fixed to a modified brush handle, the handle having been modified by cutting a portion off 700*a* to produce a relatively flat mounting surface, and then drilling a pilot hole 749 into it. The battery housing connector is fastened to the end of the handle 700 by a conductive fastener 748, which is fastened into the pilot hole, and which makes contact with the battery holder and the positive lead(s) 754 electrically linked to the lights and a switch. The battery housing connector 743 is configured to receive a battery housing 743*a* (which is inserted into the battery housing connector hollowed out area 782), and a power source electrically connected by the conductive leads or wires 740 to the first and second LEDs 720,730. A switch assembly 741 is preferably mounted at the shoulder portion of the outer shell 709, positioned between the front of the ferrule 701*b* (Axis Y, side view, FIG. 21) and the narrowest portion of the handle (Axis Z side view FIG. 21), preferably positioned relatively centered to Axis A (top view), and preferably angled backward at an oblique angle Φ1 of between 75 and 85 degrees, in relation to axis B (side view), as shown in FIGS. 9A-9E. An alternate embodiment is shown in FIG. 24 with a first switch and a second switch, whereby the switch assembly is recessed into the handle of a modified brush, with both switches angled backward at and oblique angle Φ1, of between 35 and 85 degrees. Again referring to FIGS. 9A-9E, the switch assembly 741 is electrically linked to the batteries and the first and second LEDs 720, 730 for controlling operation thereof. Conductive leads 740, which may be electrical wiring (preferably braided), extend from the switch assembly 741 and the wires are positioned along the handle and inserted through the battery housing connector relief areas 710*h*. The wires are protected between the paintbrush handle and one or more protective coverings 858, 858*a*, and electrically linked to the positive and negative terminals of the power source by means of a battery holder having a positive contact 754 and a negative contact 755 by means of what may be one or more connections of conductive components. Shown in more detail in FIG. 12, a switch locator 741*c* (which may be a textured surface on the protective covering) and protector such as a curb 741*a* is positioned around the switch activation means 741*d*, whereby the activation occurs when the push button is pressed below the curb within a recessed portion 741*b* between the activation means and the curb.

A protective covering of one or more pieces of heat-shrinkable plastic 758 and 758*a* is employed as a sealed, form-fitting protective covering 758, enveloping the gripping end of the paintbrush handle 700 from the base of the bristles 704*a* to the back of the battery housing 743*a*, securing all components in place, and allowing light to pass through at least part of the covering 758*a*. The protective covering is reinforced with anti-wear protection 758*b*. The preferred protective covering, such as heat shrinkable plastic, adds no more than an approximately 1 mm total thickness to the ferrule gripping area. The battery source is accessible by an access cover, preferably a threaded battery housing and threaded end cap 751, shown on FIGS. 9A-9E. The threaded end cap has a central negative conductor 755 (which may be a spring or a leaf spring formation), and has outside threads 753, corresponding with the battery housing having inside threads 752, of which it is turned into. A resilient compressible seal (O-ring) 751*b* is slid on over the outside threads 753 of the end cap, and positioned between the threaded battery housing and the end cap 751. The end cap has an attached strap-like loop 751*c* for hanging the lighted paintbrush when not in use. A bristle base protector 705, in the form of a resilient removable band, is stretched completely over the front of the ferrule 751*b* and the base of the bristles 704*a*, and interlocks to the gripping end by a corresponding groove 705*c*, moulded into the back side of the bristle base protector and opposite shaped channel 760, which is fixed in position on the outer surface of the light permeable protective covering 758*a*, near the front of the ferrule 701*b*. The bristle base protector has at least one integral rounded recessed shape (finger recesses 705*b*). Gripping textures 762 may be positioned on the handle of the brush, as shown in FIG. 25.

Figure 58:
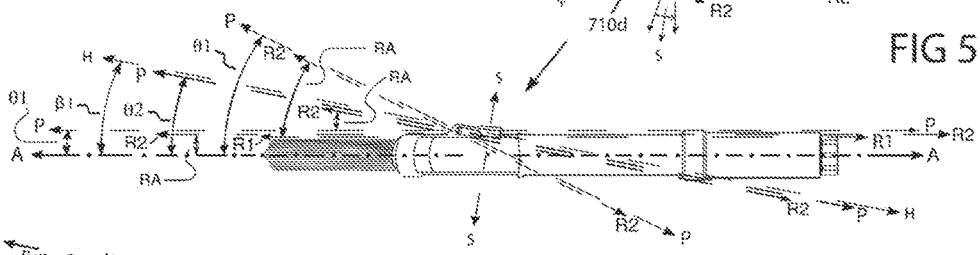
FIG. 58 shows a top view of the lighted paintbrush of FIG. 54 with bristles in a relaxed state, and the angling of the lights.
Figure 59:
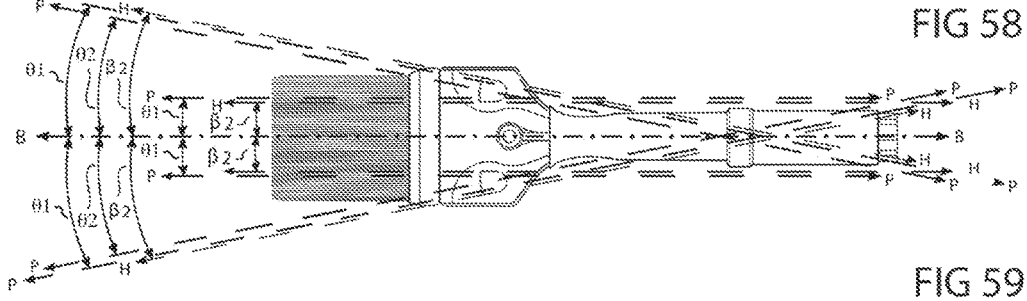
FIG. 59 shows a side view of the lighted paintbrush of FIG. 58 and the angling of the lights.
Figure 60:
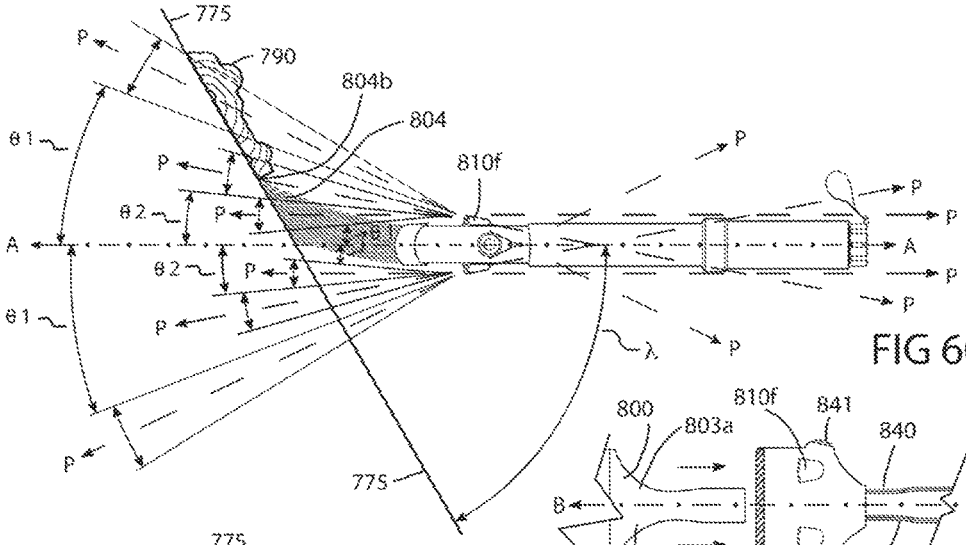
FIG. 60 illustrates a top view of an alternate embodiment of a lighted paintbrush in painting action close to a wood molding, and the traditional angling of the brush handle Axis A away from the molding, creating an oblique angle ($\lambda$ lambda) between the center of the brush Axis A and surface being painted, as well as a variance in a first light source and a second light source in relation to the edge of the bristles.
Figure 61:
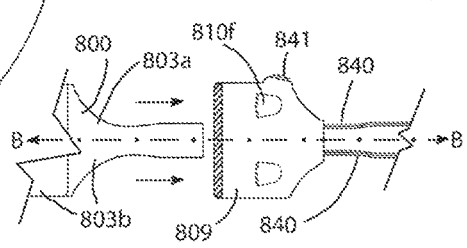
FIG. 61 shows a partial side view of the apparatus of FIG. 60 being mounted on a brush with a modified handle.
Figure 62:
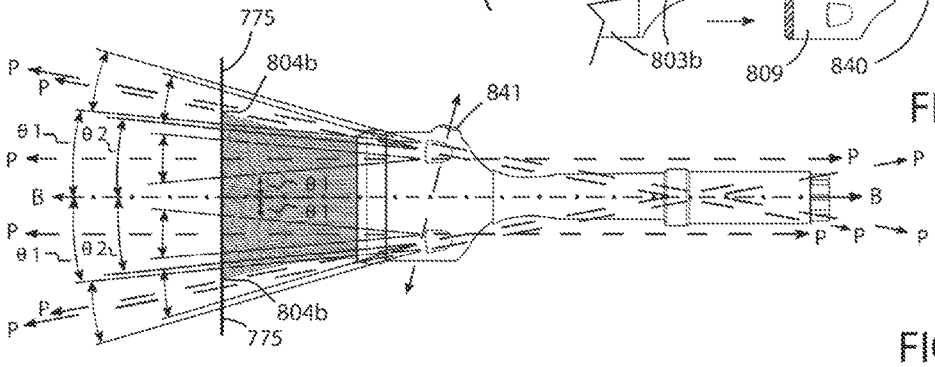
FIG. 62 shows a side view of the embodiment of FIG. 60, in painting action with the bristles in a compressed state, brushing away from the viewer, showing the angling of the lights.
Figure 63:
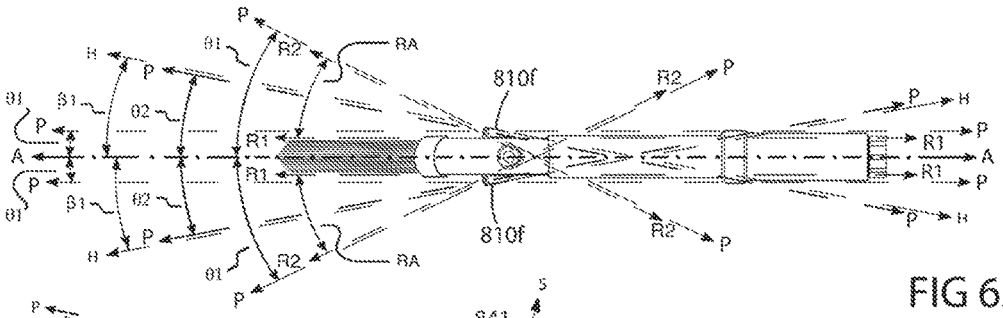
FIG. 63 shows the embodiment of FIG. 60, but with the bristles in a relaxed state, and the angling of the lights.
Figure 64:
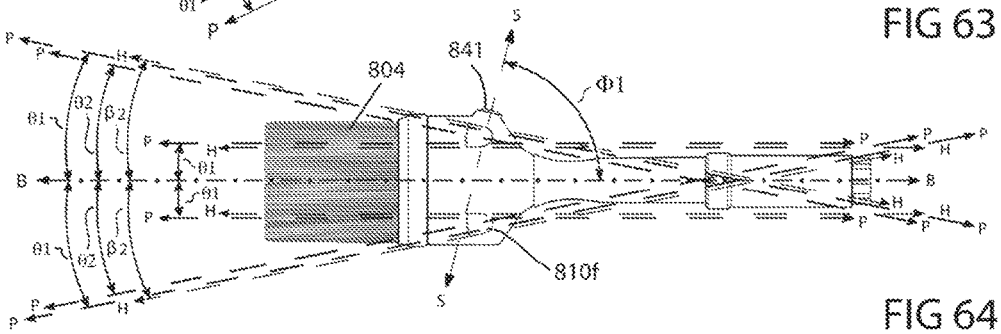
FIG. 64 shows the lighted paintbrush of FIG. 62, with the bristles in a relaxed state, and the angling of the lighting components.
Figure 65A:
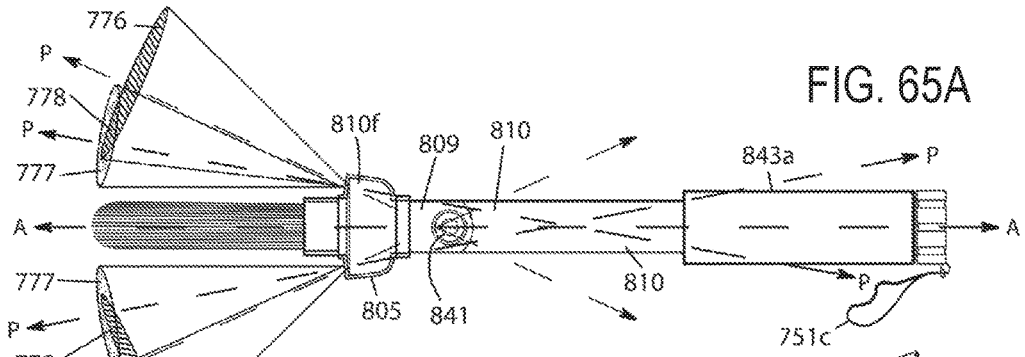
FIGS. 65A-65D illustrate an alternate embodiment of a lighted paintbrush apparatus on a rectangular brush with a modified handle, and its assembly, and various configurations of lighting, coverings, and the rays emitted.
Figure 65B:
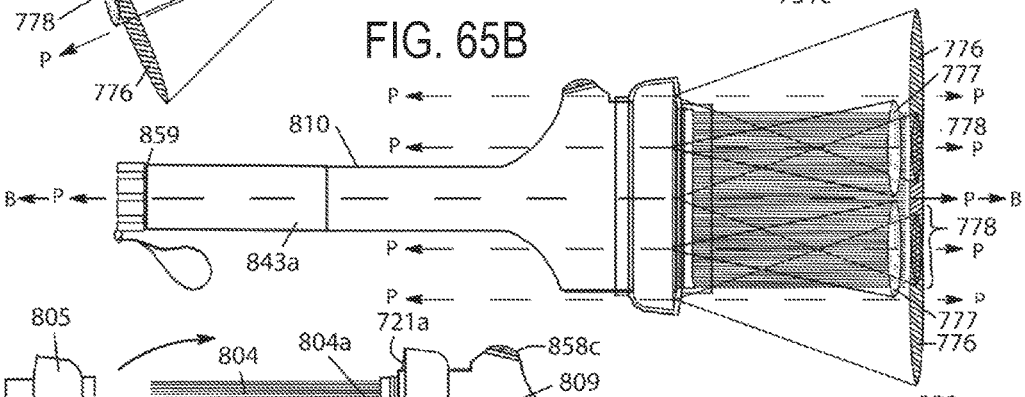
Figure 65C:
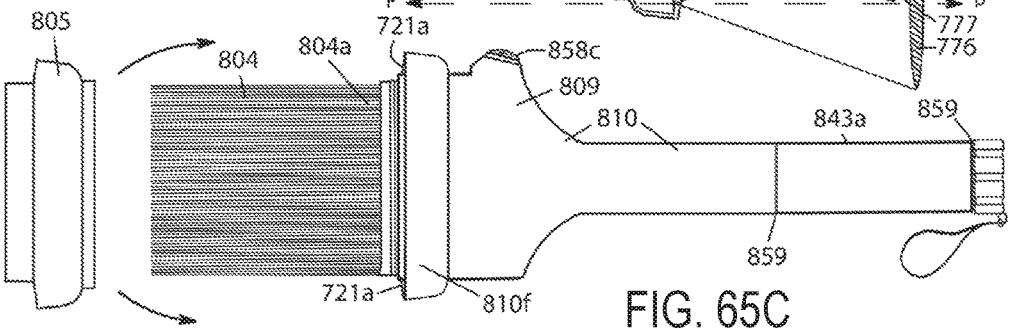
Figure 65D:
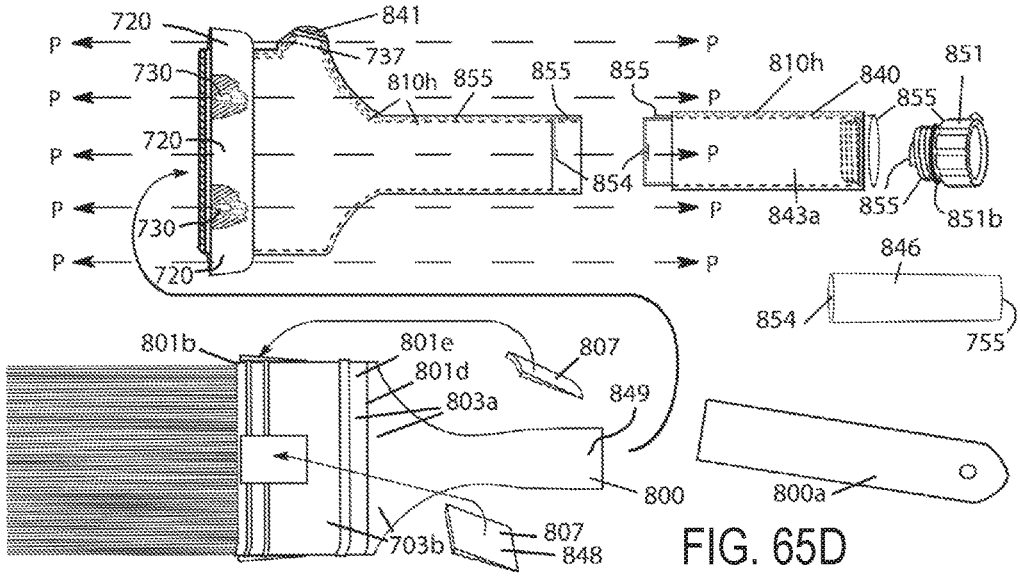
Figures 66A, 66B, 66C, 66D:
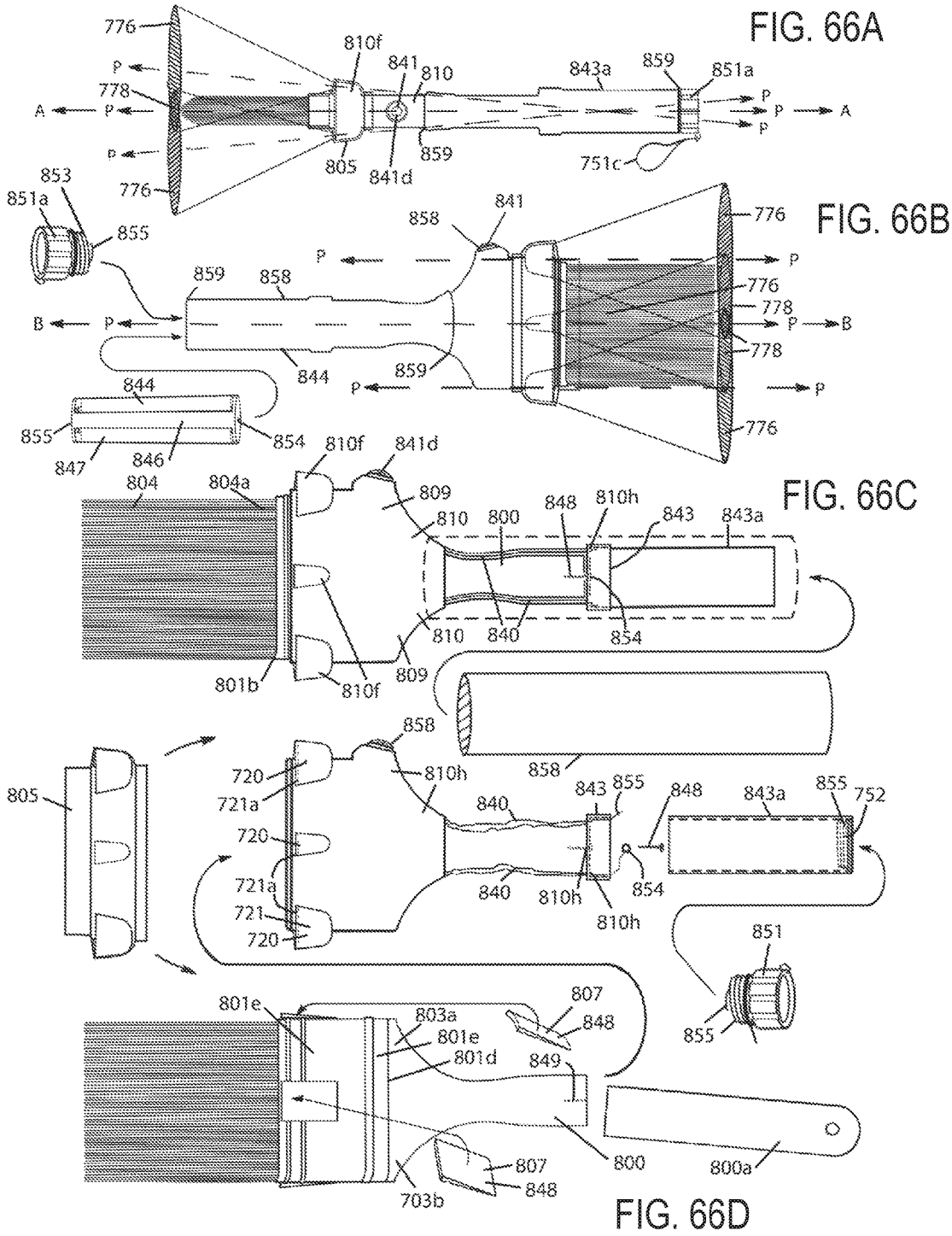
FIGS. 66A-66D illustrates an alternate embodiment of a lighted paintbrush apparatus on a rectangular brush with a modified handle, and its assembly, as well as various configurations of lighting and protective coverings, and the rays emitted.

FIGS. 37A-37E show a preferred embodiment of a lighting accessory, configured to be installed on a rectangular-ferruled brush. The lighting accessory has two outer shells 809, and the outer shells are configured to engage the gripping end of a paintbrush. One outer shell engages at least one portion of the upper shoulder 803*a* and the other outer shell engages at least one portion of the lower shoulder 803*b* of the paintbrush. The outer shells 809, shown in FIGS. 37A-37E have an outer shell extension 810, which extends from the shoulder portion of the outer shell, covering at least one portion of the transitional narrowing part of the brush handle. It also includes an (optional) ferrule covering material 807 positioned over at least a portion of the ferrule 801*e* and handle 800, and positioned between the outer shells 809 and the handle 800 or gripping end. The outer shells 809 also includes a mounting base portion 810*c*, and at least one part of this mounting base portion 810*c* is relatively thin and flat, as seen in FIGS. 37A-37E. Integral light housings 810*f* extend from the integrally moulded mounting base and outer shell, with one light housing 810*f* located on one side of each outer shell 809, as seen from a side view when the outer shells are mounted on the paintbrush. The light housings are mounted on only one side of the brush in relation to Axis A (top view). FIG. 58 shows the outside surface edge of the light housing Axis H pointed forward at an oblique angle outwardly, which may be a cant angle θ1 of 20 to 30 degrees and preferably approximately 25 degrees, in relation to Axis A (top view) of the paintbrush handle. One light housing is located on each side of Axis B (side view) and mounted on the brush in a fixed positioned relative to the gripping end. Turning to FIG. 59, one light housing outer surface Axis H is pointed forward and upward in relation to Axis B (side view), and one light housing outer surface Axis H is pointed forward and downward in relation to Axis B (side view), whereby the outer surface of a housing Axis H, forms an angle beta β2 of between approximately 5-15 degrees, preferably about 10 degrees, upward in relation to Axis B and between approximately 5-15 degrees, preferably about 10 degrees downward in relation to Axis B, as shown in FIG. 59. Referring again to FIG. 13A and FIG. 13B, the light holders 710*g* and 710*m* within the light housings 810*f* are mounted at a fixed oblique angle forward and outward from the mounting base 810*c* in relation to Axis A (top view), as shown on the right side of the brush in FIG. 58 (top view). A riser 710*d* and light holders within each integrally formed light housing, together form the raised rigid portion of the outer shell to house the light sources, as seen in FIG. 13A.

Figure 13B:
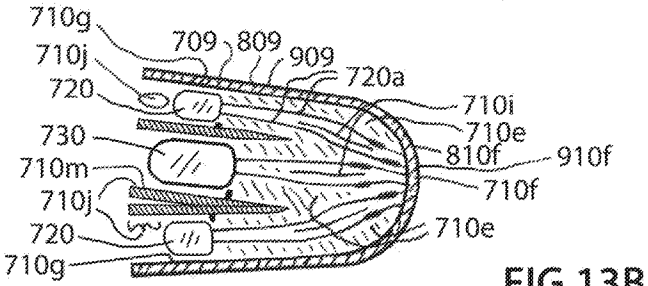
FIG. 13B shows a cross-section view through the 3 light holders which are held within the light housing mounted on the side of the brush shown in FIG. 11B, showing the placement of light holders and LED's within the housings.
Figure 13C:
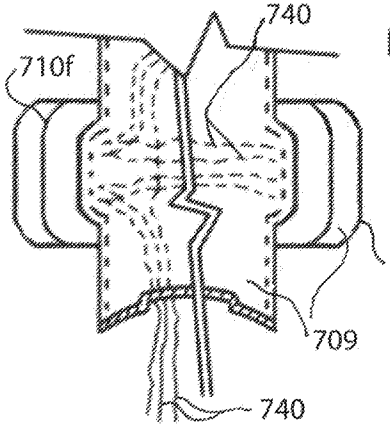
FIG. 13C shows a partial rear view of an outer shell and light housings from the brush of FIG. 11B, when the light holders are angled within the housings.
Figure 13D:
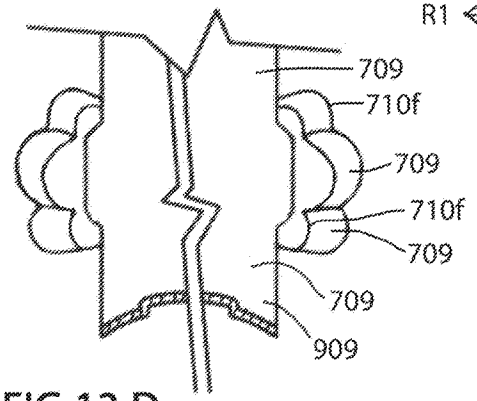
FIG. 13D shows a partial rear view of an alternate outer shell and light housing configuration from the brush of FIG. 11B, and FIG. 13B, with a thin outer shell surrounding each tubular light holder.
Figure 15:
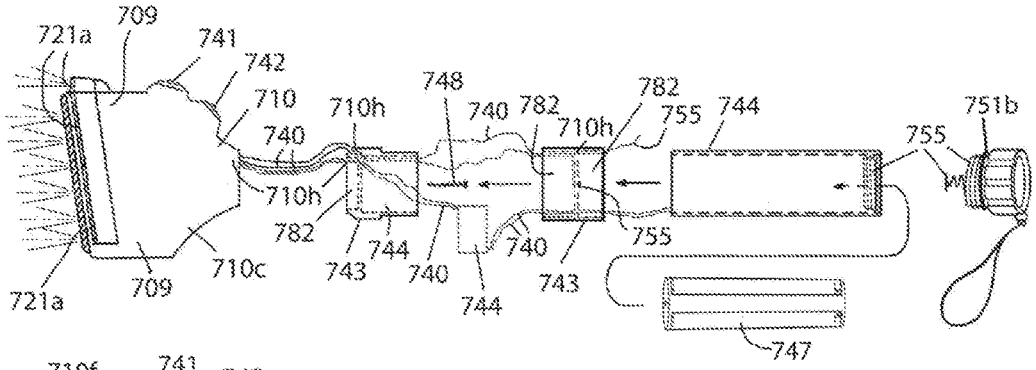
FIG. 15 illustrates a side view of an alternate illumination means mountable to a brush comprising multiple light sources, a primary switch, a secondary switch, and two storage compartments joined by means of a common coupler, which is a portion of the 2-part battery housing connector.
Figure 16:
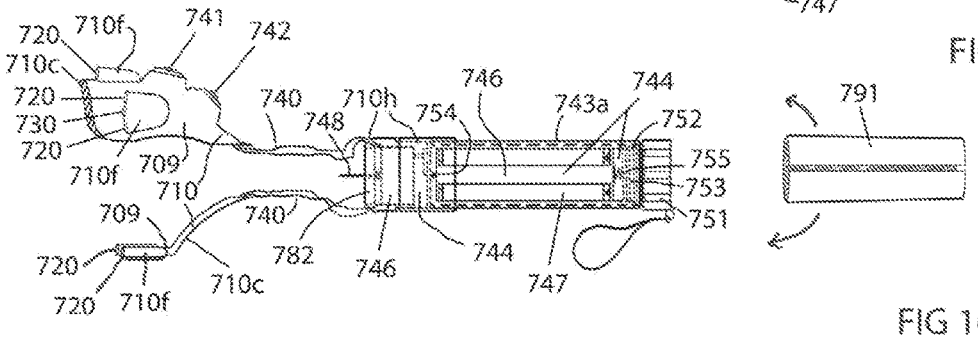
FIG. 16 illustrates a side view of an alternate illumination means with two outer shells, one comprising two switches and three light housings configured to be mountable to the upper shoulder of the brush, and the other shell comprising two light housings configured to be mountable to the lower shoulder of a brush, two storage compartments and two power sources (one wrapped around the outside surface of another battery housing).

Expanded views of the light housings are illustrated in FIG. 13B, showing 3 light sources within each light housing, and risers 710*d* are shown in the three cross-sectional views of FIG. 13A, which shows three illustrations, a cross-sectional view through each of the three light holders positioned within the same housing. Still referring to FIG. 13A and FIG. 13B, each integrally formed light housing has at least one first light holder 710*g* and at least one second light holder 710*m* within, and at least one first LED light source 720 held in position within a first light holder 710*g*, and at least one second LED light source 730 fixed in position within a second light holder 710*m*. This embodiment is shown in FIG. 54-FIG. 59, and FIG. 58 shows light housings positioned on the right side of the brush, and Axis P indicating the center of each light holder. FIG. 58 also shows at least one first light holder 710*g* and light holder centerline Axis P pointed in a first forward direction at an oblique angle outwardly, which may be a cant angle θ1 of 20 to 30 degrees and preferably approximately 25 degrees, in relation to Axis A (top view) of the paintbrush and Axis P.

Now referring to FIGS. 37A-37E, FIG. 56 and the enlarged view of FIG. 13B, at least one first light holder 710*g* and light holder centerline Axis P is pointed in a forward direction at an oblique angle upward and may be a cant angle approximately θ1 of 5 to 15 degrees, and preferably about 10 degrees in relation to Axis B (side view), when the light housing 810*f* and outer shell 809 is mounted on the paintbrush. At least one second light holder 710*m* and light holder centerline Axis P is pointed in a second forward direction at an oblique angle outwardly, which may be a cant angle θ2 of 5 to 15 degrees, and preferably approximately 10 degrees in relation to Axis A (top view) of the paintbrush, and at least one second light holder 710*m* (which may be the same second light holder) is pointed in a second forward direction at an oblique angle upward which may be a cant angle θ2 of 5 to 15 degrees, and preferably approximately 10 degrees in relation to Axis B (side view).

The light housing positioned on the lower shoulder has at least one first light holder 710*g* pointed in a first forward direction at an oblique angle outwardly, which may be a cant angle θ1 of 20 to 30 degrees and preferably approximately 25 degrees, in relation to Axis A (top view) of the paintbrush. Also, at least one first light holder 710*g* is pointed in a forward direction at an oblique angle downward and may be a cant angle θ1 of 5 to 15 degrees, and preferably approximately 10 degrees in relation to Axis B (side view), when the outer shell 709 is mounted on the paintbrush. At least one second light holder 710*m* is pointed in a second forward direction at an oblique angle outwardly, which may be a cant angle θ2 of 5 to 15 degrees, and preferably approximately 10 degrees in relation to Axis A (top view) of the paintbrush, and at least one second light holder 710*m* (which may be the same second light holder) is pointed in a second forward direction at an oblique angle downward which may be a cant angle θ2 of 5 to 15 degrees, and preferably approximately 10 degrees in relation to Axis B (side view).

As noted, the light cone projected from the second LED light source 730 has a narrower cone than the cone of light projected from the first LED light source 720. A first LED fixed within a first light holder 710*g* is preferably a 10,000 MCD or higher powered light emitting diode, of preferably a 20 to 40 degree cone and a wider, less focused beam of light than a second higher powered LED. A second LED 730 fixed within a second light holder 710*m* may be a 20,000 MCD light emitting diode having approximately a 15 to 20 degree light cone. The first and second LED are preferably positioned to provide some overlap in the light beams, most desired in the area of the edge of the bristles and the lights cones are overlapped in this area.

Referring again to FIG. 13B and FIG. 13B, the light holders 710*g*, 710*m* within the light housings positioned on the outer shells 809 and outer shell extension 810 also have relief areas 710*h* within a portion of the mounting base 710*c*, allowing space for the wires 840 or conductive leads to connect the one or more lights and at least one first switch assembly 741 within the outer shell 809 and outer shell extension 810. The wires (or conductive leads) 840 are protected in the relief areas 710*h* and 810*h* between the gripping end of the paintbrush and the mounting base 710*c* of the outer shell 809 and outer shell extension 810. The connections 736 between the LED leads and the wires (or conductive leads) are preferably positioned within the cavity 710*e* of the light housing near the base of the light holders 710*g* 710*m*. A power source comprising multiple batteries (preferably 3-AAA held within a battery holder 847, having a central positive conductor 854 at one end, and a negative conductor 855 at the other end), within a battery housing

843*a* is mounted on the gripping end of the paintbrush, and fixed secured in position behind the back of the ferrule 801*d* (preferably relatively centered to Axis A from a top view and B from a side view) by means of a battery housing connector 843 which is fixed to a modified brush handle, the handle 800 having been modified by cutting a portion off 800*a* to produce a relatively flat mounting surface, and then drilling a pilot hole 849 into it. The battery housing connector is fastened to the end of the handle 800 by a conductive fastener 848, which is fastened into the pilot hole 849, and which makes contact with the battery holder and the positive lead(s) 854 electrically linked to the lights and a switch. The battery housing connector 843 is configured to receive a battery housing 843*a* (which is inserted into the battery housing connector hollowed out area 882), and a power source electrically connected by the conductive leads or wires 840 to the first and second LEDs 720,730. A switch assembly 841 is preferably mounted relatively centered between the outer shells 709, positioned between the front of the ferrule 801*b* (Axis Y, side view, FIGS. 67A-67C) and the narrowest portion of the handle (Axis Z side view FIG. 67A-67C), preferably positioned relatively centered to Axis B (side view), and preferably angled backward at an oblique angle Φ1 of between 75 and 85 degrees, in relation to axis B (side view), as shown in FIG. 58. The switch may also be recessed into the handle, using methods similar to those of the alternate embodiment as shown in FIG. 24. Again referring to FIGS. 37A-37C, the switch assembly 841 is electrically linked to the batteries and the first and second LEDs 720, 730 for controlling operation thereof. Conductive leads 840, which may be electrical wiring (preferably braided), extend from the switch assembly 841, and the wires are positioned along the handle and inserted through the battery housing connector relief areas 810*h*. The wires are protected between the paintbrush handle 800 and one or more protective coverings 858, 858*a*, and electrically linked to the positive and negative terminals of the power source by means of a battery holder having a positive contact 854 and a negative contact 855 and what may be one or more connections of conductive components. Shown in more detail in FIG. 12, a switch locator and protector such as a curb 741*a* is positioned around the switch activation means 841*d*, whereby the activation occurs when the push button is pressed below the curb within a recessed portion 841*b* between the activation means and the curb.

A protective covering of one or more pieces of heat-shrinkable plastic 858, 858*a* is employed as a sealed, form-fitting protective covering 858, enveloping the gripping end of the paintbrush handle 800 from the base of the bristles 804*a* to the back of the battery housing 843*a*, securing all components in place, and allowing light to pass through at least part of the covering 858*a*. The protective covering is reinforced with anti-wear protection 858*b*. The preferred protective covering, such as heat shrinkable plastic, adds no more than an approximately 1 mm total thickness to the ferrule gripping area. The battery source is accessible by an access cover, preferably a threaded battery housing 843*a* and threaded end cap 751, shown on FIGS. 37A-37E. The threaded end cap has a central negative conductor 755 (which may be a spring or a leaf spring formation), and has outside threads 853, corresponding with the battery housing having inside threads 852, of which it is turned into. A resilient compressible seal (O-ring) 851*b* is slid on over the outside threads 853 of the end cap, and positioned between the threaded battery housing and the end cap 851. The end cap has an attached strap-like loop 851*c* for hanging the lighted paintbrush when not in use. A bristle base protector 805, in the form of a resilient removable band, is stretched completely over the front of the ferrule 801*b* and the base of the bristles 804*a*, and interlocks to the gripping end by a corresponding groove 805*c*, moulded into the back side of the bristle base protector and opposite shaped channel 860, which is fixed in position on the outer surface of the light permeable protective covering 858*a*, near the front of the ferrule 801*b*. The bristle base protector may have at least one integral rounded recessed shape (finger recesses not shown). Gripping textures may be positioned on the handle of the brush.

FIGS. 78A-78K show an illumination means for a small round brush, with a handle modified (cut off 900*a*), with a ferrule 901, which is not an angled or tapered ferrule, with one light source only, preferably an LED. The light source is held within an integrally moulded light holder, light housing 910*f* and a riser 910*d* which lifts the rear portion of the light holder off the lateral Axis R1 of the relatively thin mounting base 910*c*, compensating for the absence of a tapered ferrule. This integral formation aims the light holder center axis P downward in relation to axis B (side view). FIGS. 78A-78K also show a relatively long outer shell extension 910, which may have conductive leads such as wires, or may be formed thin strips of conductive material, such as copper, which have been etched from a layer and fixed to the outer shell extension, due to the minimal size of the brush. The outer shell extension covers a narrow but substantial length of the upper portion 903*a* of the brush, and is integrally moulded and configured to have one portion of a battery housing connecter 943. The battery housing connector is shaped and sized at one end to receive a portion of the brush handle 900 within a hollowed out area 982. The other end is shaped and sized to have a fixed positive contact 954 relatively centered, which is inserted into an adapter (also a part of the battery housing connector). The adapter has a relief area 910*h* that allows a conductive lead 955 (which may also be a negative contact) to pass through, and is hollow in the center to allow the power source 946 (multiple batteries) to make contact with the fixed positive contact. The adapter receives the first part of the battery housing connector in one end, and has outside threads 953 (which preferably may be at least partly conductive) at the other end as a means to thread into the inside threads 952 of a battery housing. The end of the battery housing 943*a* is at least partly conductive, and forms a sealed connection 959 between a threaded end cap 951 (employed as a negative contact 955) and an O-ring 951*b*, positioned between the end cap and the battery housing. The light housing 910*f* and switch 941 are positioned relatively centered in relation to Axis A. FIG. 91 shows additional detail of the brush of FIGS. 78A-78K, showing Axis H, and the angle of the light housing beta β2 as approximately 5-15 degrees, preferably 10 degrees, in relation to Axis B. The switch assembly 941 is mounted relatively centered on Axis S, at an angle Φ1, approximately 90 degrees, relatively perpendicular to Axis B. The light source is held within a light holder, and the center of the light holder Axis P is shown in FIGS. 78A-78K, and shown in more detail in FIG. 79L (where it shows the light pointed at the edge of the bristles 904*b*, when the bristles 904 are bent against a painting surface 775), pointed forward and downward towards Axis B at θ1, between 5 and 15 degrees, and preferably 10 degrees. FIG. 79L shows Axis R2 (the most forward part of the riser) paralleling the light source, and pointing toward Axis B at angle Psi ψ, preferably approximately 10 degrees (since it is a round brush without a tapered ferrule).

Referring again to FIGS. 78A-78K, the switch is shown with a push-button switch actuator 941*d*, which may be a relatively small tactile switch, protected and surrounded by a curb 941*a*, which may also act as a switch locator. A recessed portion 941*b* is positioned between the switch actuator and the curb. The bottom image in FIGS. 78A-78K shows an alternate positioning of a switch 941, offset in relation to the light housing 910*f* and Axis A and/or B, and may be positioned at any location between Axis A and Axis B that may be accessible and comfortable for the painter on that particular brush. The protective covering is a light permeable fixed covering, preferably one piece of heat shrinkable plastic tubing 958*a*, that is positioned and installed from the base of the bristles to the distal end of the battery housing, holding all components within the tubing in place (including the battery housing connector). A bristle base protector 905, in the form of a resilient removable band, is stretched completely over the front of the ferrule and the base of the bristles.

FIG. 90 shows a relatively medium-sized round brush, with one light source, and a slightly tapered ferrule, and slightly longer bristles than the brush of FIG. 79L. Light housing angles are shown in FIG. 90, from behind the light source. In relation to Axis R2, the angle Psi ψ, is between 2 degrees and 12 degrees, and preferably approximately 7 degrees, forwards and downwards towards Axis B. The required riser angle (raised from the back to point the light to the edge of the bristles 904*b*) is partly compensated by the angle of the tapered ferrule. The angle θ1 is shown at between 2 degrees and 12 degrees, preferably approximately 7 degrees, forwards and downwards towards Axis B. FIG. 79K shows other detail of the brush of FIG. 90, specifically the angle RA (between R1 and R2), at approximately 5 degrees.

In FIG. 79H, the large round brush is shown with a first light source pointed forward and outward at angle θ1 between 5 and 15 degrees, preferably 10 degrees, in relation to Axis A. Also in FIG. 79H, a second light source is shown, pointed in a forward direction at θ2 between 0 and 5 degrees, preferably 0 degrees, in relation to Axis A. Now referring to FIG. 79I, and in more detail in FIG. 79J, the same brush is shown from a side view, showing a first light source pointed forward and downward at θ1 between 5 and 15 degrees, preferably 10 degrees, in relation to Axis B. FIG. 79I also shows a second light source pointed in a forward direction at an angle θ2 between 0 and 10 degrees upward, preferably 5 degrees upward, from Axis B.

Thus, in an aspect, there is provided an illumination apparatus attachable to a paintbrush, comprising: a plurality of lights attached to a paintbrush, each of the plurality of lights strategically aimed to provide illumination to one or more specific target areas; whereby, in use, the plurality of lights define a target areas in relation to where an edge of bristles are bent and compressed during a painting process.

In an embodiment, the plurality of lights include at least one light adapted to project light over a wider area than another one of the plurality of lights adapted to project light over a narrower area.

In another embodiment, the plurality of lights are adapted to project a cone of light aimed to provide illumination to the one or more specific target areas.

In another embodiment, the plurality of lights include at least one precision, pin-point light source strategically aimed to target one of the specific target areas.

In another embodiment, the at least one precision, pin-point light source is a low-power laser light source.

In another embodiment, the at least one precision, pin-point light source is aligned with at least one other light and targets the center of the illumination area of the at least one other light.

In another embodiment, the at least one precision, pin-point light source is adapted to define a target point to which the edge of the bristles should be bent and compressed during the painting process, in order to obtain substantially optimal performance from the brush when painting an edge.

In another embodiment, at least one or more of the plurality of lights are separately switched in order to be separately controllable.

In another embodiment, the plurality of lights are powered by one or more battery housing connectors configured to be attachable to a gripping end of the paintbrush.

In another embodiment, the plurality of lights are protected by one or more sealed, form-fitting, protective coverings.

In another aspect, there is provided a method of illuminating a paintbrush, comprising: providing a plurality of lights attached to the paintbrush, and aiming each of the plurality of lights strategically to provide illumination to one or more specific target areas; whereby, in use, the plurality of lights define a target areas in relation to where an edge of bristles are bent and compressed during a painting process.

In an embodiment, the method further comprises adapting at least one of the plurality of lights to project light over a wider area than another one of the plurality of lights adapted to project light over a narrower area.

In an embodiment, the plurality of lights are adapted to project a cone of light aimed to provide illumination to the one or more specific target areas.

In another embodiment, the method further comprises providing at least one precision, pin-point light source as one of the plurality of lights to target one of the specific target areas.

In another embodiment, the method further comprises providing a low-power laser light source as the at least one precision, pin-point light source.

In another embodiment, the method further comprises aligning the at least one precision, pin-point light source with at least one other light and targeting the center of the illumination area of the at least one other light.

In another embodiment, the method further comprises defining with the at least one precision, pin-point light source a target point to which the edge of the bristles should be bent and compressed during the painting process, in order to obtain substantially optimal performance from the brush when painting an edge.

In another embodiment, the method further comprises configuring at least one or more of the plurality of lights to be separately switchable in order to be separately controllable.

In another embodiment, the method further comprises powering the plurality of lights by one or more battery housing connectors configured to be attachable to a gripping end of the paintbrush.

In another embodiment, the method further comprises protecting the plurality of lights by one or more sealed, form-fitting, protective coverings.

While illustrative embodiments have been described above by way of example, it will be appreciated that various changes and modifications may be made without departing from the scope of the system and method, which is defined by the following claims.

The invention claimed is:

1. An illumination apparatus attachable to a paintbrush, comprising:

a plurality of lights attached to a paintbrush, each of the plurality of lights strategically aimed to provide illumination to one or more specific target areas;

whereby, in use, the plurality of lights include at least one light adapted to project light over a wider area than another one of the plurality of lights adapted to project over a narrower area, and the plurality of lights define target areas in relation to where an edge of bristles are bent and compressed during a painting process.

2. The illumination apparatus of claim 1, wherein the plurality of lights are adapted to project a cone of light aimed to provide illumination to the one or more specific target areas.

3. The illumination apparatus of claim 1, wherein the plurality of lights include at least one precision, pin-point light source strategically aimed to target one of the specific target areas.

4. The illumination apparatus of claim 3, wherein the at least one precision, pin-point light source is a low-power laser light source.

5. The illumination apparatus of claim 4, wherein the at least one precision, pin-point light source is aligned with at least one other light and targets a center of the illumination area of the at least one other light.

6. The illumination apparatus of claim 4, wherein the at least one precision, pin-point light source is adapted to define a target point to which the edge of the bristles should be bent and compressed during the painting process, in order to obtain substantially optimal performance from the paintbrush when painting an edge.

7. The illumination apparatus of claim 1, wherein at least one or more of the plurality of lights are separately switched in order to be separately controllable.

8. The illumination apparatus of claim 1, wherein the plurality of lights are powered by one or more battery housing connectors configured to be attachable to a gripping end of the paintbrush.

9. The illumination apparatus of claim 1, wherein the plurality of lights are protected by one or more sealed, form-fitting, protective coverings.

* * * * *